US008820212B2

(12) United States Patent
Rostocil

(10) Patent No.: US 8,820,212 B2
(45) Date of Patent: Sep. 2, 2014

(54) URBAN COMBAT SYSTEM AUTOMATIC FIREARM HAVING AMMUNITION FEED CONTROLLED BY WEAPON CYCLE

(76) Inventor: Charles Edward Rostocil, Hillsboro, OR (US)

( * ) Notice: Subject to any disclaimer, the term of this patent is extended or adjusted under 35 U.S.C. 154(b) by 727 days.

(21) Appl. No.: 12/361,959

(22) Filed: Jan. 29, 2009

(65) Prior Publication Data

US 2012/0144712 A1 Jun. 14, 2012

(51) Int. Cl.

| | |
|---|---|
| ***F41A 9/27*** | (2006.01) |
| ***F41A 9/79*** | (2006.01) |
| ***F42B 14/06*** | (2006.01) |
| ***F42B 12/36*** | (2006.01) |
| ***F42B 12/64*** | (2006.01) |
| ***F41A 11/02*** | (2006.01) |
| ***F42B 7/02*** | (2006.01) |
| ***F41C 23/04*** | (2006.01) |

(52) U.S. Cl.

CPC ..... *F41A 9/79* (2013.01); *F42B 14/065* (2013.01); *F42B 12/362* (2013.01); *F42B 12/64* (2013.01); *F42B 14/064* (2013.01); *F41A 11/02* (2013.01); *F42B 7/02* (2013.01); *F41C 23/04* (2013.01)

USPC ..... 89/155

(58) Field of Classification Search

USPC ..... 89/155, 33.02, 33.16, 198, 1.4, 130, 89/132, 14.3, 148, 180, 199, 34; 42/25, 73

See application file for complete search history.

(56) References Cited

U.S. PATENT DOCUMENTS

| | | | | |
|---|---|---|---|---|
| 794,852 | A * | 7/1905 | Clearke | 89/152 |
| 3,369,316 | A * | 2/1968 | Miller | 42/72 |
| 4,066,000 | A * | 1/1978 | Rostocil | 89/198 |
| 4,484,403 | A * | 11/1984 | Schwaller | 42/50 |
| 4,677,897 | A * | 7/1987 | Barrett | 89/166 |
| 4,703,826 | A * | 11/1987 | Byron | 89/188 |
| 4,838,143 | A * | 6/1989 | Byron | 89/14.3 |
| 4,926,739 | A * | 5/1990 | Byron | 89/1.4 |
| 4,947,730 | A * | 8/1990 | Byron | 89/146 |
| 5,155,292 | A * | 10/1992 | Rostcil et al. | 89/167 |
| 5,209,215 | A * | 5/1993 | Morrison | 124/25 |
| 5,806,228 | A * | 9/1998 | Martel et al. | 42/124 |
| 7,673,412 | B2 * | 3/2010 | Griffin | 42/73 |
| 7,806,039 | B1 * | 10/2010 | Gomez | 89/132 |
| 7,827,721 | B2 * | 11/2010 | Griffin | 42/73 |
| 2005/0229463 | A1 * | 10/2005 | Tashjian | 42/75.02 |
| 2006/0242880 | A1 * | 11/2006 | Griffin | 42/73 |
| 2010/0212206 | A1 * | 8/2010 | Griffin | 42/73 |
| 2010/0236394 | A1 * | 9/2010 | Gomez | 89/138 |

* cited by examiner

*Primary Examiner* — Jonathan C Weber

(57) ABSTRACT

A weapon system for urban combat incorporating an automatic gun having a short recoil, a feed system with gun driven box magazines of different capacities, a detachable link-belt feed, spring buffered barrel and bolt recoil absorbing arrangement, and simplified fire control.

11 Claims, 43 Drawing Sheets

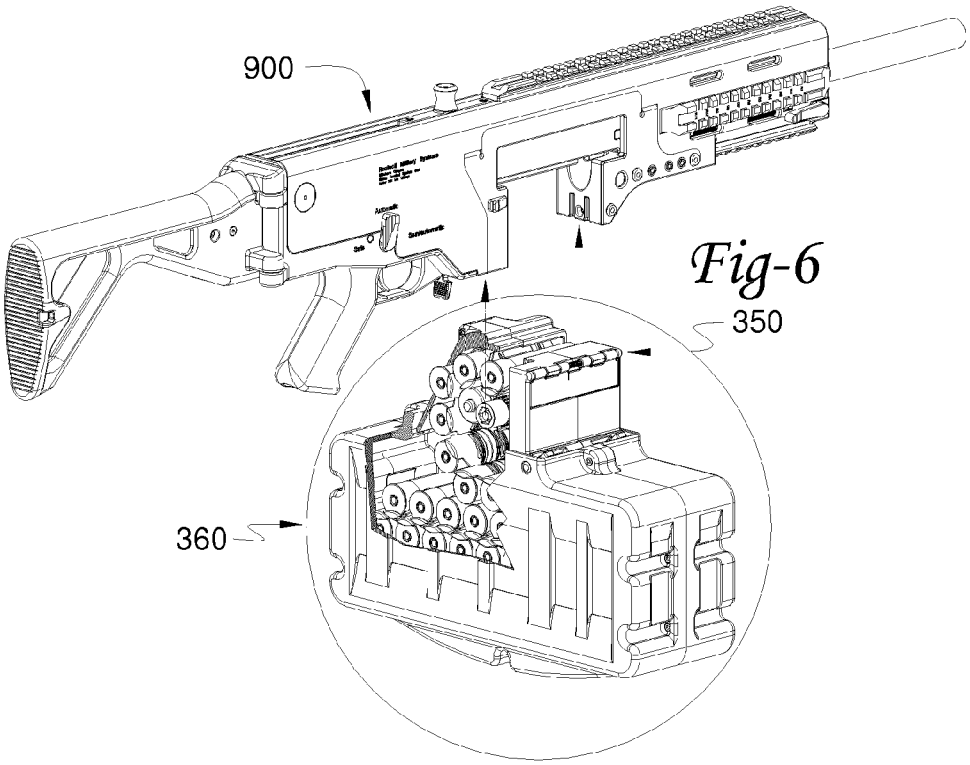
Fig-6
Fig-7
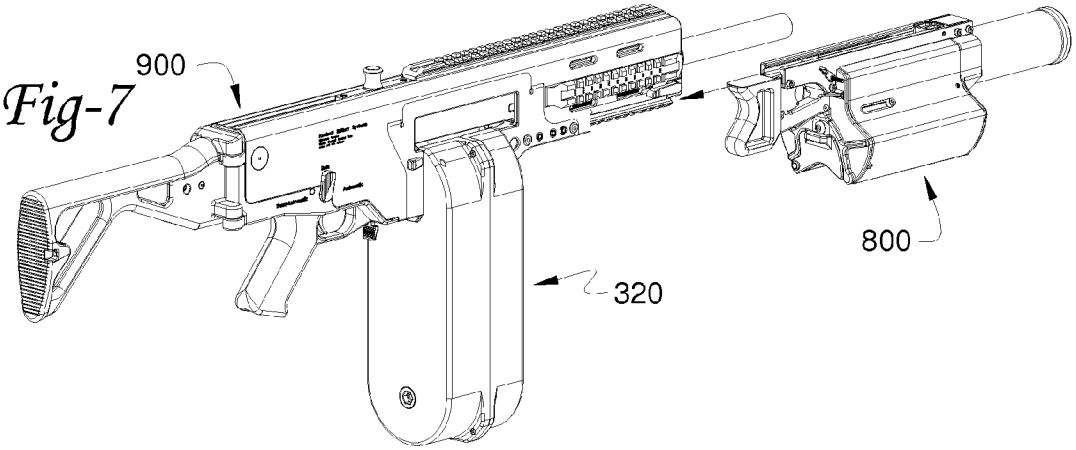

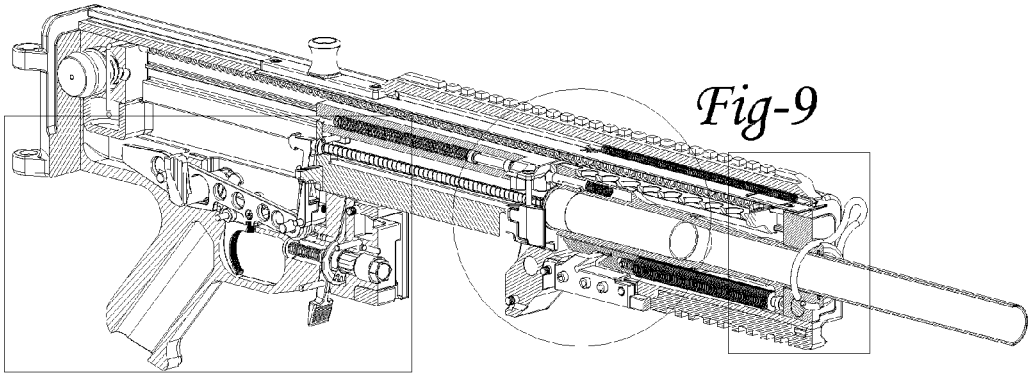
Fig-9
Fig-9B Fig-9A Fig-9C
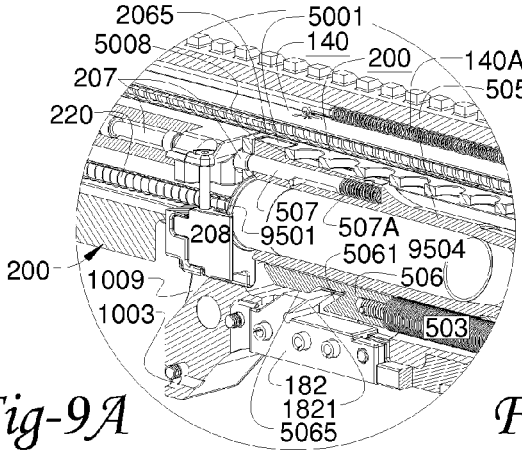
Fig-9A
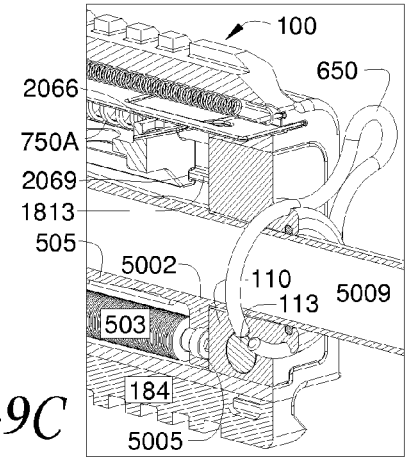
Fig-9C
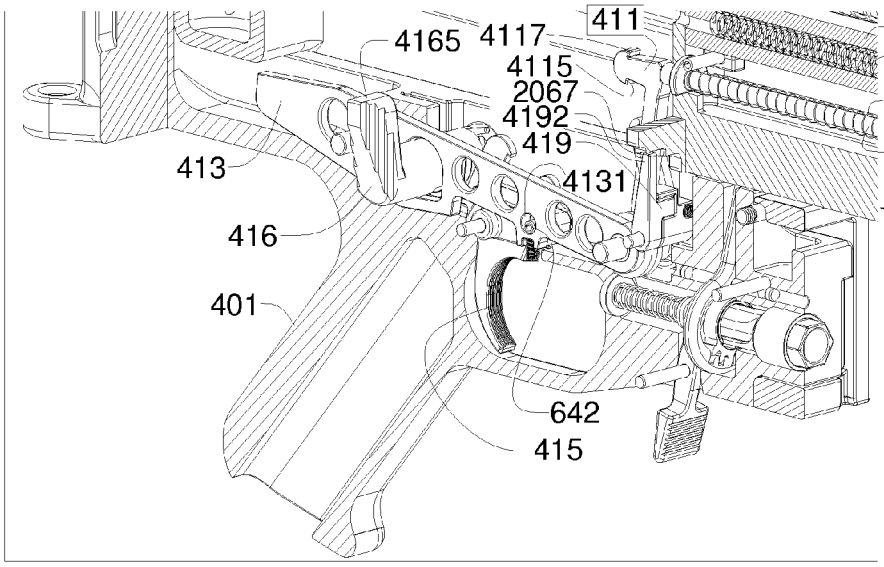
Fig-9B

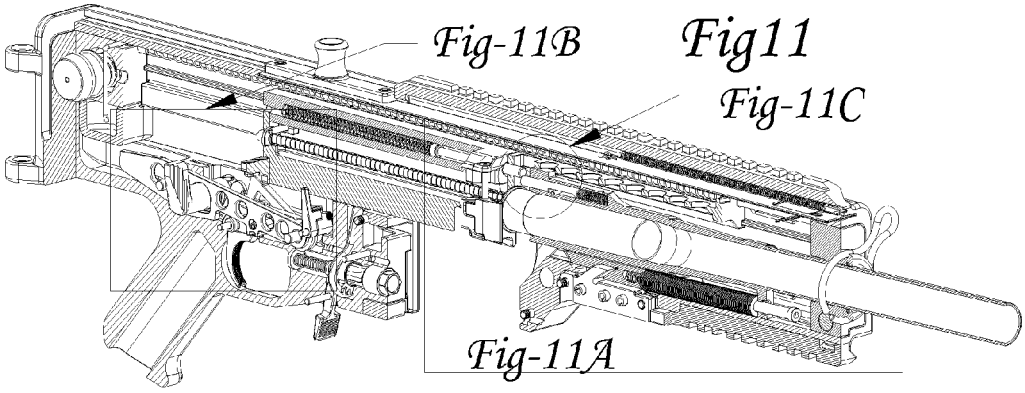
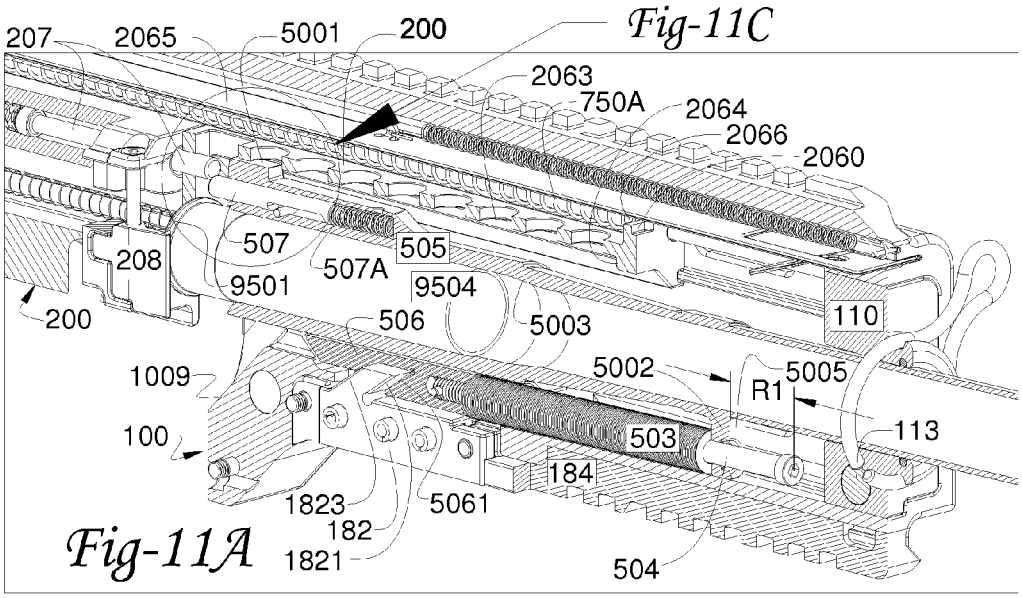
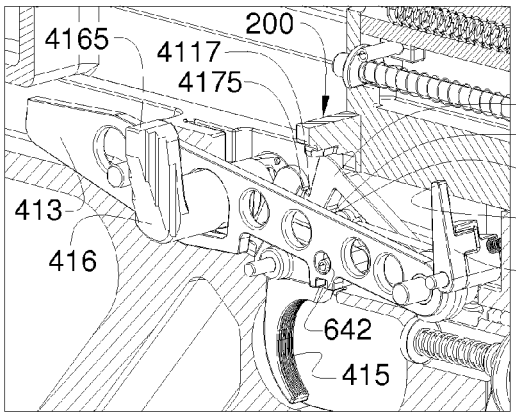
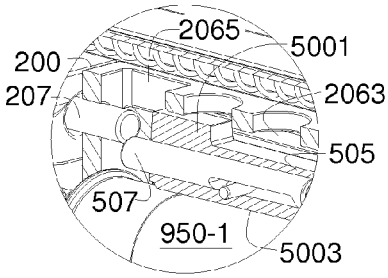
Fig-11C
Fig-11B

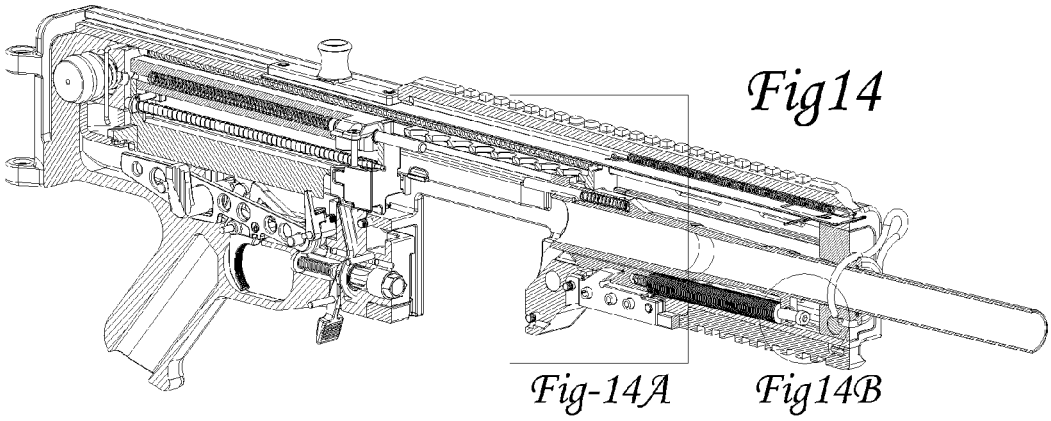
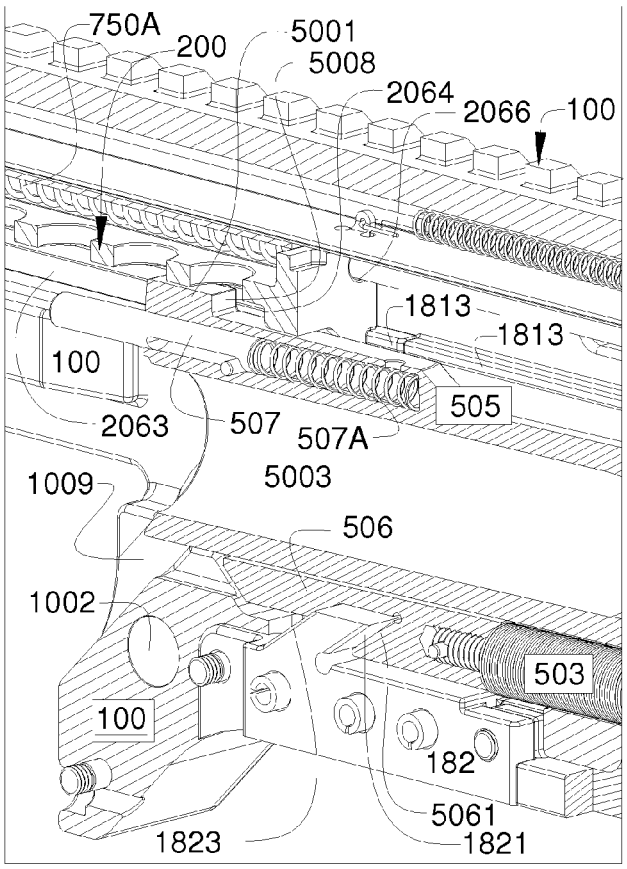
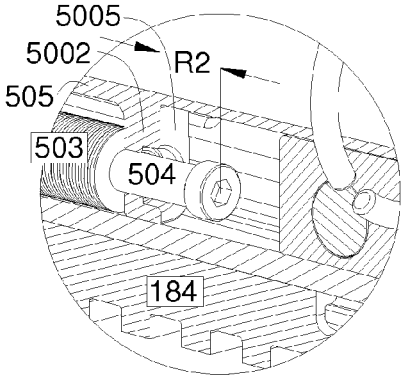
Fig-14B
Fig-14A

Fig-16
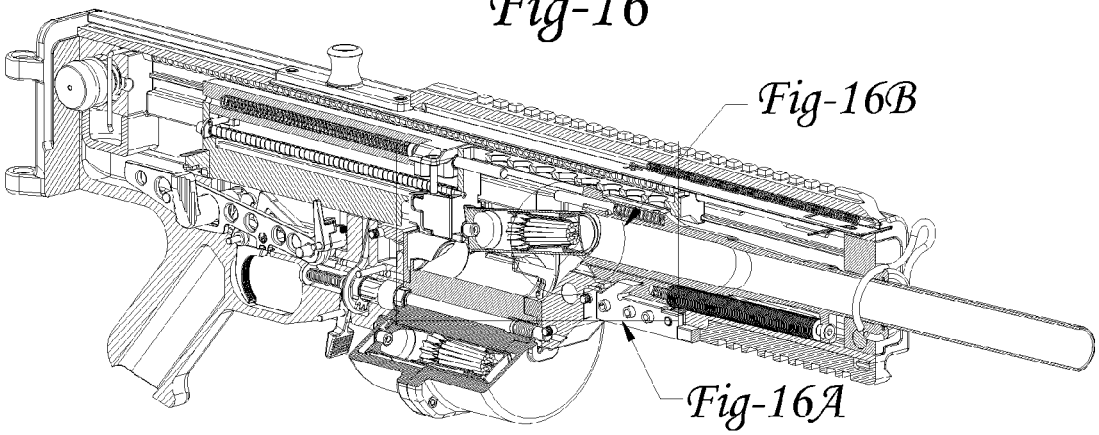
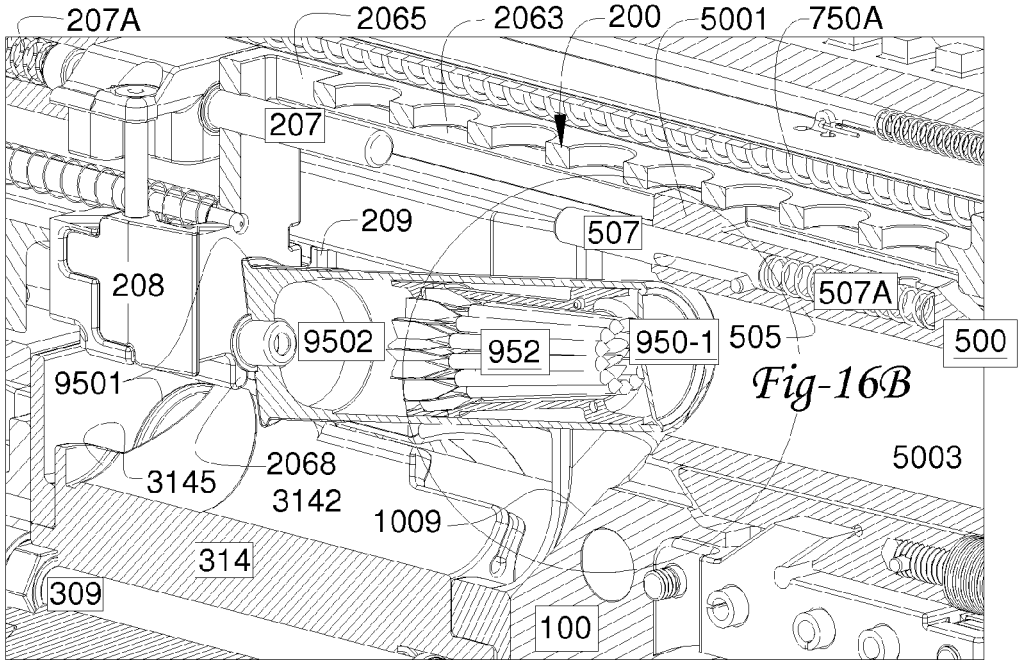
Fig-16A
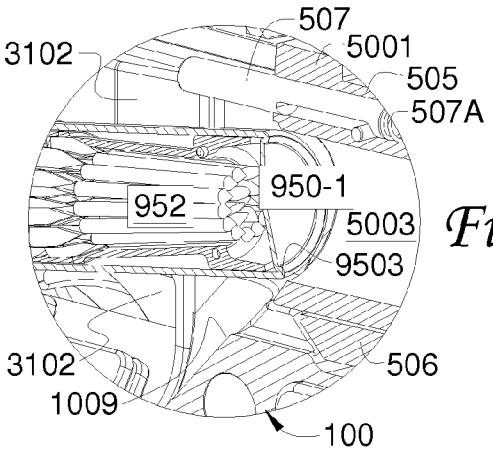
Fig-16B

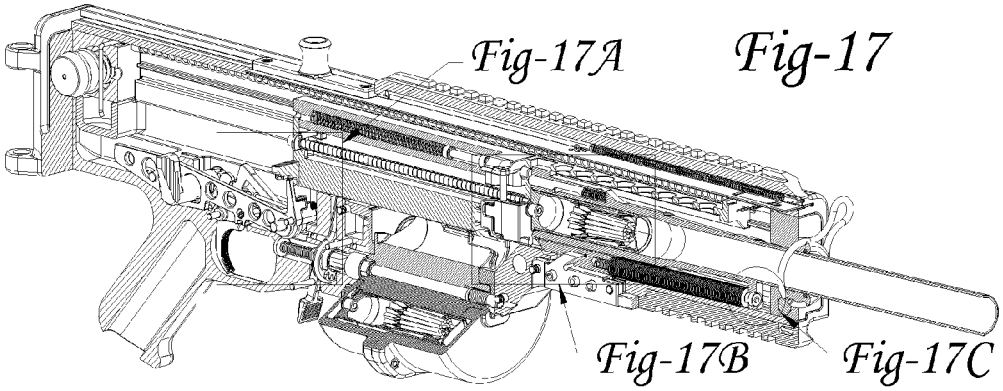
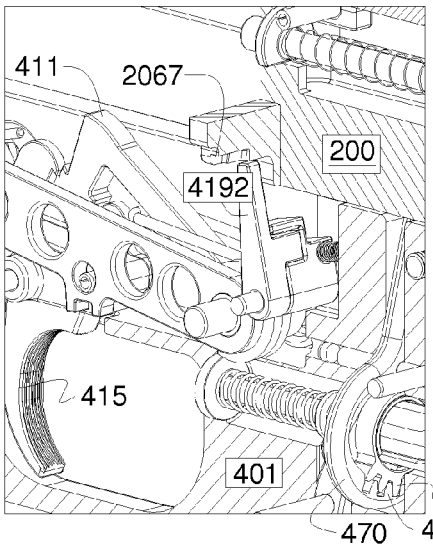
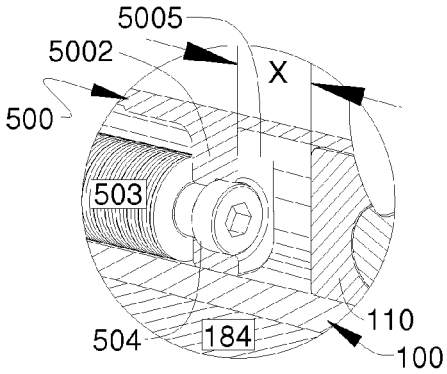
Fig-17A Fig-17C
Fig-17B
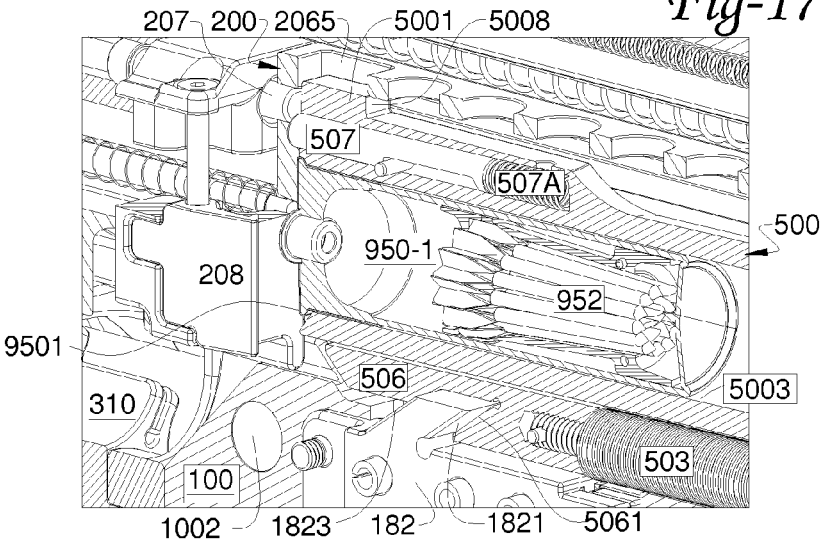

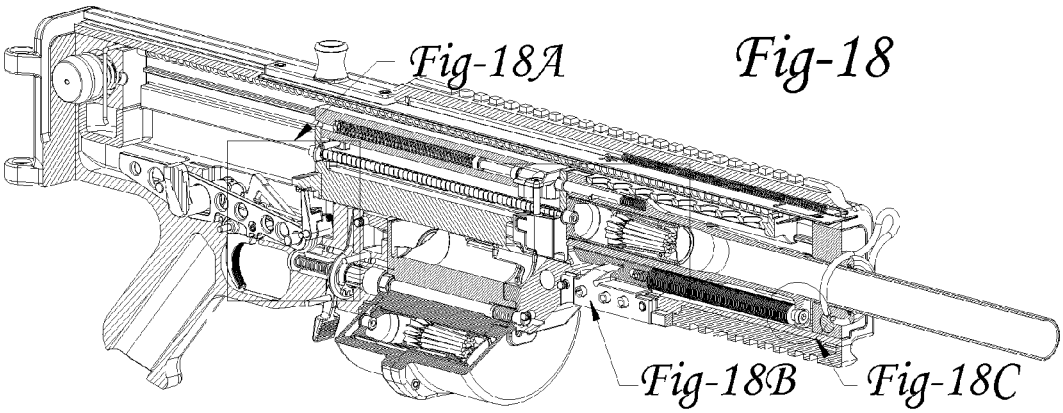
Fig-18
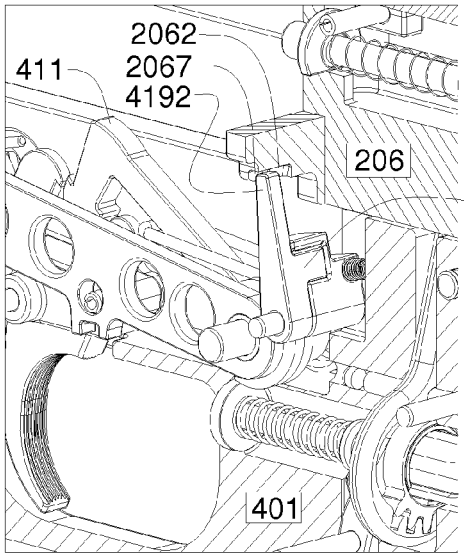
Fig-18A
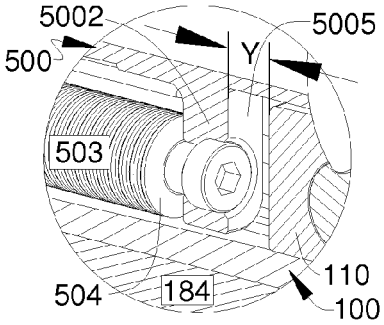
Fig-18C
Fig-18B
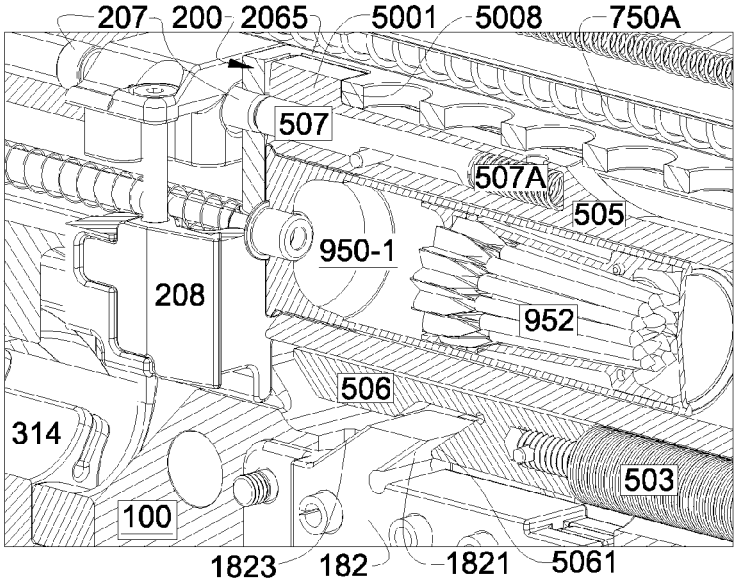

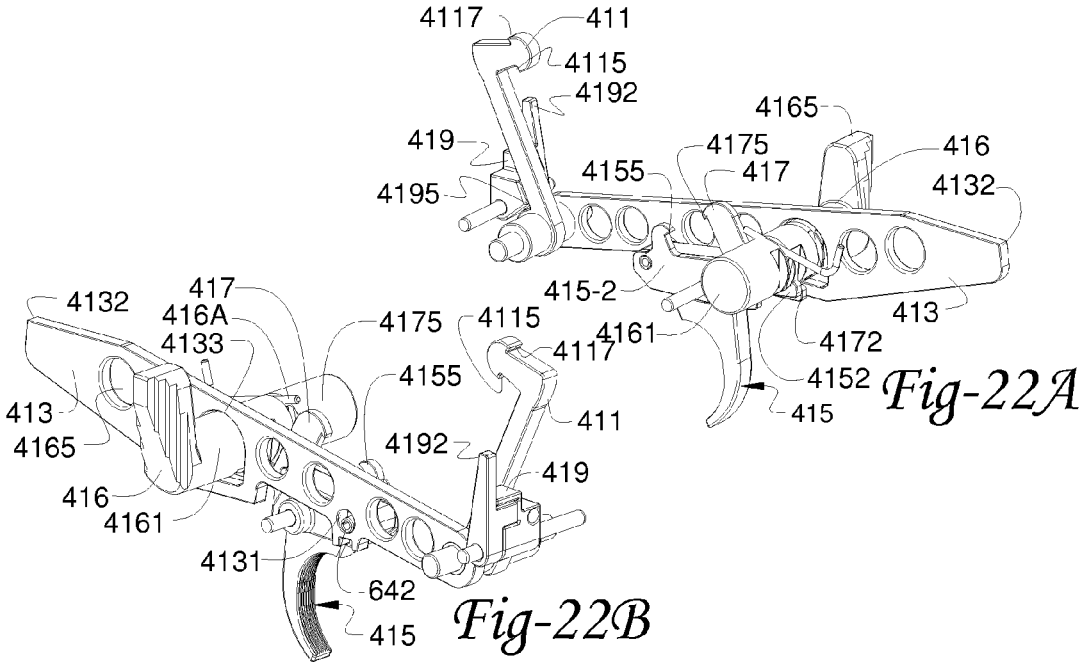
Fig-22A
Fig-22B
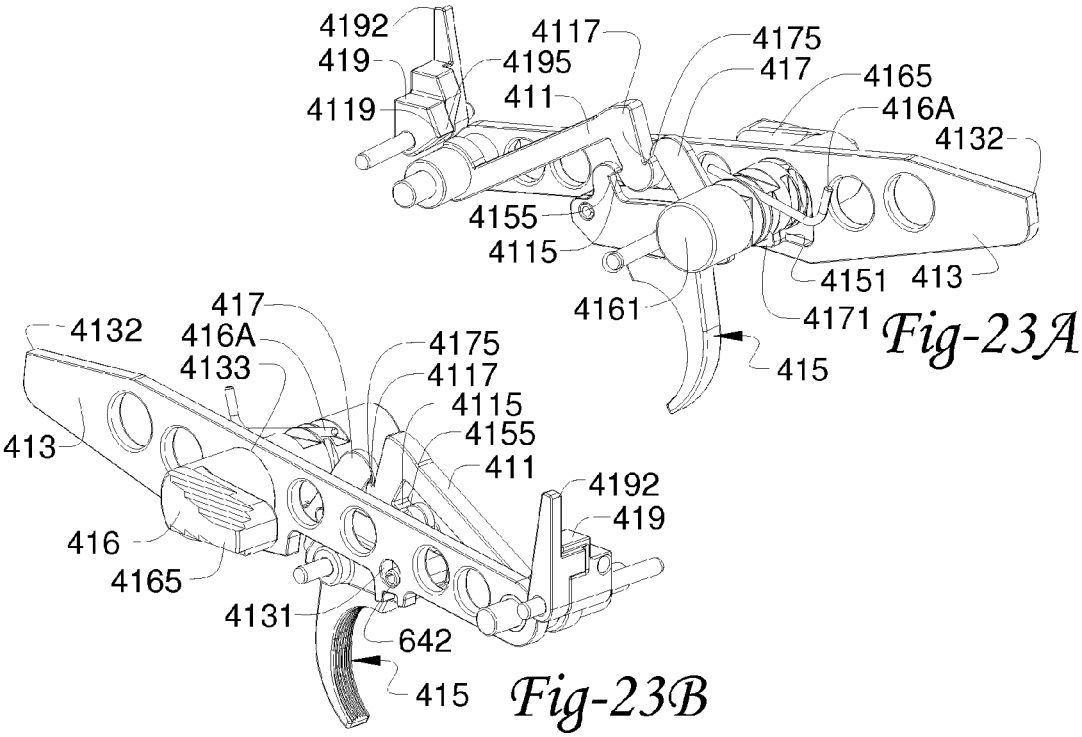
Fig-23A
Fig-23B

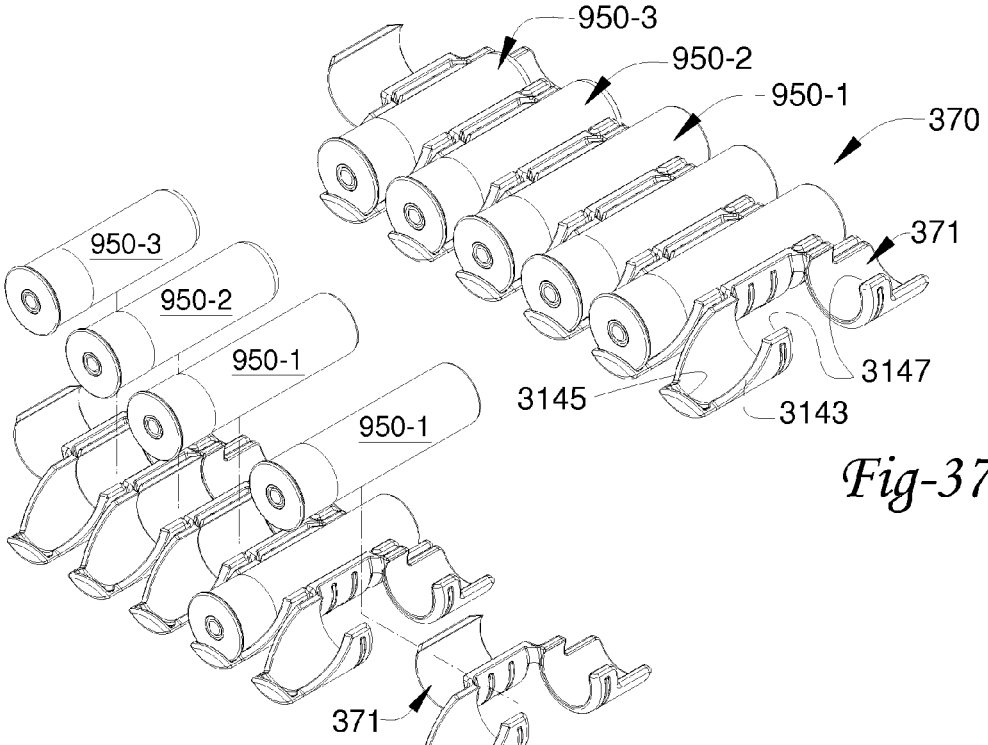
Fig-37B
Fig-37A
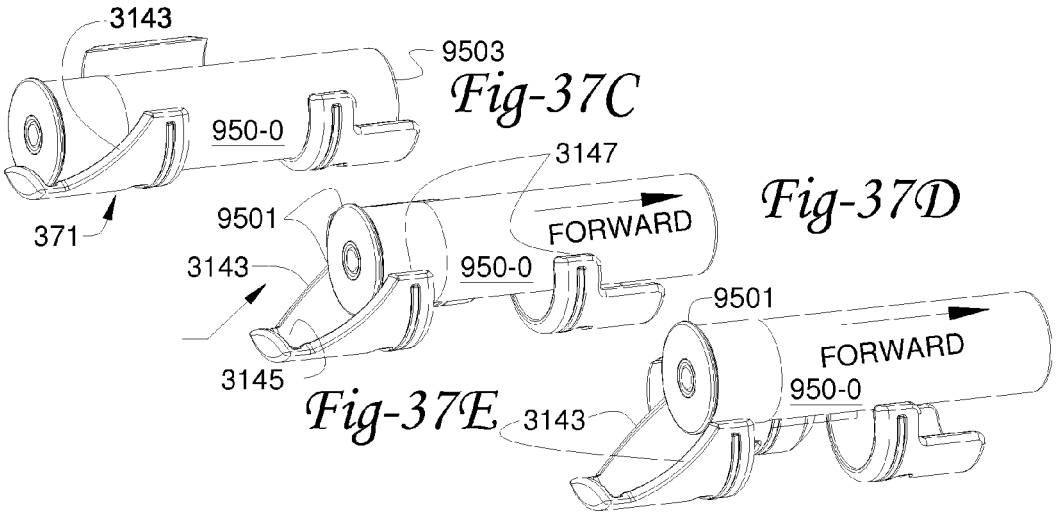
Fig-37C
Fig-37D
Fig-37E

400

401
470
648
4703
4701
486A
482
486
4801
480
482A
487
425
425A
654
401
425
427
4001
4003
400

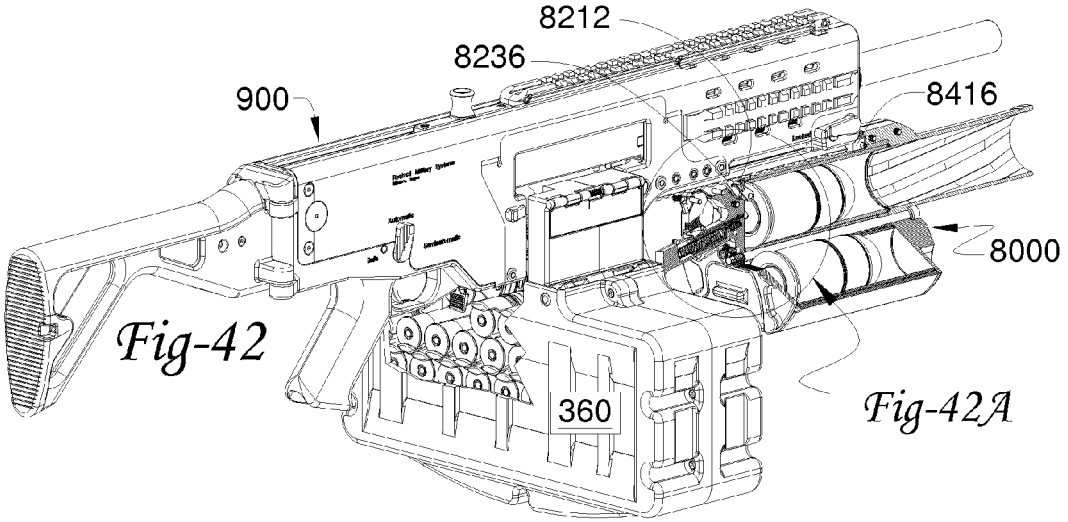
Fig-42
Fig-42A
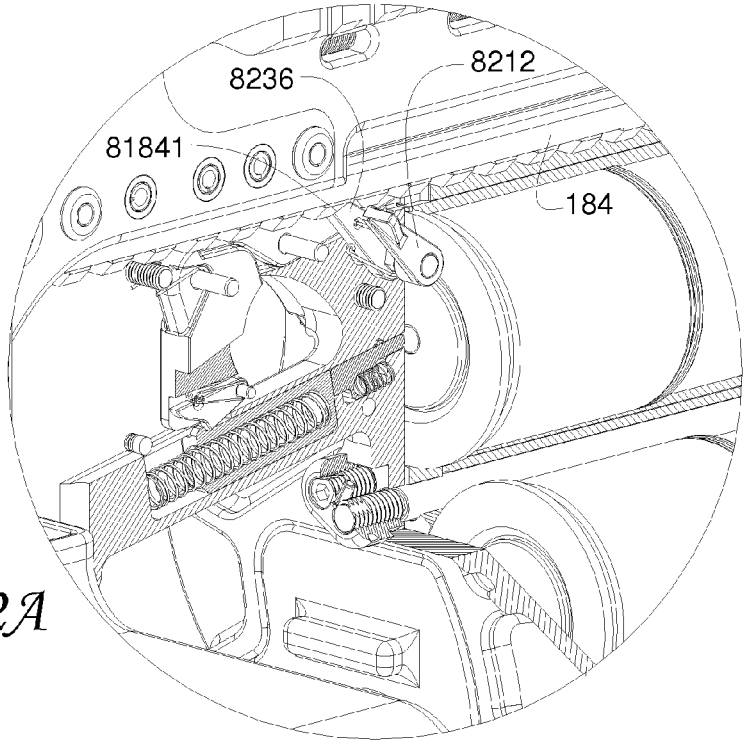
Fig-42A

Fig-43
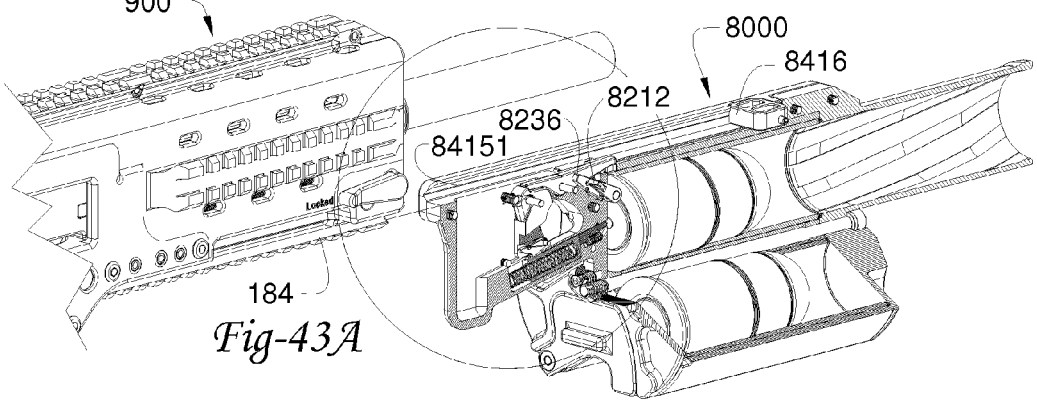
Fig-43A
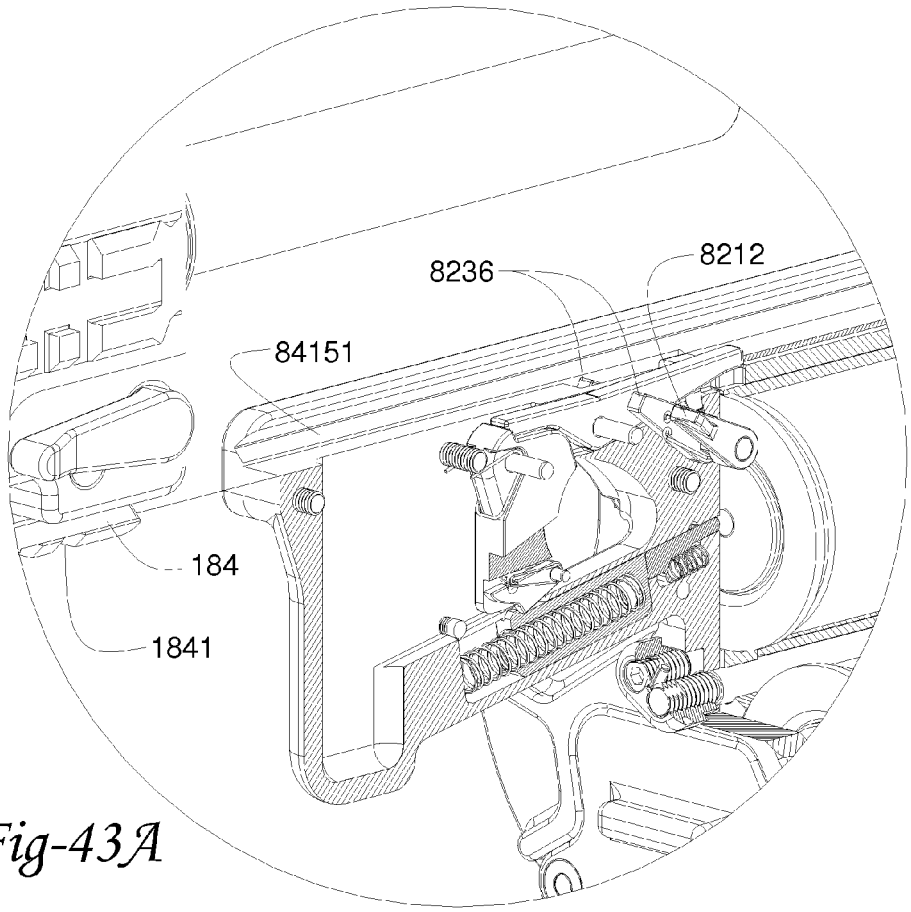
Fig-43A

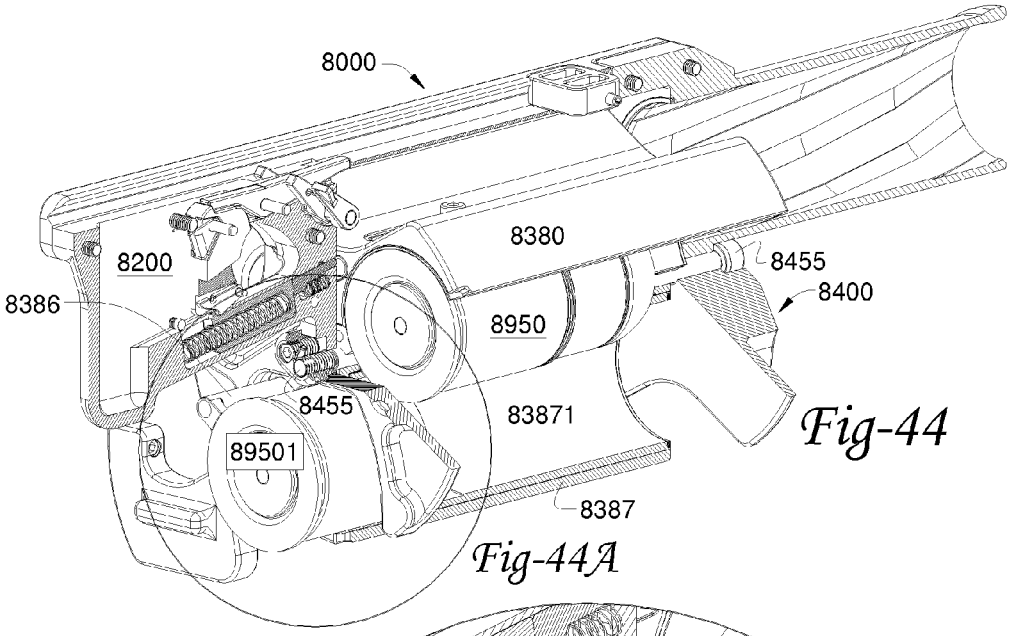
Fig-44
Fig-44A
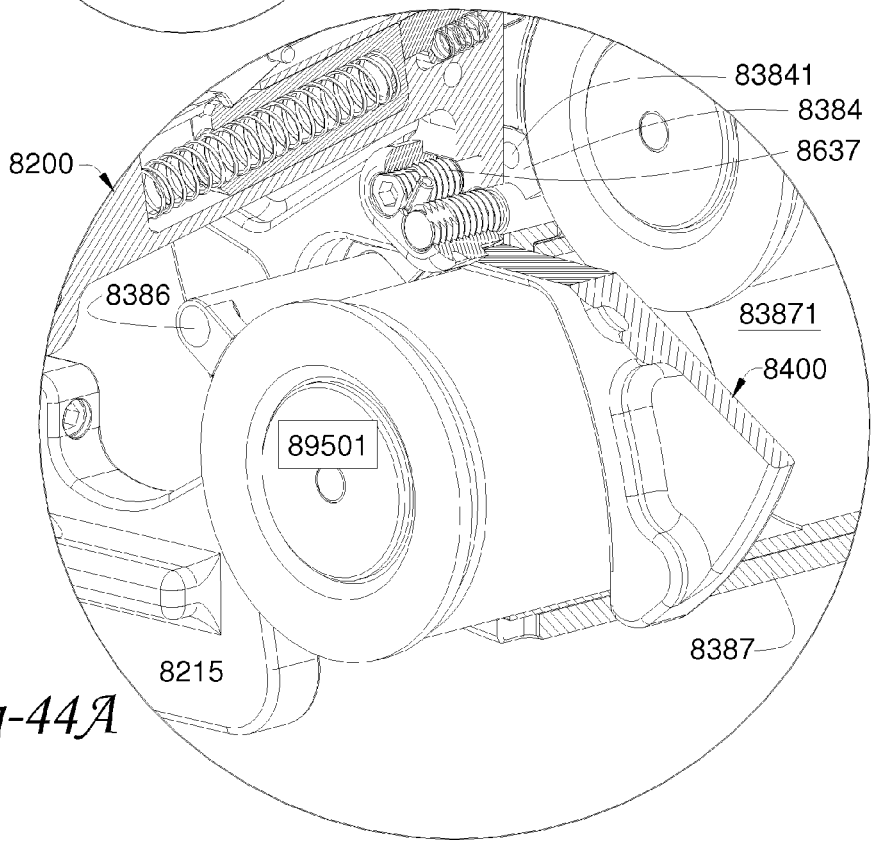
Fig-44A

Fig51
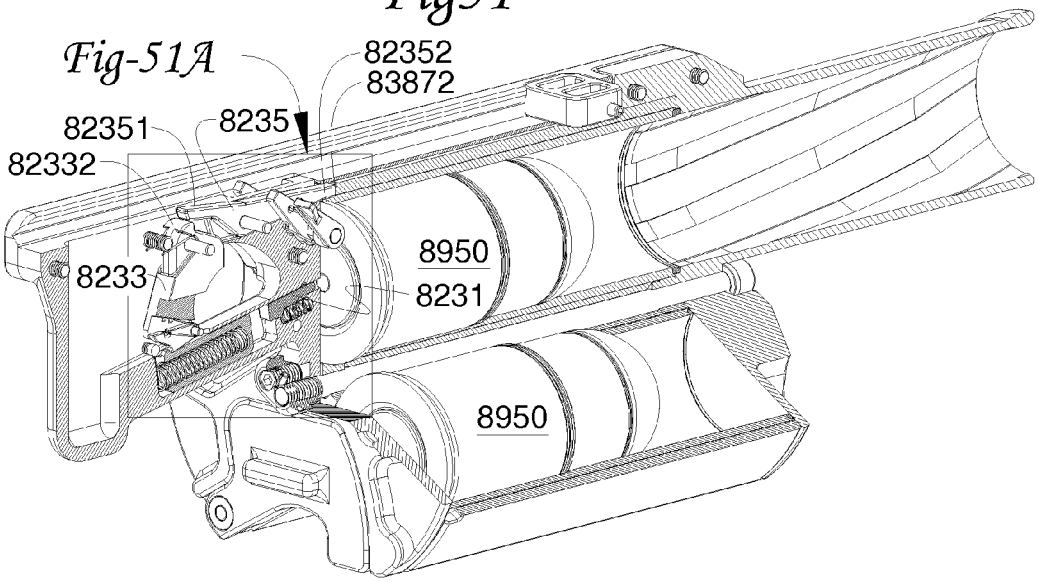
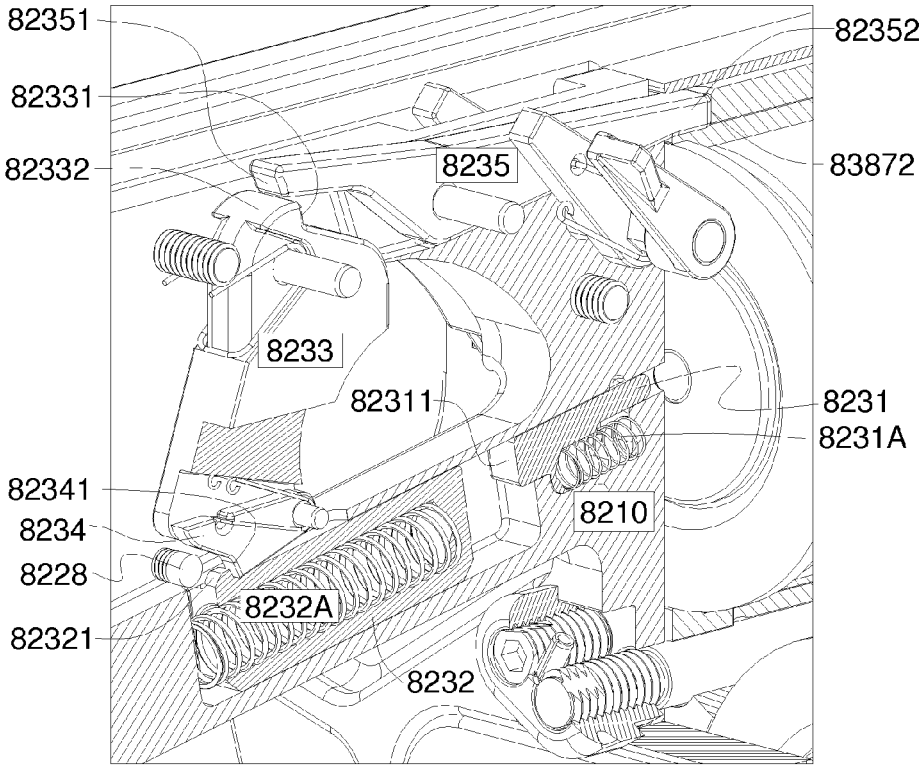
Fig-51A

URBAN COMBAT SYSTEM AUTOMATIC FIREARM HAVING AMMUNITION FEED CONTROLLED BY WEAPON CYCLE

CROSS-REFERENCE TO RELATED APPLICATIONS

This application claims the benefit of PPA Ser. No. 61/062,506 filed Jan. 28, 2008 by the present inventor, which is incorporated by reference.

FEDERALLY SPONSORED RESEARCH

Not Applicable

SEQUENCE LISTING OR PROGRAM

Not Applicable

BACKGROUND OF THE EMBODIMENT

Prior Art

Present embodiment generally relates to firearms used in the urban combat environment and more particularly relates to but is not limited to the weapons used by individuals or on vehicles to fight close-in engagements as found in the urban or jungle environment, and more particular covers a automatic gun with a improved flechette shotshell and a multiple shot grenade launcher used on a urban combat system embodied in PPA Ser. No. 61/062,506.

The gun is the infantryman's basic weapon. Regardless of the complexity of the battlefield and the advent of the electronic battlefield, it is still the grunt that has to go forward and occupy ground. This begs the question of what attributes should therefore characterize the infantryman's basic weapon.

The subject of the ideal combat gun has been debated for as long as infantrymen have been armed with guns, and this discussion will continue for the foreseeable future. However there are several characteristics that are highly desirable in any infantry gun and they are listed below in no particular order of importance.

- Weight: the gun must be as light as possible. Infantry must carry most of their kit on their back and every ounce of gun weight makes a big difference.
- Reliability: the gun must be reliable. If the soldiers' gun quits working in combat the soldier using it will probably be killed. A gun should not be sensitive to the type of ammunition it is fed as long as it is correct for that gun. A gun that is unreliable for any reason degrades soldiers' confidence in their gun and their willingness to use it.
- Robust: related to reliability the gun must be robust. Robustness is the ability of the gun to be subjected to the elements such as sand and mud, and keep working without requiring any extraordinary measures to ensure its function.
- Effective: a gun and its ammunition should be suitably to engage targets effectively out to the combat ranges the soldier finds in their theater of combat.
- Maintainable: a gun must be maintainable and not an onerous time consuming chore to clean, nor should the gun require overly frequent cleaning.
- Serviceability: a gun must be simple, intuitive to use and operate and user-friendly. Serviceability encompasses a host of factors, including ergonomics, accessories, disassembly and assembly, ease of loading, and a myriad of small details that together make up the serviceability of the gun.

To understand the need for a new gun system, first one must understand the new face technology has forced onto modern combat. No other piece of major military equipment is as antiquated as the guns that equip today's soldiers. No one would think of going into combat with vehicles that were designed 50-years-ago, fly in 50-year-old airplane designs, or communicate using radios designed 50-years-ago. But this is in fact the case for the guns used by the infantry of today. Some of the gun designs that are in use today are over 50 years old and a few of them are actually over 90 years old. In the true sense we are forcing the solider today to fight and protect a soldiers life in the high tech electronic battlefield environment of today with guns a soldiers great grandfathers used.

- Is modern combat the same today as it was 50 years ago?—NO!
- Can today's tactical needs be met using today's technology?—YES!

An engineering solution to the combat needs of today's infantry is needed now more than ever before. But to understand the technical embodiments needed in a new gun system one must first understand three fundamental things:

- Today & Yesterday: what has changed on today's battlefield?
- Today's Technical Design Goals: just what makes a good gun suitable for and optimized for the unique needs of today's electronic battlefield?
- Today's Manufacturing Technology: can modern computerized fabrication and polymers be used to enhance a good gun design?
- Today & Yesterday.

For the individual solider some things have not changed since Roman times. In Rome as today, NOTHING can replace well-trained and dedicated soldiers led by capable officers. Rome was the high tech country of its day and provided its soldiers with the best equipment available. History has shown that many Roman victories were as much attributed to the equipment their soldiers used as their soldiers who used it. Rome beat the Greek war machine using new tactics that relied on new weapons designed specifically for those new tactics. Modern technology has forced new tactics onto the battlefield, and new individual weapons are needed to not only survive within this environment but to also exploit the benefits to be found in this new environment.

Today small unit tactics are being used on a large scale by all of the world militaries. This is because the individual soldier wants to survive. No longer is it safe or even smart to mass troops or vehicles on a battlefield. Simply put, in modern warfare large area targets get killed.

Today target rich concentrations such as massed troops and vehicles get hit with smart bombs, guided missiles, guided cluster munitions, and homing artillery. All of these weapons are new since WWII and they all are made possible because of today's electronic technology.

Another change in modern combat is the accuracy of delivery for today's guided munitions. Not only can these new munitions hit point targets most of the time, the more accurate munitions allow use on targets much closer to friendly troops. Today helicopter gunships and close air support can be called in and provide direct fire support as close as 100 meters from friendly troops.

There is no longer a need to reach out with individual weapons. Going into the 21$^{st}$ century it is commonly accepted by modern armies that most combat will be fought at under 250 meters. This is because when the target is beyond 250 meters it is more effective and safer to call in precision munitions to kill the target.

However the opposing forces also know this, thus the universal reason for troop dispersal and close-in tactics. Today the battlefield bible reads, disperse and get in close; disperse enough so as not to present a suitable mass target and close in to prevent the use of electronically guided weapons.

Another trend that has resulted from the use of the new high technology weapons is the increased use of urban areas as the combat environment of choice. Not only are there more urban areas available to fight in, it is also much safer and more advantageous for the defending troops to find defensive positions in an urban environment than an open field environment. This is because an urban build-up provides good individual cover and requires that the attacking troops get in close to attack the defending troops.

As shown in the later part of the 20$^{th}$ century in global hot spots, the defending troops quickly moved into urban areas to get away from the new family of guided munitions; only to then be forced to use individual weapons that were not designed for the urban environment.

Once combat is urban grounded the technical requirements of the weapons change. There is no longer a need for a Light machine gun (LMG) with a 1000-meter range when firing across the street or an assault rifle with a 500-meter range when firing from one room up a stairwell. Urban combat requires weapons designed to fight in that environment—not the open desert and open fields.

Design goals for an optimized gun for urban combat: To summarize the historical review presented:

Troops of today are dispersed.

Troops strive to get in close and avoid long-range engagements to prevent the use of new electronic weapons systems.

Troops are increasingly using urban areas to fight in.

Armies of the 21$^{st}$ century do not need guns designed to fight WWI style mass infantry attacks, or WWII massed armor attacks. The new family of electronically guided munitions would eliminate these target rich opportunities with precision and expediency. That is after all what they are designed to do.

In today's battlefield there is no longer a need for the individual weapons firing 7.62 NATO caliber ammunition; weapons that range from machine guns to semiautomatic rifles. A 7.62 mm NATO cartridge is a class of cartridge based on the French Label 8 mm cartridge from the 1880's. The Label 8 mm cartridge was expressly designed to stop cavalry charges by killing horses at 1,000 meters, a need that individual guns today no longer have.

So what about the newer intermediate range cartridge class of automatic guns? The intermediate range cartridge class came about over 60 years ago when the generals of WWII realized that there were fewer cavalry charges to stop and combat experience had shown them that few of their troops could hit a person at 1000 meters even if they tried. Early on as a stopgap measure the submachine gun was used and proved very effective in combat ranges less than 100 meters, but was found to be almost worthless beyond that range.

So the intermediate range cartridge class of automatic assault weapon was born. First was the German 7.92 mm MP44 WWII, which was then followed in a few years by the Russian 7.62×39 cartridge which fed the legendary Russian AK47 by the late 40's. The United States military hung onto the full power NATO 7.62 mm cartridge until the early 60's. But Vietnam showed them the real need to carry more ammunition to feed the new demand for automatic assault weapons. Thus the 5.56 mm cartridge class of weapons was born.

The so-called NEW intermediate cartridge class of weapons that are now being sold are in fact based on designs that are over 60 years old. For the most part they are nothing but the weapon designs of late WWII scaled down in size. These weapons are designed to be point-target weapons for combat ranges of 500 meters rather than 1000 meters.

Troops are Increasingly Using Urban Areas to Fight

The major use of today's individual weapon is close-in combat. Most likely this will be urban combat—and against single or small groups of fleeting targets. The intermediate range cartridge class of weapons were not designed to fight in this environment. Yes they can be used in this environment—but this environment was not the design requirements for the ammunition or the automatic assault weapons they are used in.

An ability to reach out to hit point-targets at 500 meters and beyond with aimed fire is just not a need for today's average solider. Yes, it is still a specialized need. But this specialized need can be best served with squad level specialized weapons such as the newer class of .50 caliber sniper rifles.

The technical phrases used above to remember are point target weapon and aimed fire. Within these two simple technical phrases lies the biggest single misunderstanding and misdirection propagated by today's military leaders.

To best meet today's combat needs the individual weapon should not be a point-target weapon. In other words it should NOT be designed for aimed fired at a specific target. Those target types are no longer the major threat. Yes they still exist, but recent history has clearly shown that these types of targets don't survive for long on today's electronic battlefield.

What is not well understood is that in today's combat the solider seldom sees the enemy they are fighting. Seldom do they aim at any specific target—let alone take the time to sight in on a stationary target at 500 meters. This just does not happen.

However today's assault rifles using the intermediate range cartridge are designed to do just that. To hit a solider running between buildings and ducking between rooms was not the engineering design goal for today's assault rifles—it never was. They were designed as and still are specifically point-target weapons.

But still the military leaders persist on using them—mainly because there is no other creditable solution at hand. There will NOT be a creditable solution to use in the urban environment until a NEW gun system is designed specifically for this environment.

To appreciate the capabilities needed in a new gun system one should keep in mind two elusive technical characteristics. These are:

Maximum first-round hit probability: to hit what you shoot at.

High single-round fired lethality: to put down what you hit.

None of the past private or government R&D programs attempting to fulfill these characteristics have achieved any real measure of success for a variety of technical reasons. However the main problem has been from misdirection of the overall effort rather than the actual technical problems. The biggest single problem was the mindset fixation of the military leaders on point target weapons.

There are only two realistic ways to obtain a higher single round lethality over the current class of assault rifle weapons.

First Way is to Employ Hypervelocity Projectiles.

Hypervelocity projectiles produce deep cavity wounds and their kinetic impact is characterized by massive displacement and destruction of flesh with severe hydrostatic shock. Any of these wounding elements are invariable fatal. But the hypervelocity also degrades the single projectile accuracy to the point where first-found hits are an elusive dream.

Tests have shown that first-round hits with hypervelocity projectiles under most combat conditions are practically impossible. Regrettably this simple deficiency nullifies any lethal potential that hypervelocity projectiles might have because if you don't hit it, you don't hurt it.

Second Way is to Employ Burst Fire.

To improve first-round hit probability most armies since the mid 80's have adopted the burst-fire principle. This means a pre-selected number of rounds are fired in a burst each time the trigger is pulled. Almost universally the three-round burst has been chosen as being the most satisfactory for controlled burst-fire.

The basic principle of controlled burst-fire is to serially fire at high cyclic rates three or more projectiles aimed at a specific target. Mathematical probability that one projectile will hit the target is high. Normal weapon-ammunition inaccuracies are relied upon to distribute the projectiles in a desirable dispersion pattern. Controlled burst-fire changes the undesirable inaccuracy of automatic fire into an advantage by improving the hit probability of the gun in automatic fire. Controlled burst-fire is making do with what is available, but regrettably controlled burst-fire does not address the real problem.

To be truly effective a controlled burst-fire automatic weapon should have a high cyclic rate to limit the dispersion of the burst. Only a high cyclic rate can create the coveted circular burst pattern around the point of aim. This is because at a very high cyclic rate the elapsed time of the three-round burst is sufficiently short to assure that the last projectile will leave the barrel before the weapon has moved to far in recoil from the original point of aim.

This has been obtained in what are called by those versed in the art dual rate guns. Dual rate guns are high cyclic rate automatic guns firing short burst that are repeated automatically by the gun at a lower cyclic rate—thus a dual rate gun. This was first done successfully in the 1970's by Heckler & Koch in their caseless G11 assault rifle that fired a 3 round burst. Later in 1994 the Russians AN94 assault rifle that fired a 2 round burst used the same principle and was put into limited Russian service by the mid 90's.

However most assault rifles cannot obtain a high enough cyclic rate to be truly effective. This is because a cyclic rate under approximately 1400 SPM still permits the recoil movement of the gun to pull the bore axis off the original point of aim.

At the other end of the spectrum, tests have shown that firing rates over 500-600 SPM diminish the user ability to correct gun recoil movement and put the bore axis back onto the original point of aim between individual shots. Thus cyclic rates between 600-800 SPM fall right in the middle of the zone of uncontrollable fire—and this is the average cyclic rate of fire for most current assault rifles.

Another crucial point that is overlooked by the average person is that 3 round controlled burst fire may improve the mathematical first-round hit probability, but this is done at the cost of magazine capacity. Simply put, a 30 round magazine quickly becomes a 10 round magazine.

Multi-Projectile Weapon.

However there is another way to obtain both higher single round lethality while at the same time improving first round hit probability—without sacrificing magazine capacity.

Guns employing ammunition that discharges a swarm of projectiles for each round fired inherently have higher hit probability than any burst-fire gun. Also since they put more projectiles onto the target at the same time their single round fired hit lethality is greatly enhanced. Finally they also have a more favorable magazine burst capacity by providing more projectile swarms per magazine loading. This is because each single round fired from this class of guns replaces three or more rounds fired from a controlled burst-fire gun.

Thus the need to obtain a higher first-round hit probability, a higher single fired round lethality and a higher volume of fire per magazine loading can be best met with multiple-projectile gun—NOT a point-fire gun.

Multiple-projectile guns are not new. In the commercial arena they are called shotguns. Commercial sporting shotguns have a well-proven combat history and with a coat of military paint are in use today as specialized weapons. But the commercial shotguns were not designed for military use, although they can be customized to improve their military acceptability.

Ammunition the customized military shotguns fire is usually just commercial sporting ammunition with a coat of military paint. Usually the military customization of shotshell ammunition results in just an all brass shotshell case.

Specialized shotshell ammunition ranging from CS gas to explosive shells has been experimented with from time to time, but with no real acceptance by the military. In practice commercial sporting shotshell ammunition is still used as a standard for deployment by the military.

For all the advantages the shotgun can provide the military there has also been a serious set of technical limitations to prevented its acceptance as a mainstream military gun.

Technical limitations for the commercial shotgun for military use are:

1. Shotgun stocking and the use of tube magazines have prevented practical and effective automatic fire.
   a. The slow loading of tube magazines of limited capacity makes automatic fire impractical.
   b. The shoulder stock found on most commercial shotgun force the shotgun to rapidly rise vertically off the target when fired. Uncontrollable vertical rise of the shotgun makes long burst impossible and even short burst impractical.

2. Very high recoil loads, or what the laymen call kick. High cartridge impulse has prevented adequate gun controllability when automatic fire was attempted—unless the cyclic rate was reduced to less than 300 SPM. Automatic shotguns using cyclic rates higher than 300 SPM usually have proven to be uncontrollable and thus not practical.

3. Automatic shotguns using 10 round box magazines or even a 20 round drum magazines are limited by their overall loaded weight and bulk. Even a short engagement of just a few short burst depletes a 10 round box magazine. A drum magazine of 20 rounds or more may provide a longer burst, but its bulk and overall weight has limited fast gun handling in close quarters.

4. To obtain a measure of gun controllability the cyclic rate of automatic shotguns have been reduced to 300 SPM or lower. This has usually been obtained by the use of a long bolt stroke to reduce the recoil loading. However the long bolt stroke usually requires a long receiver, which results in a longer overall length for the same length barrel.

The most commonly used military shotshell loading has been the 00 Buck in a 12 gauge 2¾ inch shotshell. However this shotshell results in a loading of only 9 lead pellets. This reduces the single round hit probability at 100 meters and beyond to next to nothing because of the few number of pellets fired. Use of the 12 gauge 3-inch shotshell is increasing in popularity but has been limited. This is because the tube magazines used on most military shotguns limits the number of rounds loaded to the overall length of the magazine tube. Thus the even better 12-gauge 3½ inch shotshell is not currently used in most military shotgun because it would reduce the tube magazine capacity by as much as three cartridges.

Currently there is no box magazine or drum magazine for the 3½ inch 12 gauge shotshell. This is even though a 00 Buck loading in the 12 gauge 3½ shotshell would fire 18 pellets—which is twice the 9 pellets the 2¾ inch shotshell fires. However unless something was done to reduce the recoil loads, to fire twice the number of 00 Buck pellets per round fired would only exacerbate the controllability issue of today's automatic shotguns.

Summary Review of Shotgun Limitations

The major problem with the military shotguns in use today is that they are really just commercial sporting shotguns that have been customized for use by the military.

Of the limitations sited above it is the lack of controllability in automatic fire and the limited capacity of the tube magazine that have held back the shotgun from being accepted as a major squad level weapon.

What is deceptive is that the problem of reducing the firepower of the magazine by the use of burst-fire is not a problem when the shotgun is used. This is because each bang from the shotgun sends forth a swarm of projectiles onto the target. So there is no need to provide a burst of three or more rounds just to increase probability of a single projectile hit on the target. This is the reason the hunters will always use a shotgun to shoot birds in flight rather than a rifle.

A tube magazine is just a tube in which the shotshells are loaded nose to tail and pushed into the receiver by a magazine spring. Because of the large diameter, its rim, and the variable overall length of the shotshell when charged with different loadings; the tube magazine for the shotgun has been retained well after its use on rifles and handguns has been abandoned. Herein lies a basic conflict of commercial function verses military need.

For a military shotgun to have good handling capabilities in close quarters a short overall gun length is desired—and this means a short barrel. Usually the military shotguns have barrel lengths of 20-inches or shorter. However long barrels for commercial sporting shotguns are not a problem—in fact desirable to aid in pointing the gun.

Thus for commercial sporting shotguns the tube magazine dose not present a problem. Besides the sportsman's desire for a long barrel is the fact that magazine capacity for hunting in most states is 3 rounds or less. However when military need is factored in a magazine capacity of more than 3 rounds is a definite requirement.

The tube magazine conflict is as follows. The length of the magazine tube limits the capacity of a tube magazine and the length of the barrel limits the length of the magazine tube. Desirability by the military for a short barrel to improve handling capabilities results in a shotgun that holds fewer rounds. Usually military shotguns with tube magazines can only hold 8 to 10 rounds of 2¾ inch shotshells. Using the longer 3½ inch shotshell would exacerbate the capacity problem to a loading of 7 to 7 rounds.

At Winchester Arms Joe Badali between 1965-1966 had some limited success with a 10 round box magazine fired from a modified Winchester Model 1400 selective fired shotgun (pages 339-352, *The World's Fighting shotguns*, distributed by Ironside International Publishers Inc. P.O. box 55, Alexandria Va. 22313). Then in 1972 Max Atchisson made his Atchisson Assault Shotgun that used either a 10 round box magazine or a 20 round drum magazine (pages 385-395, *The World's Fighting shotguns*). Both of these guns were experimental and neither reached production status.

Currently there is no shoulder-fired automatic gun in any modern military that uses a magazine with a capacity of under 10 rounds. A few older assault rifles such as the original issue of the US M16 or the Stoner 63 system described in U.S. Pat. No. 3,198,076 were issued with a 20 round box magazines. But today the norm for all automatic assault rifles is a box magazine of 30 rounds.

There are many technical reasons that limit use on a shotgun of box magazines having more than 10 rounds. These include but are not limited to the shape of the shotshell itself, its center of gravity and overall weight, and the variable overall length of a loaded round of ammunition. The length of a 12 gauge shotshell can vary from under 2½ inches to as much as 3½ inches. Even the two box magazines sighted above were limited to 10 2¾ inch shotshells with only one or two shotshell loadings recommended for reliable gun function.

If the military shotgun is to provide the same substantial firepower as the modern assault rifle or SAW then another way to feed the shotgun will be needed. The only practicable feed mode remaining other than the box or drum magazine to provide a reliable 30 round or greater capacity is the link-belt feed systems.

A link-belt feed has the advantage of not having its capacity limited by the size of the container it uses. Also the link-belt feed can change its ammo capacity easily by adding belts onto belts to provide ammunition supplies of hundreds of rounds.

But the biggest advantage of a link-belt feed system is that while the gun is firing the feed system only has to pull into the gun a few rounds at any one time. This is a big advantage because both the drum and box magazine must start and stop all the ammunition they contain with each shot.

However the major problem with all link-belt feed systems is that reloading the link-belt into the gun feed system requires the user to take the time to do it right—and the loading operation is not intuitive.

However the reloading of a loaded drum or box magazine into a gun is both fast and intuitive. To permit the link-belt feed to be variable on a new improved automatic gun, the task of reloading the automatic gun must be simplified and made as intuitive as loading a box magazine.

The inherent advantage of the basic link-belt feed system is that the drive system used to power the link-belt feed system could be used to power other self-contained feed containers.

A driven feed container could offer a container similar in profile to box magazines but provide ammunition capacities comparable to drum magazines.

From the technical standpoint if the military shotgun is to integrate into the modern military infantry squad as a standard issue weapon then a link-belt feed system will be needed. Only the link-belt feed system will be able to provide the shotgun the same sustainable firepower as offered today by other squad level automatic weapons.

Another major limitation of the military shotguns in use today has been the shotshell ammunition provided for military use.

A Glimmer of Hope

A glimmer of hope for a new purely military shotshell was shown in the 60's when the United States took a serious look at using the flechette as the basic projectile unit of shotshell loading. A flechette shotshell fires a cluster of 20 or more flechettes as compared to the 9 lead pellets of 00 Buck then in common use. These experimental shotshells were quite effective and earned a good reputation by the US Marines and US Navy SEALS who use them, (Pages 464-477 *The World's Fighting Shotguns*).

The word flechette means little arrow, and the flechette as used was nothing but a small steel arrow. Field reports of flechettes used in combat were encouraging and single shot kills beyond 300 meters were documented (page 465-467, *The World's Fighting Shotguns*). However most combat was less than 100 meters, with the majority of combat less than 50 meters.

The rather crude 7.5-grain flechette used penetrated armored vest and steel helmets out to nearly 500 meters. A flechette pattern density out to 50 meters assured single shot hits and single shot kills. If two rounds were fired the effective range increased because of the greater flechette population in the same target zone.

However the flechettes ability of penetrate a steel helmet also equated to cleanly penetrating the target. The problem was that unless a vital area was hit by the flechette during its through and through passage little damage would be actually done to the target.

In the late 60's a review was done to evaluate the US shotgun flechette programs and the use of the flechette in the combat environment. In summary the evaluation showed the following:

- To obtain a reasonable target pattern density at 100 meters no less than 20 flechettes needed to be launched per single round fired.
- A flechette body diameter of 2 mm or more would be desirable. This body diameter should be coupled with a body length as long as possible with the largest fin diameter commiserate with flechette aerodynamic stability.
- To improve the flechette target lethality the flechette should deform or go unstable after target impact.
- The flechette pattern size must be smaller than the experimental rounds evaluated if a P^h of 0.9 at 100 was to be obtained.
- Any military shotshell must be fully waterproof.

In summary the review showed that the engineering work that had been done to date had been good. The historical technical data provided a solid engineering foundation for further work. However further engineering work remained to be done before the flechette would be optimized for combat use.

In summary the design requirements for a new gun have been established. These design requirements were married to the performance requirements for a flechette loaded shotshell. From this marriage it was possible to make an in-depth engineering review of the tactical requirements the new gun system was to satisfy.

The engineering review showed that the multiple-projectile system as envisioned would do what it was envisioned to do. However the ammunition fired lacked a critical capability—the ability to provide effective indirect fire. The problem was that this basic capability could only be met by using an explosive shell.

To design an explosive 12-gauge shotshell was possible. In fact several explosive 12-gauge shotshells are on the market today. However the 12-gauge has a bore diameter of only approximately 18.5 mm. Such a small bore diameter would never be able to provide the blast to fragment ratio needed if fired from a 2¾ inch shotshell. Simply put—the caliber size to shell length and thus the resulting charge-to-mass ratio in fin-stabilized explosive shell was just not there. A projectile caliber of at least 30 mm would be needed if the requirements of the new explosive shell were to be met.

Rather than take the just big enough approach and design a new 30 mm cartridge, it would be more prudent to use the proven NATO 40 mm grenade cartridge. The NATO family of 40 mm grenade cartridges has been well proven over the past 50-years of combat usage. The NATO 40 mm grenade cartridge would be very effective and provide the needed indirect fire blast-fragmentation capability found lacking in the engineering review.

To be able to fire the entire family of NATO 40 mm grenade cartridges the technical capabilities of existing 40 mm grenade launcher attachments now in use on current assault rifles were reviewed and found lacking for a new urban combat gun.

Unlike all of the current single shot 40 mm grenade launcher attachments the new improved 40 mm grenade launcher must be able to fire more than a single grenade before requiring the user to reload. In addition the user must be able to select the type of grenade being fired as the tactical need dictates without having to unload and load the grenade launcher.

However the new grenade launcher must still be as simple and light as the existing single-shot 40 mm grenade launchers attachments now in use.

The new grenade launcher must be able to attach and detach from the automatic gun while in the field, and do this without the use of tools. When attached to the host gun the new grenade launcher/automatic gun combination must NOT detract from the use and performance of either weapon. Together the new automatic gun and new grenade launcher combination should be optimized for use in the urban combat environment.

However the grenade launcher should also designed to be fully operational on or off a host weapon. If the new 40 mm grenade launcher is removed from the host gun it should still be fully operational and able fire the full family of 40 mm NATO cartridges.

From the foregoing it can be seen that a need exist for a weapon system that is optimized for the urban combat environment to eliminate or substantially reduce the above-mentioned problems, limitations and disadvantages commonly associated with weapon systems of conventional design and construction.

SUMMARY

It is a broad object of this embodiment to provide two improved firearms in the form of a automatic gun with a improved flechette shotshell and a multiple shot 40 mm grenade launcher capable of integrated operation to form a weapon system optimized for use in the urban environment.

The automatic gun is a improved recoil operated belt fed machine gun. In accordance the embodiment envisioned covers a low felt recoil and low weight selective fired recoil operated machine gun that is capable of firing from either a link-belt or a magazine feed system and capable of attaching a multiple-shot 40 mm grenade launcher without the use of special attachments or modifications to the automatic gun. More particular the major features of this embodiment are:

- Gun feature #1 of this embodiment: felt recoil. Substantially reduce the felt recoil of the automatic gun so the user can control it during automatic fire and do this without increasing the travel distance of the bolt within the gun more that is needed for the major functions of extraction-ejection-feeding-firing.
- Gun feature #2 of this embodiment: fire control. Provide for a simple to install and remove assembly that contains the components for the fire control and feed drive requirements of the automatic gun and allow the automatic-semiautomatic-safe mode settings from either side of the gun without changing the relative position of the fire control selector arm when changed from one gun side to the other.

Gun feature #3 of this embodiment: folding shoulder stock. Provide an easy to use and to install/remove folding shoulder stock that can be stowed on the right side of the gun by the user in the field and not distract from the gun function when stowed.

Gun feature #4 of this embodiment: gun complexity, service & cost of fabrication. To reduce the complexity of the automatic gun and make it easy to use and service in the field.

Gun feature #5 of this embodiment: gun weight and fabrication. Reduce the weight of the automatic machine gun by using polymer materials for as many of the components as possible and incorporate metal components only as needed.

The multiple-shot 40 mm grenade launcher is capable of firing independently or as an attachment on a host weapon, more particularly on the accessory rail of the automatic gun. Mounting and removal of the multiple-shot 40 mm grenade launcher from the automatic gun bottom accessory rail can be done without the use of tools or modifications to the automatic gun. The major features of the multiple-shot 40 mm grenade launcher of this embodiment are:

Launcher feature #1 of this embodiment: double-action lock. Provide a launcher double-action lock that is easy to use by either left or right hand users to fire the 40 mm grenade launcher Launcher feature #2 of this embodiment: grenade launcher safety. Provide a launcher double-action lock that blocks the movement of the launcher trigger unless the launcher cylinder is in correct chamber alignment with the launcher barrel. Movement of the launcher trigger locks the cylinder to the frame to prevent cylinder rotation.

Launcher feature #3 of this embodiment: loading and unloading of ammunition. Provide an easy to use way to load and unload 40 mm grenade cartridges from the cylinder without affecting host automatic gun operation.

Launcher feature #4 of this embodiment: mounting to host automatic gun. Provide a fast and simple means to mount the multiple-shot 40 mm grenade launcher on the host automatic gun accessory rail that can be used by either left or right hand users and accomplished in the field without tools.

Launcher feature #5 of this embodiment: complexity, service, and weight. To reduce the multiple-shot 40 mm grenade launcher complexity and make it easy to use and service while in the field with the lowest overall weight.

Felt Recoil: Gun Feature #1 of this Embodiment

Felt recoil is a technical phrase and as defined in this embodiment is what the layman not skilled in the art would call the kick of the gun. What is not well understood by many is that the impulse of the cartridge cannot be reduced by mechanical means, only the resultant recoil force spread out over a longer time base than the cartridge operating cycle. When the recoil force is spread out over a longer time base, then it is said that the felt recoil of the gun has been reduced.

Realistically substantial reduction of the felt recoil force is not possible in repeating actions characterized by pump action shotguns. This is because technically only two things can be done to actually reduce the felt recoil in non-automatic guns:

1. Use a Muzzle Brake.

Muzzle brakes work by impinging the escaping muzzle gun gas onto baffles within the muzzle brake to direct the gun gases in a sideward or rearward direction. When this is done the apparent effect is to pull the gun forward. The forward pull on the barrel reduces the total rearward recoil impulse of the cartridge—thus reducing the felt recoil the user feels.

However in practice muzzle brakes are limited in how effective they are to the cartridge charge to mass ratio coupled with the cartridge operational pressure. Simply put the higher the cartridge operating pressure and the higher the propellant weight relative to the projectile weight the better the muzzle brake can work.

Even on rifles operating at high chamber pressures with favorable charge to mass ratios the muzzle brakes seldom can reduce the gun recoil impulse more than 30%.

Usually a muzzle brake is considered a good muzzle brake if it can reduce the gun recoil impulse by as much as 15% to 20%.

In practice muzzle brakes have been of little use on shotguns because they just don't have the right conditions to operate well. This is because of the relative small weight of propellant operating at a relative low pressure to launch a relative high throw weight.

2. Add a Gun Buffer

A gun buffer in the context of this embodiment is defined as a shoulder pad made from a compliant material that is placed on the aft surface of the shoulder stock. The intent of the gun buffer approach is to let the shoulder stock be driven into the compliant shoulder pad—thus spreading out the time base of the recoil force the user feels.

The common shoulder pad will only allow a total movement of the gun into the shoulder pad of about 3 or 4 mm. There is marginal functionality in the use of a shoulder pad and they do take the sting from the kick. This is because the shoulder pads flatten the spike of the recoil load, but no significant reduction in total felt recoil can be obtained.

Other more complex gun buffer designs have been made. However all gun buffers used on non-automatic guns are limited in the amount of felt recoil they can reduce because of they are limited in the amount of gun travel permitted when firing from the shoulder.

Automatic Guns and Felt Recoil Loads.

As is understood by those of ordinary skill in the art the felt recoil of any gun results solely from the impulse of the cartridge when the gun is fired. In layman's language the bullet goes one way and the gun goes the other way—both with the same momentum.

As explained in the preceding section substantial reduction in felt recoil can only be obtained in automatic guns. This is because to reduce the felt recoil something must move on the gun to spread out the recoil force time base. It is that simple.

Which is the best automatic gun action to reduce the felt recoil? To understand which automatic gun action is best suited a brief review of the different types of automatic gun actions is needed.

As a general classification there are three types of automatic gun actions in use today that offer the potential to reduce the gun felt recoil.

1. The most common automatic gun action is the gas-operated action as characterized by the Armalite AR18 assault rifle described in the Miller U.S. Pat. No. 3,318,192.

2. The next most common is the blowback operated automatic action as characterized by the machine gun described in Rostocil U.S. Pat. No. 4,066,000 and also in use on most small caliber handguns.

3. Finally there is the recoil operated action as characterized by the Remington Arms Model 1148 auto-loading shotgun and the German MG42 machine gun of WWII.

The common feature for all three types of automatic actions is that they all use the cartridge impulse to operate the gun. By using the cartridge impulse to operate the gun, the impulse that makes up the gun recoil can be spread out over a longer time base and thus reduce the felt recoil force.

Gas-Operated Actions;

In all gas-operated actions the bolt and barrel are locked together. Important too note is that in a gas-operated action the barrel is fixed to the receiver and cannot move. Gun gas is tapped off the barrel to impinge on the bolt to force it rearward. The rearward or recoil travel of the bolt then will unlock it from the barrel and then work through the case extract-case eject-feed functions that are common in all automatic guns.

Although there is no forward force at the time of firing to counter the initial rearward cartridge impulse force, there is a forward component delivered into the barrel/receiver when the gun gas impinges on the bolt to start the bolt recoil cycle. This is because the gas system as it pushes the bolt aft is also pushing the receiver forward.

Most of the felt recoil force from gas-operated actions comes from not the initial cartridge impulse, but rather when the bolt is stopped at the end of the recoil cycle.

This is because the bolt is usually allowed to stop on the receiver and this bolt slap spike is what the user feels as kick. Bolt slap is characterized in guns like the Armalite AR18 assault rifle described in the Miller U.S. Pat. No. 3,318,192.

Imposing a bolt buffer between the receiver and the bolt can minimize bolt slap by damping the bolt slap spike load. This bolt buffer method is characterized in guns like the US M16. Use of a bolt buffer does flatten the spike loading resulting from the bolt slap but since the bolt stroke into the bolt buffer is usually limited to 2-3 mm the resulting reduction in bolt slap spike loading is marginal.

The only way to completely eliminate the bolt slap in a gas-operated action is to not stop the bolt on the receiver. Only using the bolt driving spring to eventually slow and stop the bolt accomplishes this. This design approach has been used with success in several automatic guns. The Sullivan assault rifle as described in U.S. Pat. No. 4,475,437 characterized this method. In this embodiment this manner of stopping the bolt shall be referred to as a long bolt stroke.

A long bolt stroke does prevent the bolt slap. However under normal conditions its use requires an excessive amount of bolt recoil travel to be effective.

The problem is that a long bolt stroke usually results in a reduction of the gun cyclic rate. A Atchisson Assault Shotgun that used a long bolt stroke to eliminate bolt slap best characterizes the reduction in the gun cyclic rate. The Atchisson Assault Shotgun cyclic rate was reduced to only 300 SPM (pages 385-395, *The World's Fighting Shotguns*).

In practice to allow for bad environmental conditions and to allow for shooting the gun down or up usually result in a bolt over-travel for the long bolt stroke that may be as much as 3 to 5 cartridge lengths. This long bolt over-travel distance is quite common when the long bolt stroke method is used.

Blowback Actions

In a blowback action the bolt is not locked to anything when the cartridge is fired. The Rostocil U.S. Pat. No. 4,066,000 characterizes the blowback action. Blowback actions omit the problem of initial cartridge impulse loading by allowing the bolt to move aft in recoil from the instance of firing. Only the high inertial mass of the bolt relative to the low mass of the projectile being fired limits the recoil velocity of the bolt to a safe level.

Blowback actions are very common. It is used extensively in small caliber handguns and almost exclusively is the only automatic action used in sub-machine guns. Both of these automatic guns classes use pistol ammunition. The 5.56 mm machine gun described in Rostocil U.S. Pat. No. 4,066,000 was one of the few successful attempts to use the blowback action to fire a full power rifle cartridge.

In the Rostocil U.S. Pat. No. 4,066,000 the bolt slap problem was address by using a bolt buffer on the bolt and a set of long tension rods attached to a front bulkhead of the receiver. This bolt buffer design permitted almost full restitution of the bolt recoil momentum back into bolt for counter-recoil travel thus retaining a high cyclic rate. However the buffer stroke was limited to only 5 mm and thus did not significantly reduce the bolt slap.

Recoil Gun Actions

The Remington Arms Model 1148 auto-loading shotgun characterizes these actions. All recoil gun actions lock the bolt to the barrel the same as gas-operated gun actions do. But unlike the gas-operated actions the locked bolt and barrel of a recoil gun action is allowed to travel in recoil from the instance of firing. Later at some point in the recoil cycle the bolt and barrel are unlocked from each other. When in the recoil cycle unlocking occurs determines the type of recoil gun action.

As characterized by the Remington Arms Model 1148 the locked bolt and barrel are allowed to recoil together as a locked unit to the rear of the receiver. Once there the bolt is unlocked from the barrel and held there as the barrel is allowed to return to battery. After the barrel has returned to battery the bolt is released to move in counter-recoil to chamber and fire the next round. This type of recoil gun action is called long recoil. Long recoil gun actions were the most common type of automatic action used for auto-loading shotguns for almost 50 years.

If the barrel is stopped after a short recoil travel and the unlocked bolt is then allowed to continue in recoil travel, then the recoil gun action is called short recoil. Guns such as the German MG42 of WWII characterize short recoil gun actions.

The major source of felt recoil in both long and short gun recoil actions is the stopping of both the bolt and the barrel in recoil travel and not the cartridge firing impulse.

In short recoil operated automatic actions bolt buffers have been added to reduce but not entirely eliminate the spike loading that occurs when the bolt impacts the receiver at the end of the bolt recoil cycle.

However nothing has been done to reduce the barrel to receiver impact spike loads that occur after the unlocked barrel stops it recoil travel.

As is well understood by those skilled in the art most short recoil gun actions used what is called an accelerator to transfer some of the barrel recoil momentum into the bolt after the bolt has been unlocked from the barrel. But the accelerator does not buffer the remaining barrel recoil momentum before the receiver finally stops the recoil travel of the barrel. In fact the accelerator itself transfers a major spike load into the receiver. This is because they usually use a rotating lever to accomplish the acceleration, wherein this pivoting movement through the accelerator pivot support transfers a spike load to the receiver.

Spike loads from stopping both the barrel and bolt in recoil travel combine to make the high felt recoil loads found on all short recoil operated guns in use today.

It is the object of the first gun feature of this embodiment to provide a substantial reduction in the felt recoil of the gun while not reducing the gun cyclic rate.

Other than using a very long bolt over-travel the gas-operated automatic actions offer no inherent way to stop the bolt recoil travel without creating a high felt recoil load.

Blowback operated gun automatic actions also inherently do not offer any way to stop the bolt recoil travel without creating a high felt recoil load, and they have the added disadvantage of either a very high bolt recoil velocities or a large bolt mass.

Only the recoil operated automatic actions offer the potential to reduce the felt recoil force. But this can only be done if both the barrel and bolt can be stopped in recoil without creating a spike recoil load.

As envisioned in this embodiment to stop the barrel after it has been unlocked from the bolt a long stroke barrel spring is used. Unique to the gun of this embodiment the barrel does not start to compress the barrel spring until after the bolt has been unlocked from the barrel.

The barrel spring permits free recoil travel of the barrel for approximately 25 mm or more. The barrel is not stopped directly by the receiver, but rather all of the barrel recoil stopping loads are transmitted into the receiver through the barrel spring. The use of the barrel spring to stop the barrel recoil travel omits the barrel recoil slap common to all short recoil automatic actions.

As envisioned in the gun shown in this embodiment to stop the bolt recoil travel the barrel spring is used once again. The bolt in recoil travels over the barrel locking lug in a bolt barrel guide grove that is cut into the body of the bolt. At the end bolt recoil travel the bolt strikes the barrel locking lug at the end of this grove and stops its recoil travel. The bolt barrel guide grove sets the limit of bolt recoil travel—not the receiver. Bolt impact on the barrel locking lug provides almost full restitution of bolt recoil momentum back into bolt counter-recoil momentum. Almost full restitution of bolt recoil momentum is accomplished without the bolt impacting the receiver.

Once again the barrel is put into a recoil cycle after stopping the bolt recoil travel, and once again the barrel spring stops the barrel recoil travel. Thus in operation the barrel and barrel spring cycle twice in recoil travel during each gun cycle.

Breaking up of the cartridge recoil impulse into two loadings—with both recoil loadings going through the barrel spring—provides for a major reduction in the gun felt recoil.

t is envisioned in the gun shown in this embodiment that a barrel cam slider will be used to interface with a receiver barrel cam. The barrel cam slider works with the receiver barrel cam to provide the bolt to barrel locking and unlocking functions.

By allowing the barrel to move over the relative stationary barrel cam slider the barrel is allowed to move freely in recoil travel after the barrel has been unlocked from the bolt. Small and low in weight the barrel cam slider is stopped in recoil travel after only a short travel distance and locked into position within the receiver barrel cam allowing the barrel body to remain free to continue its recoil travel compressing the barrel spring.

This separation of basic barrel to bolt lock functions into two separate and free to move components is unique to this style of lock. This style of lock is familiar to those skilled in the art and is used on many pistols today as either the Browning Lock or the SIG Lock. However all current applications of this style of lock do not allow the barrel to move in recoil AFTER the barrel has been unlocked from the bolt. Only in the gun shown in this embodiment is the barrel allowed to continue recoil travel after it has been unlocked from the bolt.

Unique to the gun in this embodiment the bolt, or slide as it is called in a pistol, in recoil travel is guided by the receiver but is restrained in recoil travel by the barrel that is free to move in recoil after unlocking and stopped in recoil travel only by the barrel spring.

Fire Control, Gun Feature #2 of this Embodiment

In most automatic guns the components needed to control the mode of firing are located within the receiver and are not easily removed for service.

Characterized by the US M16 and the Armalite AR18 assault rifle, the fire control components are held in place within the receiver by pins that are pressed fit in place or held in place by retaining devices. A fire control selector that controls the automatic-semiautomatic-safe settings is located on the right side of the receiver. These fire control selectors are not capable of being removed and installed on the left side of the receiver. For a left-handed user locating the safety on the right side of the gun makes it difficult to reach and use.

In some commercial guns such as the Remington Arms Model 870 & Model 1100 place the fire control components in a removable assembly that is held in place within the receiver by pins—which are in turn held in place by spring retainers located within the fire control assembly. However in the case of the Remington Arms auto-loading model 1100 shotgun there is no capability for automatic fire nor is there any design consideration for holding the bolt in the open-bolt position.

Few assault rifles or machine guns today offer a complete fire control system that can be used by either left or right-handed users and fully contained in a easy to remove from the gun assembly.

Bullpup, why not Use One?

Found in favor by some of the world militaries today is a gun configuration called bullpup. The term bullpup means a gun configuration in which the automatic action is telescoped back to operate within the shoulder stock of the gun. In the bullpup configuration the rearward travel of the bolt is stopped close to the aft face the shoulder stock.

A bullpup configuration provides for a short gun overall length, which is very desirable in close quarter combat. However the bullpup configuration also means that the case ejection and fire control will also be located close to the face of the user and must be changed for left or right-handed use.

Usually bullpup configurations provide for the removal of the fire control assembly to permit the changing of the location of the fire control selector to either the left or right side of the gun. But this change over is usually done at a company level by the ordnance officer and not by the user.

Usually when changing the side of the gun the fire control selector is mounted on will also change the relative position of the arm of the fire control selector points. This means that the arm of the fire control selector could point forward on one side to mean safe while on the other side pointing forward might mean automatic fire.

It is the object of the second gun feature of this embodiment to provide a complete self-contained fire control system within a single assembly that can be easily removed and installed in the field by the user. The fire control selector of the fire control system will also be easily changeable by the user for left or right handed operation. When changed the arm of the fire control selector shall not alter where the arm of the fire control points for automatic-semiautomatic-safe settings.

Fire Control Selector

It is envisioned in the gun shown in this embodiment that a fire control selector is easy to change from left to right side operation by simply pulling it out and installing it into the other side of the pistol grip. Once installed the arm of the fire control selector will point for each fire mode in the same direction for automatic-semiautomatic-safe.

Fire Control System Installation and Service

A fire control system as envisioned in this embodiment is installed as part of the pistol grip. Attachment of the pistol grip into the receiver is shown in FIG. 8.

The complete fire control system can be disassembled into its' individual components without the use of tools.

Bolt Hold-Open and Trigger Disconnection

The bolt hold-open and trigger disconnection are components within the fire control system. The bolt hold-open function is to hold the bolt in the open-bolt position until released by a trigger or the fire control selector. To stop the gun from firing the user releases the trigger, which is interconnected to the bolt hold-open.

This style of fire control is usually called a Browning-trigger, named after its inventor. This style of trigger is the basis for both of the trigger styles used in the Armalite AR18 assault rifle described in the Miller U.S. Pat. No. 3,318,192 and the assault rifle described in the Sullivan U.S. Pat. No. 4,502,367. They both may look different but they both use basic principles as John Browning used in his original trigger design.

What is unique in this embodiment is the way the components are easy to install in an assembly that is itself easy to install or remove from the gun—all done without the use of tools.

Folding Shoulder Stock, Gun Feature #3 of this Embodiment.

As is understood by those of ordinary skill in the art unless the bullpup gun configuration is used it is desirable today to provide the user a way to shorten the length of a shoulder fired gun. A short gun is desirable for close quarter combat. Close quarter combat requires fast movement of the gun when firing from either the shoulder or non-shoulder position.

A short gun also allows easier carrying of the gun and stowing of the gun in vehicles. Being able to use or remove the shoulder stock also permits more versatile vehicle mounting.

Normally the shoulder stock is only required when firing from the prone position. Conversely the short gun configuration without a shoulder stock is usually only used when firing from positions other than the prone position.

To use a shoulder stock the gun must have the correct pull length. A desirable pull length is usually not less than 13 inches but usually no more than 16 inches. If the user is shooting the gun while wearing winter clothing or protective body armor then the shorter pull length is preferred. The Armalite AR18 assault rifle described in the Miller U.S. Pat. No. 3,318,192 characterized an assault rifle using the short pull length. The German MG42 of WWII was usually fired from the prone position and it characterized guns using the long pull lengths.

To shorten the overall length of the gun most shoulder stocks are moved to a forward stow position. Usually the shoulder stock is put into the forward stow position by the following three methods.

1. Telescoping the shoulder stock forward into or around the receiver. The German HECKLER & KOCH MP5 sub-machine gun and the US M3 Grease Gun sub-machine gun of WWII both characterize the telescoping method.

2. Pivoting the shoulder stock up onto the receiver or down and under the receiver. The German MP43 sub-machine gun characterized the bottom pivot method and the Russian PPSh-41 sub-machine gun characterized the top pivot method. Both of these weapons were used in WWII.

3. Folding the shoulder stock to the side of the receiver. The Armalite AR18 assault rifle described in the Miller U.S. Pat. No. 3,318,192 characterized the folding method.

Telescoping Shoulder Stocks

Historically it has been found that the telescoping shoulder stock method has an inherent weakness and provides for an uncomfortable and poor interface with the users face.

Pivoting Shoulder Stocks

Historically it has been found that using the pivoting shoulder stock method is also limited. Pivoting the shoulder stock up or down onto the receiver requires the shoulder stock shoulder support to be hinged when placed in the stow position. This weakens the shoulder support without a major weight penalty and makes good and comfortable user interface difficult.

To pivot the shoulder stock under the receiver also is only possible when the magazine placement, type and size of the magazine permit. To pivot the shoulder stock onto the top of the receiver also may interfere with the sights mounted on the gun or make sighting the gun difficult.

Folding Shoulder Stocks

Historically it has been found that the folding shoulder stock is the best method when strength and ergonomic are considered. A folding shoulder stock can be made suitable for firing the gun from either the prone or shoulder position and still allow it to be put into a stowed position to shorten the overall length of the gun.

In common use the folding shoulder stock is usually folded to the left side of the gun. This is because folding the shoulder stock to the right side will usually interfere with the ejection of the fired cases and cartridge links from the gun and can also interfere with gun charging. These limitations can be seen on the Armalite AR18 assault rifle described in the Miller U.S. Pat. No. 3,318,192.

As shown on the Armalite AR18 assault rifle the fire control selector is also mounted on the right side of the receiver. To fold the shoulder stock to the right side of the gun would block access to the fire control selector.

However when the folding shoulder stock is folded to the gun left side to avoid these problems it also means that the folding shoulder stock will be on the side of the receiver that is next to the users body when being carried with a sling. Stowing the folding shoulder stock on the left side of the receiver is not good when a sling is used because it will push the gun out and away from the users body. Also being next to the users body might cause the folding shoulder stock to interfere with something the user is wearing.

To avoid these ergonomic problems the folding shoulder stock should fold to the right side of the receiver. However when folded to the right side of the receiver the folding shoulder stock must not interfere with user access to the fire control selector or interfere with the ejection of the fired cases and spent links.

Another limiting feature of existing folding shoulder stocks is that they usually are difficult to remove and install. It is desirable that the folding shoulder stock be able to be installed and removed by the user without the use of tools.

It is the object of the third gun feature of this embodiment to provide a strong, ergonomic, and lightweight folding shoulder stock. It should be easy to installed or removed by the user without requiring tools. It should be stowed on the right side of the receiver. When it is stowed it should permit user access to the fire control selector regardless of the side of the gun the fire control selector might be mounted. When in the stow position it should not interfere with the ejection of the fired cases and spent cartridge links. Gun function must be entirely independent of the folding shoulder stock, having reliable gun function with or without it.

Gun Complexity, Service and Cost, Gun Feature #4 of this Embodiment

Most magazine fed guns today are rather simple in design, however the link-belt fed LMG or SAW automatic guns usually are quite complex. This usually results in LMG and SAW automatic guns being harder to service and maintain than magazine fed automatic guns. The added complexity of a link-belt feed also results in a significant increase in the cost to fabricate when compared to the fabrication cost for a magazine fed gas-operated automatic gun.

It is the object of the fourth gun feature of this embodiment to provide a link-belt fed automatic gun that is not complex, easy to service and still similar in cost to magazine fed automatic guns.

To aid in servicing the automatic gun it is envisioned in this embodiment that the automatic gun would be made from major assemblies of function groups. Each major assembly will contain all if not most of the components needed for a single functional group. That each major assembly and the components it contains be easy to access and service. That the major assemblies be easy to change out if found to be defective.

To ensure reliable operation all components within the major assemblies should be protected from the environment. Even though they are protected the major assemblies should still be open enough to prevent the accumulation of dirt, sand, mud, water and other foreign objects.

Using the US M16, as an example the gun should NOT require wet lubricants for reliable function. This is because in the field environment wet lubrications not only lubricate the gun they also act as a magnet for fine sand. When fine sand is mixed with a wet lubricant an abrasive cocktail is created that will slow down and eventually stop any gun. Not only will this abrasive cocktail stop the gun but will also abrasively wear out gun components as the gun shoots.

The gun envisioned in this embodiment can operate without wet lubricants and protect its functioning components from the environment. The gun envisioned in this embodiment allows for the shedding of sand and mud and prevents accumulation in the major assemblies.

Gun Weight and Fabrication Methods, Gun Feature #5 of this Embodiment.

It is obvious to those of ordinary skill in the art that the weight of any gun must be as low as possible for a multitude of reasons.

However there is a lower limit of gun weight that is dictated by the complexity of the gun, the physical size of the components that are needed to accomplish the functions assigned to them, and the physical requirements of the automatic gun action dynamics.

This is especially true in guns using link-belt fed systems as characterized by the German MG42 LMG of WWII and US M242 SAW. The usual weight of a modern assault rifle is 6 to 8 pounds. The SAW is approximately 14 pounds, as characterized by the US M242. The LMG is approximately 26 pounds, as characterized by the German MG42.

Cartridges the link-belt fed guns fire and the fabrication methods used to make them—rather than the feed system design itself—dictate the difference in weight for two different link-belt fed guns listed.

Normally the higher weight of the LMG and the SAW over an equally chambered assault rifle results from the increased complexity of the linked-belt fed system and its functional requirements.

It is the object of the fifth gun feature of this embodiment to provide an automatic gun that uses a link-belt feed system but has a weight comparable to box magazine fed assault rifles. The difference between the link-belt feed system as envisioned in this embodiment and other link-belt feed systems now in common use is in the method of fabrication used, the materials used to make most of the components, the layout of the feed system within the gun, and how the gun feed system interfaces to the gun action for power to operate. Also by the polymer molding most of the feed system components allows the link-belt fed feed system as envisioned in this embodiment to be light in weigh and low in cost.

As envisioned in this embodiment the link-belt feed system design is different from other current link-belt feed systems in two major ways:

1. The design of the feed components permits them to be molded from polymer materials.

2. Splitting of the feed system into two separate functions.

a. Feed drive b. Feed advance

Double-Action Lock: Launcher Feature #1 of this Embodiment

The technical phrases double-action lock as defined in this embodiment is derived from the classic revolver term double-action lock. However as used in this embodiment it is not the same. In the classic double-action lock as found in most revolvers, pulling the launcher trigger back not only pulls the hammer back to the cocked position but will advance a ratchet pawl to rotate the cylinder. As the cylinder is being rotated a spring-loaded cylinder lock is released that engages a notch in the cylinder body after cylinder has been rotated one chamber position. After cylinder indexing final launcher trigger pull releases the hammer to fall and fire the gun.

In this embodiment the double-action lock differs in the following way. Pulling the launcher trigger aft still pulls the hammer back but launcher trigger movement does not index the cylinder. Indexing or rotation of the cylinder is done directly by the user, not by launcher trigger movement. After the cylinder has been indexed by hand a set of strong detents retain the cylinder in correct chamber alignment with the barrel. However before the launcher trigger is pulled aft the detents can be over ridden and the cylinder rotated by hand either clockwise or counter clockwise.

It is the object of the first launcher feature of this embodiment to provide a simple to use modified double-action lock to safely fire the grenade launcher.

Grenade Launcher Safety, Launcher Feature #2 of this Embodiment.

In the classic double-action lock, trigger movement is always allowed. Even if the cylinder chamber is not in alignment with the barrel the trigger can still be pulled. The classic double-action lock depends on the cylinder ratchet to advance and catch up with the rotational position of the cylinder and establish correct chamber to barrel alignment. In the double-action lock used in this embodiment launcher trigger pull does not index the cylinder, the user does. Since a cylinder chamber is already in alignment with the grenade launcher barrel only the locking of the cylinder in place for safe firing is required. At the first movement of the launcher trigger the cylinder lock is camed down into engagement with a cylinder lock notch in the cylinder body. If the cylinder lock and the cylinder lock notch are not in alignment with each other the cylinder lock cannot move down. If the cylinder lock cannot move then the launcher trigger also cannot move. Thus the launcher trigger cannot be pulled unless a cylinder chamber is in correct alignment with the barrel.

It is the object of the second launcher feature of this embodiment to be safe to fire and only fire when a cylinder chamber and the barrel are in correct alignment and the cylinder locked from movement. There is no component within the grenade launcher called safety because none is needed.

Loading and Unloading of Ammunition, Launcher Feature #3 of this Embodiment.

In the classic sense there are three ways to reload a revolver cylinder.

1. The cylinder swing-out frame design used to expose the face of the cylinder,

2. The break-open frame design used to expose the face of the cylinder,

3. The loading gate on the frame used to expose one cylinder chamber.

The grenade launcher in this embodiment uses very large 40 mm cartridge. The large caliber size of the cartridge imposes a practical limit on the number of chambers the cylinder can have. These factors forced the grenade launcher in this embodiment to use a cylinder of only three chambers and also limited the practical options available for loading and unloading.

Swinging such a large cylinder out from the frame would the frame and cylinder cradle needed to hold the cylinder overly complex. The cylinder swing-out frame design would also drastically increase the overall weight of the grenade launcher.

The use of the break-open frame design to expose the cylinder face is impractical for two major reasons.

1. Break-open frames inherently weaken the strength of the frame. This is the major reason that today break-open frames are seldom used.

2. A break-open frames would limit the placement on the host gun. Only mounting to the side or top of the host gun would be practical.

The only practical solution is to use a loading gate. The only serious drawback to the loading gate is that only one cartridge can be loaded at a time. Since there are only three cartridges to be loaded this drawback is somewhat nullified. The loading gate design approach can provide full access to the chambers to load and unload the large caliber 40 mm grenade cartridge and do this without weakling the frame. The loading gate also allows the grenade launcher to be mounted on the bottom accessory rail of the host gun, which is the best of all possible mounting locations.

It is the object of the fourth launcher feature of this embodiment to provide a method to load and unload the grenade launcher without weakening the frame or increase the overall weight. The loading gate provides the best solution to obtain the lowest weight with the minimum of complexity while not sacrificing frame strength.

Mounting to the Automatic Gun, Launcher Feature #4 of this Embodiment

All grenade launcher mounts in use today require modifications too the host automatic gun they are attached to. These automatic gun modifications can and usually do require major work. After modification the mounting of the grenade launcher requires tools and usually requires an ordnance technician skilled in the art. After the grenade launcher is installed the user in the field cannot removed it from the automatic gun. Furthermore once grenade launcher has been removed from the host automatic gun it is not operational—meaning it cannot be fired independent of a host gun.

The envisioned grenade launcher in this embodiment is made to be operational when mounted on the automatic gun shown in this embodiment or as a stand-alone weapon. The grenade launcher in this embodiment is made to slide onto the bottom accessory rail of the automatic gun. The user without tools can mount of the grenade launcher and do the mounting while in the field. More importantly the user in the field can remove the grenade launcher from the host automatic gun without affecting either weapons.

It is the object of the fourth launcher feature of this embodiment to provide the user a fast and easy way to mount or remove the grenade launcher from the host automatic gun while in the field and do this without tools or special ordnance skills. Both the grenade launcher and the host automatic gun shown in this embodiment are fully functional when mounted together or independent of each other.

Complexity, Service and Weight, Launcher Feature #5 of this Embodiment

It is obvious to those of ordinary skill in the art that the weight of any grenade launcher must be as low as possible for a multitude of reasons. To make a grenade launcher of low weight it must be designed to be very simple and allow the use of low weight materials. The envisioned embodiment of the grenade launcher accomplished this by extensive use of components made from polymer and alloy materials assembled in a very simple design.

It is the object of the fifth launcher feature of this embodiment to provide a grenade launcher that uses polymer and alloy materials in a very small and a simple grenade launcher design. To provide a grenade launcher design that is simple keeps the overall weight and complexity of the grenade launcher as low as possible.

DRAWINGS

Figures

FIG. 1 grenade launcher assembly installed on Urban Combat System (UCS) automatic gun assembly loaded with ready box assembly;

FIG. 2 grenade launcher installed on automatic gun that is loaded with single sprocket magazine assembly;

FIG. 3 grenade launcher installed on automatic gun loaded with dual sprocket magazine assembly;

FIG. 4 loading automatic gun with single sprocket magazine;

FIG. 5 loading automatic gun with dual sprocket magazine;

FIG. 6 loading automatic gun with ready box;

FIG. 7 installing grenade launcher onto automatic gun loaded with loaded dual sprocket magazine;

FIG. 8 expanded view of automatic gun showing major assemblies;

FIG. 9 sectioned view of automatic gun after firing but before the start of recoil, shown are areas of coverage for FIG. 9A, FIG. 9B, and FIG. 9C;

FIG. 9A close-up of barrel chamber and barrel to bolt lock region;

FIG. 9B close-up of fire control region;

FIG. 9C close-up of barrel stop region;

FIG. 10 sectioned view of automatic gun after unlock, shown are areas of coverage for FIG. 10A, FIG. 10B, and FIG. 10C;

FIG. 10A close-up of barrel chamber and barrel to bolt lock region;

FIG. 10B close-up of feed advance region;

FIG. 10C close-up of barrel stop region;

FIG. 11 sectioned view of automatic gun during first barrel recoil cycle, shown is areas of coverage for FIG. 11A, FIG. 11B, and FIG. 11C;

FIG. 11A close-up of barrel chamber and barrel to bolt lock region;

FIG. 11B close-up of fire control region;

FIG. 11C close-up of barrel to bolt lock region;

FIG. 12 sectioned view of automatic gun during bolt free recoil, shown is areas of coverage for FIG. 12A and FIG. 12B;

FIG. 12A close-up of case ejection and fire control region;

FIG. 12B close-up of barrel to bolt lock region;

FIG. 13 sectioned view of automatic gun during second barrel recoil cycle, shown is areas of coverage for FIG. 13A, FIG. 13B, and FIG. 13C;

FIG. 13A close-up of feed advance and fire control region;

FIG. 13B close-up of bolt-to-bolt hold-open sear region;

FIG. 13C close-up of barrel chamber region;

FIG. 14 sectioned view of automatic gun at start of bolt counter-recoil cycle, shown is areas of coverage for FIG. 14A, and FIG. 14B;

FIG. 14A close-up of barrel to bolt lock region;

FIG. 14B close-up of barrel stop region;

FIG. 15 sectioned view of automatic gun at start of bolt ramming of cartridge, shown is areas of coverage for FIG. 15A, FIG. 15B, and FIG. 15C;

FIG. 15A close-up of barrel chamber region;

FIG. 15B close-up of feed ramp region;

FIG. 15C close-up of barrel stop region;

FIG. 16 sectioned view of automatic gun showing bolt-ramming cartridge into chamber, shown is areas of coverage for FIG. 16A, and FIG. 16B;

FIG. 16A close-up of cartridge ramming up feed ramp;

FIG. 16B close-up of rammed cartridge and barrel chamber;

FIG. 17 sectioned view of the automatic gun chambering a cartridge, shown is areas of coverage for FIG. 17A, FIG. 17B, and FIG. 17C;

FIG. 17A close-up of fire control and feed advance region;

FIG. 17B close-up of barrel lock and chambered cartridge region;

FIG. 17C close-up of barrel stop region;

FIG. 18 sectioned view of the automatic gun showing barrel locked into the bolt, shown are areas of coverage for FIG. 18A, FIG. 18B, and FIG. 18C;

FIG. 18A close-up of fire control region;

FIG. 18B close-up of barrel lock region;

FIG. 18C close-up of barrel stop region;

FIG. 19 expanded view of trigger assembly;

FIG. 20A left side view, fire control components on automatic, hammer on trigger;

FIG. 20B right side view, fire control components on automatic, hammer on trigger;

FIG. 21A left side view, fire control components on automatic, hammer on auto-sear;

FIG. 21B right side view, fire control components on automatic, hammer on auto-sear;

FIG. 22A left side view, fire control components on automatic, hammer down;

FIG. 22B right side view, fire control components on automatic, hammer down;

FIG. 23A left side view, fire control components on semi-automatic, hammer on disconnector;

FIG. 23B right side view, fire control components on semi-automatic, hammer on disconnector;

FIG. 24A left side view, fire control components on semi-automatic, hammer on trigger;

FIG. 24B right side view, fire control components on semi-automatic, hammer on trigger;

FIG. 25A left side view, fire control components on safe;

FIG. 25B right side view, fire control components on safe;

FIG. 26 installing folding shoulder stock assembly onto pistol grip;

FIG. 26A installed folding shoulder stock assembly extended;

FIG. 27 stowing folding shoulder stock assembly;

FIG. 27A folding shoulder stock assembly in stow position;

FIG. 28 expanded view of flechette loaded shotshell assembly;

FIG. 28A features of flechette;

FIG. 29 aft view of receiver assembly;

FIG. 29A expanded view of receiver assembly;

FIG. 30 expanded view of receiver body assembly;

FIG. 31A expanded view of the bolt assembly;

FIG. 31B bottom view of bolt assembly;

FIG. 31C front view of bolt assembly;

FIG. 31D aft view of bolt assembly;

FIG. 32A loading single sprocket magazine assembly;

FIG. 32B expanded view of single sprocket magazine assembly;

FIG. 32C sectioned view of single sprocket magazine assembly;

FIG. 32D aft view of single sprocket magazine assembly;

FIG. 32E front view of single sprocket magazine assembly;

FIG. 32F feed sprocket wheel with reference features;

FIG. 33A loading dual sprocket magazine assembly;

FIG. 33B expanded view of dual sprocket magazine assembly;

FIG. 33C dual sprocket magazine assembly, aft magazine housing removed;

FIG. 33D cartridge carrier, with reference features and cartridge being loaded;

FIG. 34A expanded view of feed cover assembly;

FIG. 34B aft sectioned view of feed cover assembly;

FIG. 34C front view of loaded feed cover assembly;

FIG. 34D aft view of loaded feed cover assembly;

FIG. 35 ready box assembly;

FIG. 35A sectioned view of making ready box assembly;

FIG. 36 sectioned view of ammo box with lid installed;

FIG. 36A ammo box lid assembly being installed onto ammo box;

FIG. 37A loading cartridge link with various length shotshells, linked-belt assembly;

FIG. 37B view of completed linked-belt assembly;

FIG. 37C view of cam action of rim feed ramp on cartridge rim;

FIG. 37D view mid-way of cam action of rim feed ramp on cartridge;

FIG. 37E view of completed cam action of rim feed ramp on cartridge;

FIG. 38A bottom side view of cartridge link assembly;

FIG. 38B top aft view of cartridge link assembly;

FIG. 39A expanded view of pistol grip fire control components;

FIG. 39AA sectioned view of pistol grip fire control components assembled;

FIG. 39B expanded view of pistol grip feed drive components;

FIG. 39BB sectioned view of pistol grip feed drive components assembled;

FIG. 39C expanded view of pistol grip pistol grip attachment components;

FIG. 39CC sectioned view of pistol grip attachment components assembled;

FIG. 40 aft view of assembled barrel assembly;

FIG. 40A front expanded view of barrel assembly;

FIG. 41B aft view of folding shoulder stock assembly;

FIG. 41C front view of folding shoulder stock assembly;

FIG. 41A front view folding shoulder stock expanded;

FIG. 42 sectioned view of grenade launcher installed on automatic gun loaded with ready box, shown is area of coverage for FIG. 42A;

FIG. 42A close-up of grenade launcher attachment to automatic gun bottom accessory rail;

FIG. 43 sectioned view of grenade launcher being installed on automatic gun, shown is area of coverage for FIG. 43A;

FIG. 43A close-up of grenade launcher attachment region;

FIG. 44 sectioned view of grenade launcher being loaded with 40 mm NATO grenade cartridge, shown is area of coverage for FIG. 44A;

FIG. 44A close-up of grenade launcher, loading gate open and viewed from right side of grenade launcher;

FIG. 44B grenade launcher with loading gate open and viewed from left side of grenade launcher;

FIG. 45 expanded view of cylinder assembly being installed into frame;

FIG. 46 expanded view of frame assembly;

FIG. 47 expanded view of launcher barrel and launcher top strap being assembled;

FIG. 48 expanded view of breech assembly;

FIG. 49 expanded view of cylinder assembly;

FIG. 50 sectioned view of grenade launcher ready to fire, shown are areas of coverage for FIG. 50A and FIG. 50B;

FIG. 50A close-up of breech region and close-up region FIG. 50B;

FIG. 50B close-up of launcher hammer sear and launcher sear region;

FIG. 51 sectioned view of grenade launcher with launcher trigger pulled halfway back, shown is area of coverage for FIG. 51A;

FIG. 51A close-up of breech region with launcher trigger halfway back;

FIG. 52 sectioned view of grenade launcher with launcher trigger pulled all the way back and launcher sear shown disengaged from launcher hammer sear, shown is area of coverage for FIG. 52A;

FIG. 52A close-up launcher sear and launcher hammer region with launcher sear disengaged from launcher hammer sear;

FIG. 53 sectioned view of grenade launcher with launcher trigger pulled all the way back with launcher hammer down and grenade launcher fired, shown is area of coverage for FIG. 53A;

FIG. 53A close-up launcher sear and launcher hammer region with launcher hammer shown down.

| DRAWINGS - Reference Number | |
|---|---|
| 100 | receiver assembly |
| 1002 | trunion hole |
| 1003 | feed index plunger socket |
| 1005 | magazine lip slots |
| 1007 | magazine well zone |
| 1009 | feed ramp |
| 140 | gun charger |
| 140A | charger return spring |
| 141 | charger body |
| 1401 | charger retraction lever |
| 142 | charger handle |
| 110 | barrel bushing |
| 113 | barrel bushing lock |
| 1201 | aft swivel stud |
| 650 | front sling swivel |
| 651 | aft sling swivel |
| 649 | charger spring retaining pin |
| 101 | receive body assembly |
| 120 | receiver housing |
| 1201 | aft sling swivel stud |

-continued

| DRAWINGS - Reference Number | |
|---|---|
| 1203 | top accessory rail |
| 1205 | side accessory rail |
| 105 | case ejector |
| 114 | folding shoulder stock stow stud |
| 180 | receiver Left side plate |
| 181 | receiver right side plate |
| 1813 | receiver bolt guide rib |
| 182 | receiver barrel cam |
| 1821 | front barrel cam locking face |
| 1823 | aft barrel cam facing slope |
| 183 | barrel guide plate |
| 184 | bottom accessory rail |
| 1841 | bottom accessory rail latch notch |
| 200 | bolt assembly |
| 205 | bolt top cover |
| 206 | bolt body |
| 2060 | charger notch |
| 2061 | feed cam path |
| 2062 | bolt hold-open sear tang |
| 2063 | bolt barrel guide grove |
| 2064 | bolt barrel stopping face |
| 2065 | bolt barrel locking recess |
| 2066 | driving spring support |
| 2067 | bolt auto-sear notch |
| 2068 | bolt ram face |
| 2069 | bolt guide grove |
| 207 | case guide |
| 207A | case guide spring |
| 208 | case extractor |
| 208A | case extractor spring |
| 209 | case support |
| 209A | case support spring |
| 220 | firing pin |
| 220A | firing pin return spring |
| 300 | common feed components |
| 308 | feed sprocket |
| 3081 | hex drive socket |
| 3083 | sprocket link thrust rib |
| 309 | feed index plunger |
| 309A | feed index plunger spring |
| 310 | single sprocket magazine assembly |
| 311 | single sprocket aft housing |
| 312 | single sprocket front housing |
| 314 | feed sprocket wheel |
| 3142 | cartridge pocket |
| 3143 | rim feed ramp |
| 3145 | cartridge retainer |
| 3147 | cartridge retention clamps |
| 317 | loading cog |
| 317A | loading cog spring |
| 3101 | magazine lips |
| 3102 | feed tray |
| 320 | dual sprocket magazine assembly. |
| 321 | dual sprocket aft housing |
| 322 | dual sprocket front housing |
| 323 | cartridge carrier |
| 3231 | cartridge carrier chain |
| 3239 | hinge pin |
| 324 | carrier chain roller |
| 635-1 | timing belt |
| 350 | feed cover assembly |
| 3505 | link thrust rib |
| 3506 | front link guide path |
| 3507 | ammo box lug |
| 3508 | aft link guide path |
| 351 | feed cover aft housing |
| 352 | feed cover front housing |
| 354 | secondary link-belt sprocket |
| 355 | center guide rib |
| 358 | link eject cover |
| 358A | link eject cover spring |
| 359 | ammo box latch |
| 359A | ammo box latch spring |
| 360 | ready box assembly |
| 361 | ammo box |
| 3611 | feed cover well |
| 3615 | ammo box latch hole |

-continued

| DRAWINGS - Reference Number | |
|---|---|
| 3617 | ammo box lug pocket |
| 363 | ammo box lid assembly |
| 364 | ammo box lid body |
| 365 | ammo box lid latch |
| 365A | lid latch springs |
| 3637 | ammo box lid attach lug |
| 370 | linked-belt assembly |
| 371 | cartridge link assembly |
| 3715 | link thrust groves |
| 3716 | front link guide |
| 3717 | aft link guide |
| 656 | stiffing spring clip |
| 400 | pistol grip assembly |
| 4001 | pistol grip folding shoulder stock locking key |
| 4003 | pistol grip folding shoulder stock hinge |
| 401 | pistol grip body |
| 411 | hammer |
| 4115 | hammer trigger sear |
| 4117 | hammer disconnector sear |
| 4119 | hammer auto-sear notch |
| 413 | bolt hold-open |
| 4131 | bolt hold-open trigger hole |
| 4132 | bolt hold-open sear |
| 4133 | bolt hold-open fire control slot |
| 415 | trigger assembly |
| 415A | trigger spring |
| 415-1 | trigger body |
| 415-2 | trigger sear plate |
| 4151 | trigger tang |
| 4155 | trigger hammer sear |
| 416 | fire control selector |
| 416A | fire control selector detent |
| 4161 | fire control selector body |
| 4163 | fire control selector slots |
| 4165 | fire control selector arm |
| 417 | disconnector |
| 417A | disconnector spring |
| 4171 | disconnector tang |
| 4175 | disconnector hammer sear |
| 419 | auto-sear |
| 4192 | auto-sear tang |
| 4195 | auto-sear hammer sear |
| 425 | pistol grip latch |
| 425A | pistol grip latch spring |
| 427 | folding shoulder stock latch plate |
| 470 | feed drive flipper |
| 4701 | flipper ring gear teeth |
| 4703 | feed drive flipper pivot hole |
| 480 | feed ratchet |
| 4801 | feed ratchet gear teeth |
| 482 | ratchet cog |
| 482A | ratchet cog spring |
| 486 | feed drive shaft |
| 486A | feed drive shaft spring |
| 487 | magazine release lever |
| 642 | trigger cam pin |
| 647 | disconnector pivot pin |
| 648 | feed drive flipper pivot pin |
| 654 | pistol grip latch retainer |
| 500 | barrel assembly |
| 5001 | barrel locking lug |
| 5002 | barrel spring support |
| 5003 | barrel chamber |
| 5004 | barrel face cam surface |
| 5005 | barrel stopping face |
| 5006 | barrel centerline axis |
| 5007 | barrel slider guide rib |
| 5008 | barrel lug stopping face |
| 5009 | barrel tube |
| 503 | barrel spring |
| 504 | barrel spring guide |
| 505 | barrel body |
| 506 | barrel cam slider |
| 5061 | barrel slider lock tang |
| 5065 | barrel slider lock support |
| 507 | cartridge guide |
| 507A | cartridge guide bias spring |

-continued

| DRAWINGS - Reference Number | |
|---|---|
| 700 | folding shoulder stock assembly |
| 7001 | folding shoulder stock locking key grove |
| 7003 | folding shoulder stock pivot studs stud |
| 701 | folding shoulder stock body |
| 703 | folding shoulder stock latch |
| 703A | folding stock latch spring |
| 613 | folding shoulder stock stow ball detent |
| 750 | driving spring assembly |
| 750A | driving spring |
| 900 | automatic gun assembly |
| 950-0 | cartridge |
| 950-1 | 3½ inch shotshell |
| 950-2 | 3 inch shotshell |
| 950-3 | 2¾ inch shotshell |
| 951 | sabot |
| 952 | flechette cluster |
| 953 | sabot clam shell sides |
| 955 | sabot base |
| 958 | cover disk |
| 9501 | cartridge rim |
| 9502 | cartridge head |
| 9503 | cartridge nose |
| 9504 | cartridge case |
| 980 | flechette |
| 9801 | flechette body |
| 9803 | flechette tail fins |
| 9805 | flechette chisel point nose |
| 8000 | grenade launcher assembly |
| 8400 | frame assembly |
| 8415 | launcher top strap |
| 84151 | accessory rail grove |
| 8416 | launcher buffer |
| 8450 | launcher barrel |
| 8451 | launcher barrel face seal |
| 8455 | cylinder pivot screw |
| 8200 | breech assembly |
| 8210 | breech body |
| 8211 | lock plate |
| 8212 | launcher latch release lever |
| 8213 | loading gate pivot |
| 8214 | breech nut |
| 8215 | loading gate |
| 8217 | loading gate bushing |
| 8228 | lock plate screw |
| 82281 | screw sear cam face |
| 8231 | launcher firing pin |
| 8231A | launcher firing pin return spring |
| 82311 | launcher firing pin hammer face |
| 8232 | launcher hammer |
| 8232A | launcher hammer spring |
| 82321 | launcher hammer sear |
| 8233 | launcher trigger |
| 8233A | launcher trigger return spring |
| 82331 | launcher trigger lock cam |
| 82332 | launcher trigger lock support |
| 8234 | launcher sear |
| 8234A | launcher sear spring |
| 82341 | launcher sear hammer face |
| 82342 | launcher sear cam face |
| 8235 | cylinder lock |
| 8235A | cylinder lock spring |
| 82351 | lock trigger tang |
| 82352 | lock cylinder tang |
| 8236 | launcher latch |
| 8236A | latch spring |
| 8237 | cylinder lock plunger |
| 8237A | cylinder lock plunger spring |
| 8637 | launcher ball detent |
| 8238 | latch shaft |
| 8380 | cylinder assembly |
| 8387 | cylinder body |
| 83871 | cylinder chamber |
| 83872 | cylinder lock notch |
| 8384 | aft pivot bushing |
| 83841 | launcher detent recess |
| 8385 | front pivot bushing |
| 8386 | launcher ejector |

-continued

| DRAWINGS - Reference Number | |
|---|---|
| 8386A | launcher ejector return spring |
| 8602 | launcher ejector spring retaining screw |
| 8614 | launcher ejector screw knob |
| 8950 | 40 mm NATO grenade cartridge assembly. |
| 89501 | 40 mm NATO grenade cartridge case |

GLOSSARY OF TERMS

1. Gun centerline axis, gun axis, bore axis: as used in this embodiment they all mean the same thing. The centerline axis of the bore is in the gun barrel and relative only at the instance in time the gun is fired.

2. Gun centerline axis, gun axis, bore axis: as used in this embodiment they all mean the same thing. The centerline axis of the bore is in the gun barrel and relative only at the instance in time the gun is fired.

3. Feed system: the entire mechanical means and all components needed to bring into the gun unfired ammunition and place those unfired cartridges in position for the bolt to chamber them into the barrel chamber.

4. Locked, lockup: a position wherein the barrel locking lug is secured into the bolt barrel locking recess to prevent relative separation. This position can be seen in FIG. 9A.

5. Fired position: a position of gun components at the moment of gun firing. This position can be seen in the FIG. 9.

6. In battery, battery position, battery: a position of gun components similar to the fired position but before the cartridge has fired. The major difference between the fired position and the in battery position is the relative position of the hammer and firing pin. The in battery position can be seen in the FIG. 18.

7. Feed drive: the mechanical means and components used to power the advancement of ammunition into the gun. The feed drive can be seen in FIG. 39B & FIG. 39BB.

8. Feed advance: the mechanical means and components used to advance the ammunition inside the gun. Feed advance assemblies can be seen in FIG. 32B, FIG. 33B, and FIG. 34A.

9. Chamber, barrel chamber, cylinder chamber: region of gun barrel or cylinder that contains the cartridge.

10. Chambering: the act of inserting an unfired cartridge into a chamber. This can be seen in the FIG. 16A and FIG. 44B.

11. Linked-belt, cartridge belt: the interlocked grouping of cartridge links around cartridges to form a linked-belt of ammunition of any length. This can be seen in the FIG. 37A and FIG. 37B.

12. Cartridge link: a component that attaches to the cartridge to form the linked-belt of ammunition. The cartridge link can be seen in the FIG. 38A and FIG. 38B.

13. Cartridge, shotshell, ammunition, and round: all of these terms as used in this embodiment mean the same. An assembly made up of a cartridge case, primer, propellant and projectile(s). The shotshell used in this embodiment is shown in FIG. 28.

14. Cartridge case, fired case: both of these terms are used in this embodiment interchangeably although technically they are not the same. In this embodiment they all are given the same reference number.

15. Cartridge carrier: a feed system component that holds for transport and positioning within the magazine a single cartridge. A cartridge carrier can be seen in FIG. 33D.

16. Carrier chain, carrier loop, loop of carriers: a cartridge carrier can be linked together with other cartridge carriers to make a carrier chain. A carrier chain can be seen in FIG. 33B and FIG. 33C.

17. Extractor, case extractor, and cartridge extractor: a bolt component that extracts the case or cartridge from the chamber of the barrel. The case extractor can be seen in FIG. 31A and FIG. 31B.

18. Ejector: a gun component that ejects the case or cartridge from the gun. The ejector can be seen in FIG. 30 and FIG. 13A.

19. Case support: a bolt component that provides support to the case to ensure the case extractor remains fully engaged on the cartridge rim. The case support is shown in FIG. 31A, and FIG. 31B.

20. Barrel bushing: a gun component that supports and centers the barrel tube in the receiver while allowing it to move freely along a predetermined path. The barrel bushing can be seen in FIG. 29A.

21. Gun charger, charger: a gun component that is used to pull the bolt and barrel back in such a way as to replicate firing of the gun. The gun charger can be seen in the FIG. 29A.

22. Case guide: a component in the bolt that limits the amount of vertical cartridge movement during chambering. The case guide can be seen in the FIG. 31B and FIG. 16A.

23. Cartridge guide: a component in the barrel assembly that limits the vertical movement of the cartridge nose during chambering. The cartridge guide can be seen in the FIG. 40, FIG. 40A, and FIG. 16A.

24. Cog, ratchet cog: a feed advance component that permits the rotation of the feed drive shaft in only one direction. The ratchet cog can be seen in FIG. 39B.

25. Loading cog: a feed advance component that prevents the back rotation of the feed drive as it is being reset during bolt counter-recoil travel. The loading cog is also used to hold the linked-belt in the feed cover. The loading cog can be seen in FIG. 32B, FIG. 33B, and FIG. 34A.

26. Accessory rail: a gun component that permits the attachment of auxiliary equipment onto the gun. The accessory rail can be either part of the receiver or attached as a removable component. The bottom accessory rail and the accessory rails for the top and the sides of the automatic gun are shown in FIG. 30.

27. Hold open, bolt hold-open: a gun component that holds the bolt at the rear of the receiver and just slightly forward of the maximum bolt recoil travel position. Usually the bolt hold-open is part of the fire control system. The bolt hold-open can be seen in FIG. 39A.

28. Fire control selector: a gun component that predetermines the gun firing mode from safe-semiautomatic-automatic. Usually the fire control selector is part of the fire control system. The fire control selector can be seen in FIG. 39A and FIG. 20B.

29. Disconnector: a gun component that disconnects the trigger from firing the gun after the trigger has been pulled. Usually the disconnector is mounted on the trigger as together they are components of the fire control system. The disconnector can be seen in FIG. 19, FIG. 20A, and FIG. 39A.

30. Auto-sear: a gun component that permits the gun to fire just before gun dwell time has ended. Usually the auto-sear is part of the fire control system. The auto-sear can be seen in FIG. 20B, and FIG. 39A.

31. Pull length: a technical phrase meaning the distance from the face of the trigger to the aft surface of the shoulder stock.

32. Stow position: a technical phrase that in this embodiment describes the position of the shoulder stock when folded onto the side of the receiver to foreshorten the overall length of the automatic gun. The stow position for the folding shoulder stock can be seen in FIG. 27A.

33. Extended, deployed position: the converse of the stow position. When the folding shoulder stock is put into a stow position to then extended is to deploy the folding shoulder stock to a useable position. The extended position of the folding shoulder stock can be seen in FIG. 26A.

34. Functional group: this technical phrase means a collection of components that work together to provide a specific function or functional requirement.

35. Wet lubricants: compounds such as oil and grease along with other lubrications that are in either a fluid or paste form. Wet lubricants are contrasted to dry lubricants such as Teflon or graphite that are applied in a dry or powder form.

36. Selective fire: a automatic gun that can set to fire either automatic or semiautomatic fire.

37. Automatic: A gun that will continue to fire as long as the trigger is pulled and ammunition is available.

38. Semiautomatic: a gun that will fire only once when the trigger is pulled, requiring the trigger to be released and pulled again before the gun will fire again.

39. LMG: Light Machine Gun, used in this embodiment to mean a bi-pod fired automatic gun that usually feeds from a linked-belt of ammunition and firing from the open-bolt position.

40. MG: machine gun, used in this embodiment to mean a tripod or vehicle fired automatic gun that feeds from a linked-belt of ammunition and firing from the open-bolt position.

41. SAW: Squad Automatic Weapon, as used in this embodiment to mean a selective fired automatic gun firing from the shoulder or a bipod and feeding from a linked-belt or a box magazine and firing from the open-bolt position.

42. Assault rifle: used in this embodiment to mean a selective fired automatic gun feeding from a box or drum magazine and firing from the closed-bolt position.

43. Point-target weapon: a gun that is aimed to hit a specific point on a target.

44. Aimed fire: to aim the gun at a specific point on the target.

45. UCS: Urban Combat System. The UCS is shown in the FIG. 1.

46. Hypervelocity projectiles: in this embodiment meaning projectiles that are launched at muzzle velocities greater than 5000 feet/second.

47. Burst-fire, controlled burst-fire: in this embodiment meaning a small number of rounds fired in automatic fire, usually a burst of 3 rounds. Usually this phrase is used to describe a short burst rounds fired at the moderate cyclic rate of 600-800 SPM. Controlled burst-fire can be repeated as fast as the user can pull the trigger and the supply of ammunition permits.

48. Dwell time, dwell; the travel distance the locked barrel and bolt unit travel in recoil before they unlock from each other. Conversely it is the distance the locked barrel and bolt unit will travel in counter-recoil before the gun fires. Dwell can be seen in FIG. 10C and FIG. 18C as the stated value Y.

49. Impulse, cartridge impulse, firing impulse: in this embodiment this term shall mean the total force the fired cartridge exerts into the gun.

50. Belt pitch: the distance between two adjacent cartridges in a linked-belt. Belt pitch can be seen in FIG. 37A and FIG. 37B.

51. Cyclic rate, cyclic rate of fire, firing rate, Shots/Minute, SPM: in this embodiment these terms are interchangeable. A unit of measurement of how many rounds can be fired within one minute.

52. Serially fired: to fire one round after another in a burst. Usually this phrase is used to describe a short burst of three rounds fired at a cyclic rate greater than 1400 SPM.

53. P^h: Statistical notation for Hit Probability.

54. Bolt over-travel: the amount of bolt recoil travel beyond the distance that is needed to clear the aft face of the magazine. Bolt over-travel is shown in FIG. 13B.

55. Bi-directional rotation: to turn or rotate in both directions. The feed drive flipper does this and can be seen in FIG. 39B.

56. Directional rotation: to turn or rotate in only one direction. This is done by the feed drive shaft that can be seen in FIG. 39B.

57. Oscillatory rotation: to turn or rotate back and forth, to oscillate. The feed drive flipper and the feed ratchet both do this and can be seen in FIG. 39B.

58. Intermittent directional rotation: to intermittently rotate in one direction. This is done by the feed drive shaft shown in FIG. 39B and feed sprocket shown in FIG. 34A and FIG. 33B.

59. Ring gear: a ring gear is outer gear member of a planetary gear clusters. The ring gear is a special gear having ring gear teeth on the inside face of a ring and not gear teeth on the outside face of a disk as found on normal gears. A ring gear is a feature on the feed drive flipper and can be seen on FIG. 39B and FIG. 17A.

60. Gear teeth: the teeth of the gear or a section of gear teeth used in a intermittent planetary gear cluster. Gear teeth are used on the feed ratchet and can be seen in FIG. 17A.

61. Dual sprocket magazine, multiple sprocket magazine: as used in this embodiment they mean the same and are interchangeable. A magazine having two or more feed sprockets to transport a cartridge carrier chain within the magazine.

62. Launcher, grenade launcher, and 40 mm launcher: in this embodiment these terms are interchangeable and mean a weapon that fires a grenade cartridge. The grenade launcher can be seen in FIG. 1, FIG. 42, and FIG. 50.

63. Stovepipe: this is a ordnance special meaning for a common word to refer a style of gun jam wherein the cartridge or cartridge case is sandwiched vertically between the face of the bolt or slide and the aft face of the barrel.

DETAIL DESCRIPTION

FIG. 1 Through-FIG. 53A

FIG. 1 aft view of a grenade launcher assembly 8000 attached to a automatic gun assembly 900 loaded a with a ready box assembly 360.

FIG. 2 aft view of the grenade launcher 8000 attached to the automatic gun 900 loaded with a single sprocket magazine assembly 310.

FIG. 3 front view of the grenade launcher 8000 attached to the automatic gun 900 loaded with a dual sprocket magazine assembly 320.

FIG. 4 aft view of the automatic gun 900 being loaded with the single sprocket magazine 310. The single sprocket magazine 310 of this embodiment holds 6 cartridges.

FIG. 5 aft view of the automatic gun 900 being loaded with the dual sprocket magazine 320. The dual sprocket magazine 320 shown in this embodiment holds 20 cartridges.

FIG. 6 aft view of the automatic gun 900 being loaded with the ready box 360. A feed cover assembly 350 is attached to a ammo box 361 to make the ready box 360. The ready box 360 shown this embodiment holds the ammo box 361 containing a linked-belt assembly 370 of 50 cartridges.

FIG. 7 aft view of the grenade launcher 8000 being attached to the automatic gun 900 loaded with the dual sprocket magazine 320.

FIG. 8 aft expanded view of the automatic gun 900 showing the major assemblies. Major assemblies are: a receiver assembly 100, a bolt assembly 200, a pistol grip assembly 400, a driving spring assembly 750, and a barrel assembly 500. On the pistol grip 400 a folding shoulder stock assembly 700 is attached. Shown being attached are the dual sprocket magazine 320, the ready box 360, and the single sprocket magazine 310.

FIG. 9 sectionalized view of the automatic gun 900 locked and the fired. The automatic gun 900 has just fired a cartridge 950-0 of any length but has yet to start recoil travel. Shown in FIG. 9 are areas of coverage for FIG. 9A, FIG. 9B, and FIG. 9C.

FIG. 9A is a close-up view of the chamber and lockup region showing a barrel locking lug 5001 engaged into a bolt barrel locking recess 2065. Identified are the bolt barrel locking recess 2065, a barrel lug stopping face 5008, a case guide 207, a firing pin 220, the bolt 200, a feed ramp 1009, a feed index plunger socket 1003, a receiver barrel cam 182, a front barrel cam locking face 1821, a barrel slider lock tang 5061, a barrel spring 503, a barrel cam slider 506, a cartridge case 9504, a cartridge guide 507, a cartridge guide bias spring 507A, a barrel body 505, a charger return spring 140A, a gun charger 140, the barrel locking lug 5001, and a case extractor 208.

FIG. 9B is a close-up view of fire control region showing a auto-sear tang 4192 pushed forward by a bolt auto-sear notch 2067. Identified are a fire control selector 416, a bolt hold-open 413, a hammer 411, a fire control selector arm 4165, a hammer disconnector sear 4117, a hammer trigger sear 4115, the bolt auto-sear sear notch 2067, the auto-sear tang 4192, a auto-sear 419, a bolt hold-open trigger hole 4131, a trigger cam pin 642, a trigger assembly 415, the bolt 200, and a pistol grip body 401.

FIG. 9C is a close-up view showing how the barrel body 505 stops on a barrel stopping face 5005 when the barrel body 505 strikes a barrel bushing 110. Identified are the barrel spring 503 and a barrel bushing lock 113.

FIG. 10 sectionalized view of the automatic gun 900 showing the bolt 200 locked to the barrel 500 as a unit and having traveled in recoil approximately 18 mm. Shown in FIG. 10 are area of coverage for FIG. 10A, FIG. 10B, and FIG. 10C FIG. 10A is a close-up view of unlocking the barrel locking lug 5001 from the bolt barrel locking recess 2065. Also shown is the placement of the barrel cam slider 506 on the receiver barrel cam 182 that is part of the receiver 100.

FIG. 10B is a close-up view of the fire control region showing the auto-sear tang 4192 rotated aft after the bolt auto-sear notch 2067 has moved aft during recoil unlocking. Identified is a bolt top cover 205, a case guide spring 207A, and a firing pin return spring 220A FIG. 10C is a close-up view showing the movement of the barrel stopping face 5005 from the barrel bushing 110 to a distance of <X>. There has been NO compression of the barrel spring 503 by a barrel spring support 5002. Also shown is a bolt guide grove 2069 and how it rides on a receiver bolt guide rib 1813. Identified is a bottom accessory rail 184.

FIG. 11 sectionalized view of the automatic gun 900 showing the first recoil cycle of the barrel body 505. Shown in FIG. 11 are areas of coverage for FIG. 11A, FIG. 11B, and FIG. 11C.

FIG. 11A is a close-up view showing the barrel spring support 5002 compressing the barrel spring 503 to recoil distance of R1. The barrel body 505 and bolt 200 are shown unlocked from each other and in recoil. Shown is the barrel spring support 5002 compressing the barrel spring 503 and the case extractor 208 extracting the cartridge case 9504 from a barrel chamber 5003. Identified is a driving spring 750A.

FIG. 11B is a close-up view of fire control region showing cocking of the hammer 411 with the placement of a trigger hammer sear 4155 and the hammer trigger sear 4115. Also shown in FIG. 11B is the placement of the bolt hold-open 413 and the trigger cam pin 642.

FIG. 11C is a close-up view showing placement of the cartridge guide 507 and how it works with the case guide 207. Also shown in FIG. 11C is the first movement of a bolt barrel guide grove 2063 over the barrel-locking lug 5001.

FIG. 12 sectionalized view of the automatic gun 900 showing the bolt 200 in free recoil and ejecting the cartridge case 9504 from the receiver 100. Shown in FIG. 12 are areas of coverage for FIG. 12A and FIG. 12B FIG. 12A is a close-up view of the case extractor 208 holding the fired cartridge case 9504 as the ejector ejects the fired cartridge case 9504 from the receiver 100. Also shown is the placement of the feed advance components at this stage of the bolt 200 recoil. Identified are a bolt hold-open sear 4132, a feed drive shaft 486, a feed ratchet 480, a feed drive flipper 470, a feed ratchet gear teeth 4801, a flipper ring gear teeth 4701, and a magazine release lever 487.

FIG. 12B is a the close-up view of the barrel cam slider 506 relationship to the receiver barrel cam 182. Identified is a trunion hole 1002.

FIG. 13 sectionalized view of the automatic gun 900 showing the placement of the barrel body 505 and the bolt 200 as the bolt 200 reaches the end of its recoil cycle. Shown in FIG. 13 are areas of coverage for FIG. 13A, FIG. 13B, and FIG. 13C FIG. 13A is a close-up of the fire control and feed advance component placement at the end of the bolt 200 recoil cycle. Identified are a feed drive shaft spring 486A, a feed drive flipper pivot pin 648, a feed drive flipper pivot hole 4703, a case support 209, and a case ejector 105.

Figure 1:
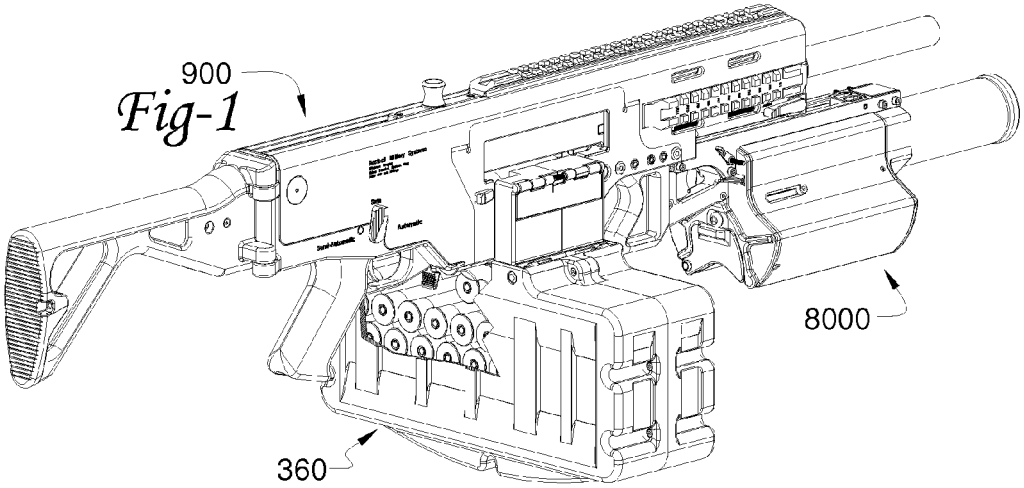
Figure 2:
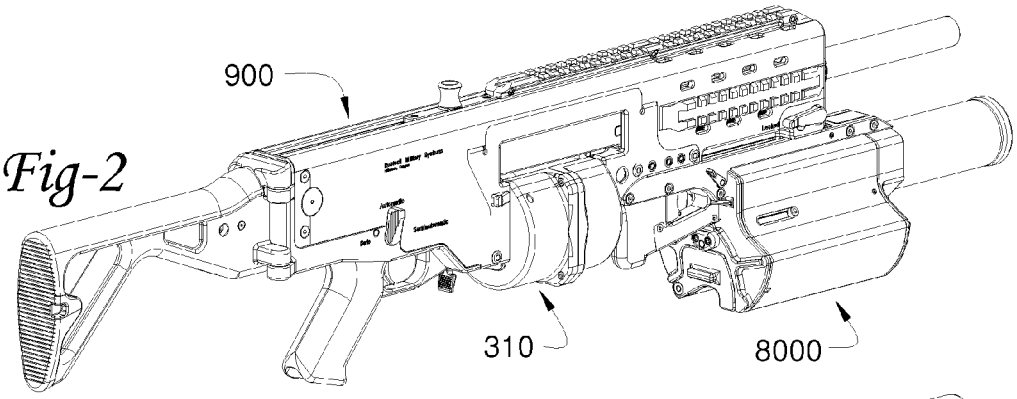
Figure 3:
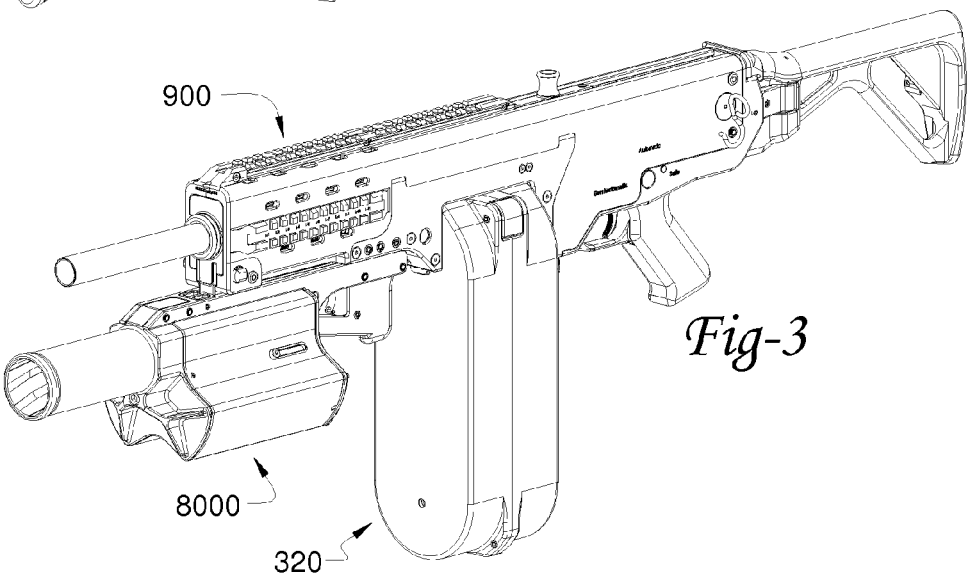

FIG. 14 sectionalized view of the automatic gun 900 showing the bolt 200 starting counter-recoil travel after bouncing off the barrel lug stopping face 5008. Shown is the maximum recoil of the barrel body 505 after being hit by the bolt 200. Shown in FIG. 14 are areas of coverage for FIG. 14A, FIG. 14B, and FIG. 14C FIG. 14A is a close-up view of the barrel body 505 and the recoil and placement of the bolt barrel stopping face 2064 relative to the barrel lug stopping face 5008.

FIG. 14B is a close-up view of the barrel spring support 5002 after compression of the barrel spring 503 to a recoil distance of <R2>. Identified is a barrel spring guide 504.

FIG. 15 sectionalized view of the automatic gun 900 showing the bolt 200 at the start of counter-recoil travel with the barrel body 505 shown at rest after the second barrel body 505 recoil cycle. A bolt ram face 2068 is ready to ram the fresh cartridge 950-0 from the single sprocket magazine 310. Shown in FIG. 15 are areas of coverage for FIG. 15A, FIG. 15B, and FIG. 15C FIG. 15A is a close-up view of the bolt ram face 2068 ready to ram a cartridge rim 9501. Shown and ready for use as cartridge guides is the case support 209, and the case extractor 208. Identified is the ejector 105.

Figure 15A:
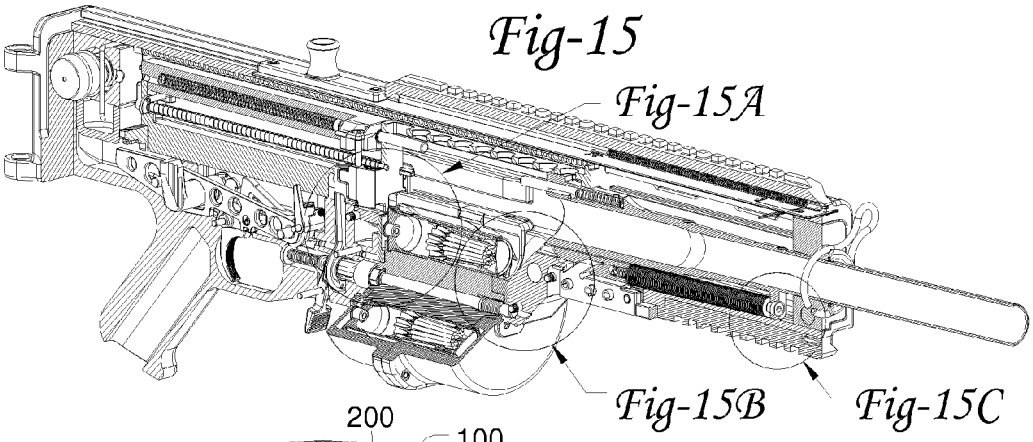
Figure 15A:
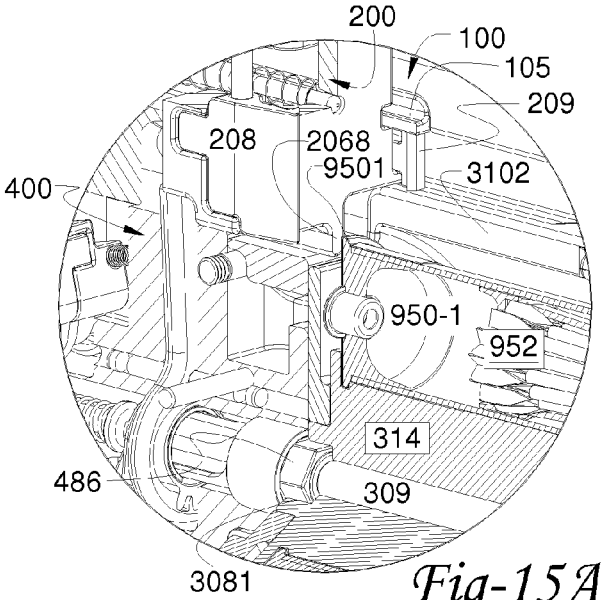
Figure 15C:
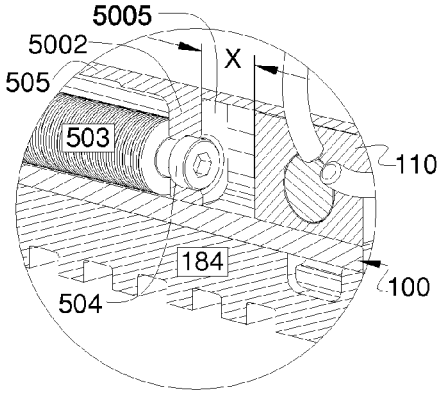
Figure 15B:
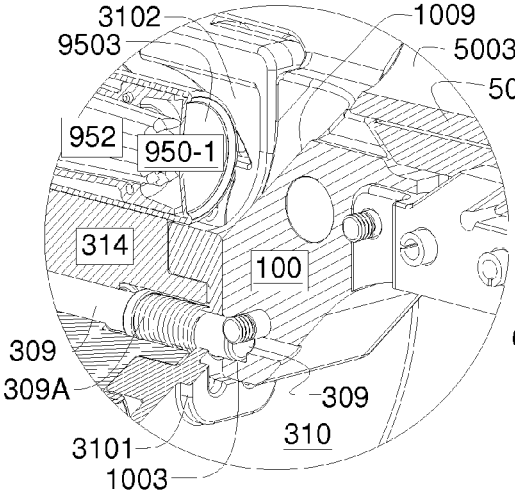

FIG. 15B is a close-up view of a 3½-inch shotshell 950-1 in the single sprocket magazine 310 ready to be rammed forward within a feed tray 3102 and up the feed ramp 1009. Identified are a cartridge nose 9503, a set of magazine lips 3101, and a feed index plunger 309.

FIG. 15C is a close-up view showing that the barrel spring support 5002 recoil into the barrel spring 503 is zero while the barrel 500 recoil within the receiver 100 is at a value <X>.

FIG. 16 sectionalized view of the automatic gun 900 with the bolt 200 ramming the fresh 3½-inch shotshell 950-1 up the feed ramp 1009 from the single sprocket magazine 310 and into the barrel chamber 5003. Shown in FIG. 16 are areas of coverage for FIG. 16A and FIG. 16B.

FIG. 16A is a close-up view of ramming the fresh 3½-inch shotshell 950-1 up the feed ramp 1009 from the single sprocket magazine 310. Identified are a feed sprocket wheel 314, and a flechette cluster 952.

FIG. 16B is a close-up view of the cartridge nose 9503 entering the barrel chamber 5003.

FIG. 17 sectionalized view of the automatic gun 900 showing the bolt 200 at the start of locking to the barrel 500. Shown in FIG. 17 are areas of coverage for FIG. 17A, FIG. 17B, and FIG. 17C.

FIG. 17A is a close-up view of the bolt auto-sear notch 2067 striking the auto-sear tang 4192.

FIG. 17B is a close-up view of the barrel-locking lug 5001 in alignment with the bolt barrel locking recess 2065. Shown are the cartridge guide 507 and the case guide 207 fully retracted.

FIG. 17C is a close-up view showing the barrel body 505 recoil at <X> and the barrel spring 503 compression by the barrel spring support 5002 at zero.

FIG. 18 sectionalized view of the automatic gun 900 at the start of dwell. Shown with the barrel-locking lug 5001 locked into the bolt barrel locking recess 2065 to finish lockup. Also shown is the bolt 200 striking the auto-sear 419 forward to fire the automatic gun 900. Shown in FIG. 18 are areas of coverage for FIG. 18A, FIG. 18B, and FIG. 18C FIG. 18A is a close-up view of the bolt auto-sear notch 2067 striking the auto-sear tang 4192.

FIG. 18B is a close-up view of the barrel-locking lug 5001 fully seated into the bolt barrel locking recess 2065. This view shows the start of dwell travel. Shows the compressed case guide 207 and the cartridge guide 507.

FIG. 18C is a close-up view of the barrel 500 at the start of dwell with a potential travel distance of <Y>.

Figure 19:
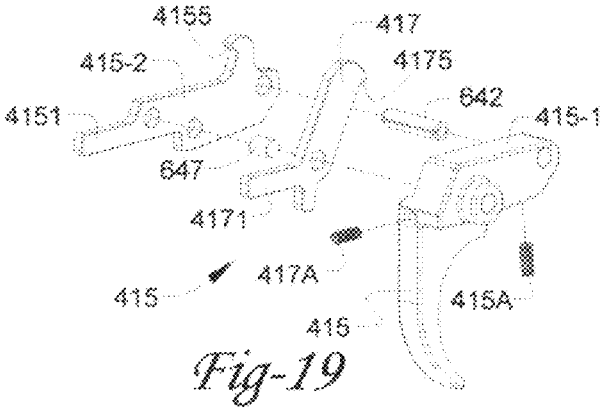

FIG. 19 expanded view of the trigger assembly 415 comprising a trigger body 415-1 with a trigger spring 415A, a trigger sear plate 415-2 held onto the trigger body 415-1 by the trigger cam pin 642. Upon the trigger body 415-1 a disconnector 417 with a disconnector spring 417A is installed on a disconnector pivot pin 647. Identified are the trigger tang 4151, the disconnector tang 4171, a disconnector hammer sear 4175, and the trigger hammer sear 4155.

Figure 20A:
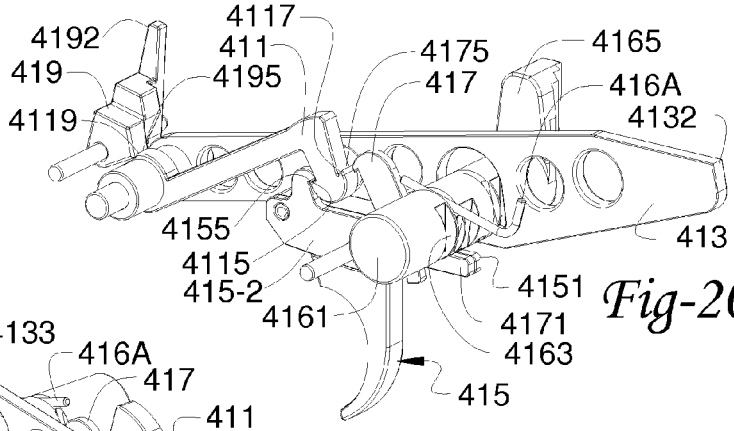

FIG. 20A left side view of the fire control components positioned for automatic fire mode before the trigger 415 is pulled. Identified are the auto-sear 419, the auto-sear tang 4192, a auto-sear hammer sear 4195, the bolt hold-open 413, the bolt hold-open sear 4132, the hammer 411, a hammer auto-sear notch 4119, the hammer disconnector sear 4117, the hammer trigger sear 4115, the trigger 415, the trigger sear plate 415-2, a trigger tang 4151, the trigger hammer sear 4155, the disconnector 417, the disconnector hammer sear 4175, a disconnector tang 4171, a fire control selector body 4161, the fire control selector arm 4165, a set of fire control selector slots 4163, and a fire control selector detent 416A.

Figure 20B:
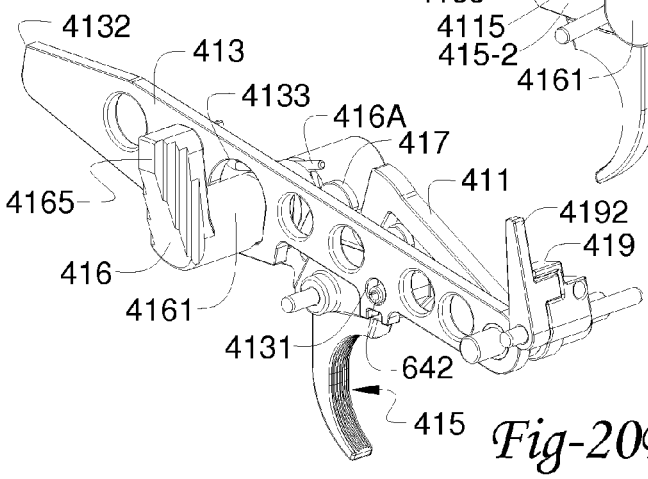

FIG. 20B right side view of the fire control components positioned for automatic fire mode before the trigger 415 is pulled. Identified but not covered in FIG. 20A are the bolt hold-open trigger hole 4131, and a bolt hold-open fire control slot 4133.

Figure 21A:
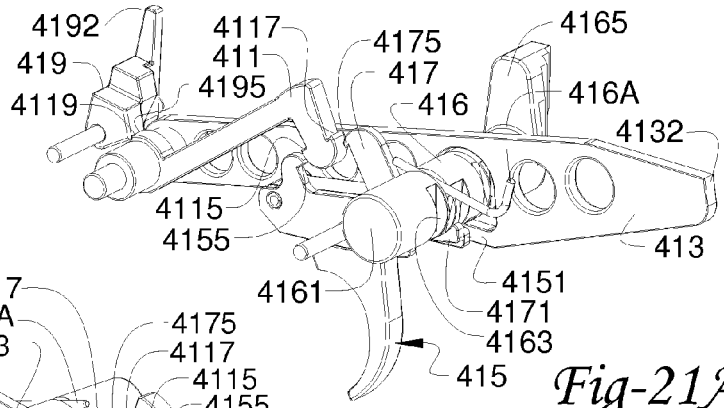

FIG. 21A left side view of the fire control components positioned for automatic fire mode but after the trigger 415 has been pulled. The hammer 411 is cocked with both the trigger 415 and the bolt hold-open 413 are depressed. Only the auto-sear 419 holds the hammer 411 cocked. Components and component features are identified in FIG. 20A and FIG. 20B.

Figure 21B:
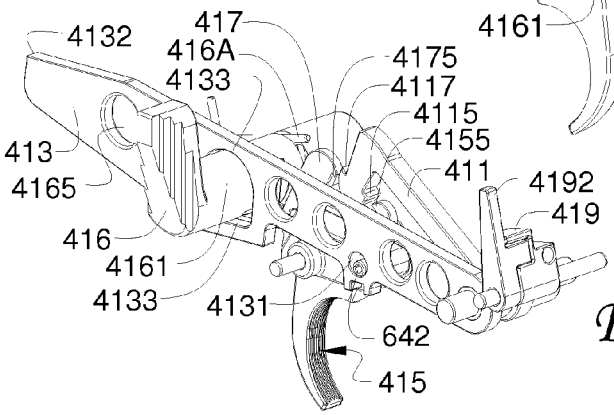

FIG. 21B right side view of the fire control components positioned for automatic fire mode but after the trigger 415 has been pulled. The hammer 411 is cocked with both the trigger 415, and the bolt-hold-open 413 depressed. Only the auto-sear 419 holds the hammer 411 cocked. Components and component features are identified in FIG. 20A and FIG. 20B.

FIG. 22A left side view of the fire control components positioned for automatic fire mode after the hammer 411 has fallen. The auto-sear tang 4192 is pushed forward rotating the auto-sear 419 to off. Components and component features are identified in FIG. 20A and FIG. 20B.

FIG. 22B right side view of the fire control components positioned for automatic fire mode after the hammer 411 has fallen. The trigger 415 is pulled aft and the trigger cam pin 642 holds the bolt hold-open 413 down. The auto-sear tang 4192 is pushed forward rotating the auto-sear 419 to off. Components and component features are identified in FIG. 20A and FIG. 20B.

FIG. 23A left side view of the fire control components positioned for semiautomatic fire mode after the trigger 415 has been pulled. The fire control selector arm 4165 is pointed forward with the hammer 411 cocked and held by the disconnector sear 4175. Both the trigger 415, and the bolt hold-open 413 are held depressed. The auto-sear 419 has been rotated forward to off. Components and component features are identified in FIG. 20A and FIG. 20B.

FIG. 23B right side view of the fire control components positioned for semiautomatic fire mode after the trigger 415 has been pulled. The fire control selector arm 4165 is pointed forward with the hammer 411 cocked and held by the disconnector 417. Both the trigger 415, and the bolt hold-open 413 are held depressed. The auto-sear 419 has been rotated forward to off. Components and component features are identified in FIG. 20A and FIG. 20B.

Figure 24A:
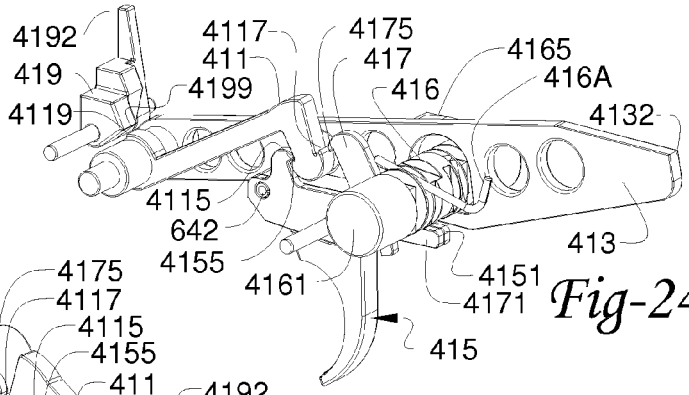

FIG. 24A left side view of the fire control positioned for semiautomatic fire mode after the trigger 415 has been released. The disconnector hammer sear 4175 is now off the hammer disconnector sear 4117. The trigger hammer sear is on the hammer trigger sear 4115, and holding the hammer 411 cocked. The bolt hold-open 413 is free to move up. The bolt auto-sear notch 2067 holds the auto-sear 419 forward to the off position. Components and component features are identified in FIG. 20A and FIG. 20B.

Figure 24B:
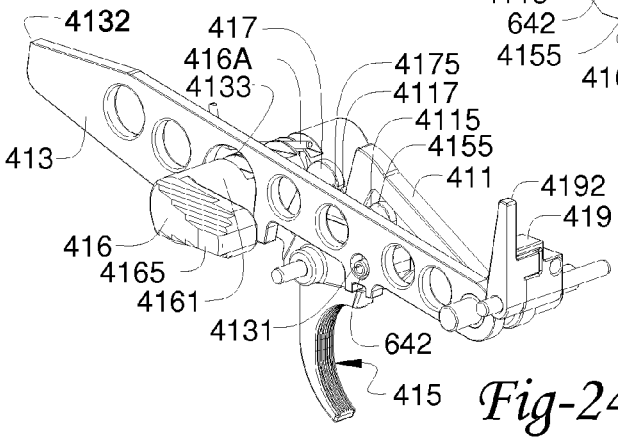

FIG. 24B right side view of the fire control positioned for semiautomatic fire mode after the trigger 415 has been released. The disconnector hammer sear 4175 is now off the hammer disconnector sear 4117. The trigger hammer sear 4155 is on the hammer trigger sear 4115 and holding the hammer 411 cocked. The bolt hold-open 413 is free to move up. The bolt auto-sear notch 2067 holds the auto-sear 419 forward to the off position. Components and component features are identified in FIG. 20A and FIG. 20B.

Figure 25A:
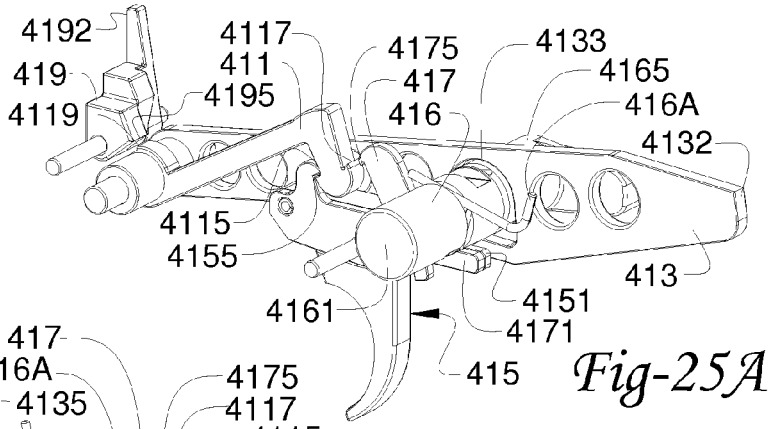

FIG. 25A left side view of the fire control components positioned for safe. The trigger 415 is forward and blocked from movement by the fire control selector body 4161. The bolt hold-open 413 is held depressed by the fire control selector body 4161 and blocked from movement. The bolt 200 is forward in the closed-bolt position. The auto-sear tang 4192 has been rotated forward to off position. Components and component features are identified in FIG. 20A and FIG. 20B.

Figure 25B:
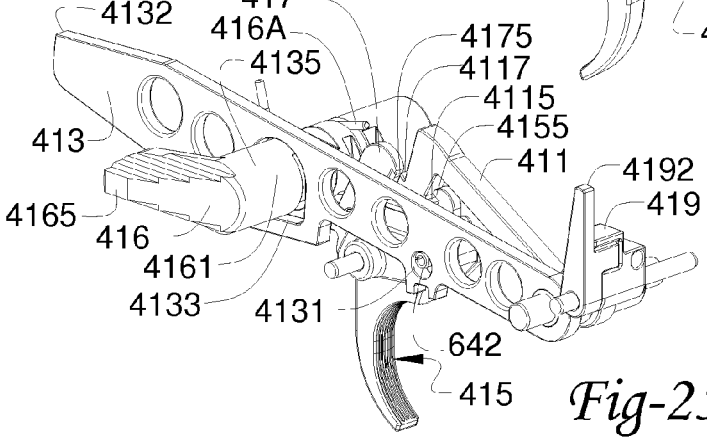

FIG. 25B right side view of the fire control components positioned for safe. The trigger 415 is forward and blocked from movement by the fire control selector body 4161. The bolt hold-open 413 is held depressed by the fire control selector body 4161 and blocked from movement. The bolt 200 is forward in the closed-bolt position. The auto-sear tang 4192 has been rotated forward to off position. Components and component features are identified in FIG. 20A and FIG. 20B.

Figure 26:
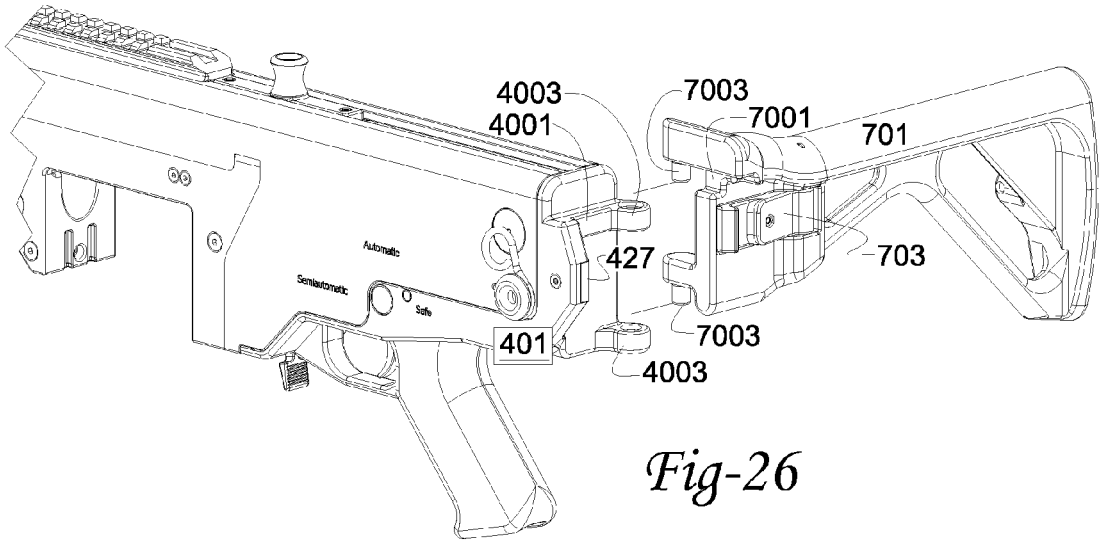

FIG. 26 shows the installation of the folding shoulder stock 700 onto the pistol grip 400. Identified are a set of folding shoulder stock pivot studs 7003, a folding shoulder stock locking key grove 7001, a folding shoulder stock latch plate 427, a pistol grip folding shoulder stock locking key 4001, and a set of pistol grip folding shoulder stock hinges 4003.

Figure 26A:
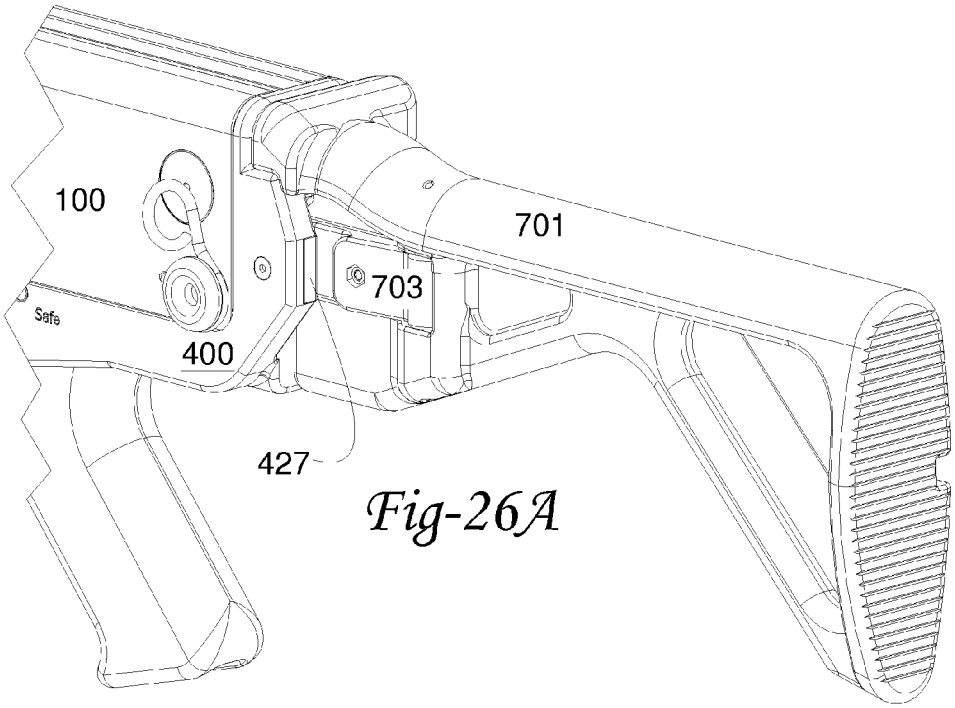

FIG. 26A shows the folding shoulder stock 700 after installation and shown in the extended position. Identified are a folding shoulder stock latch 703, a folding shoulder stock body 701, the receiver 100, and the folding shoulder stock latch plate 427.

Figure 27:
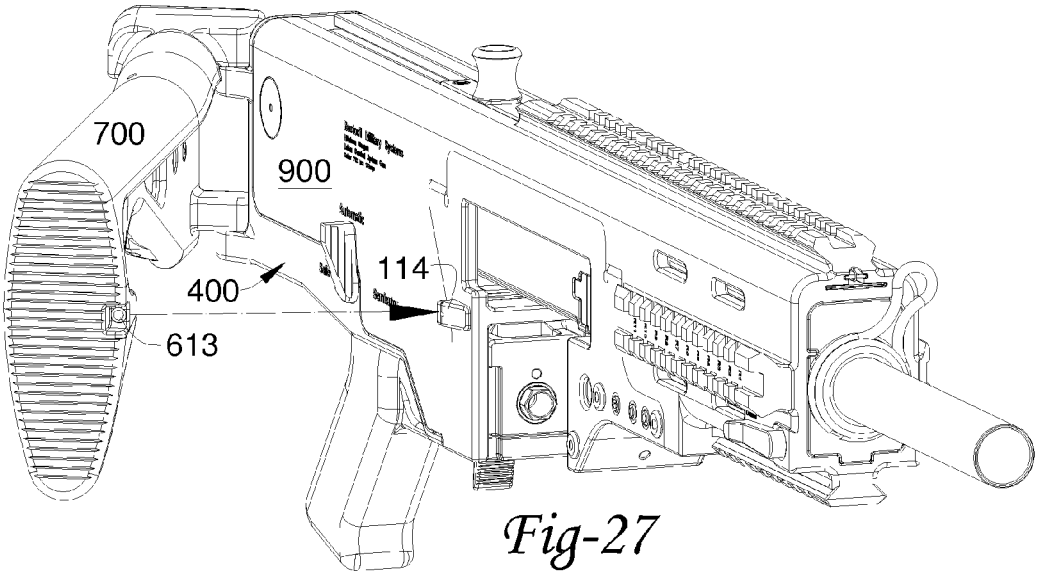

FIG. 27 a front view showing the latching of the folding shoulder stock 700 onto a folding shoulder stock stow stud 114. Identified are a folding shoulder stock stow ball detent 613, and the folding shoulder stock stow stud 114.

Figure 27A:
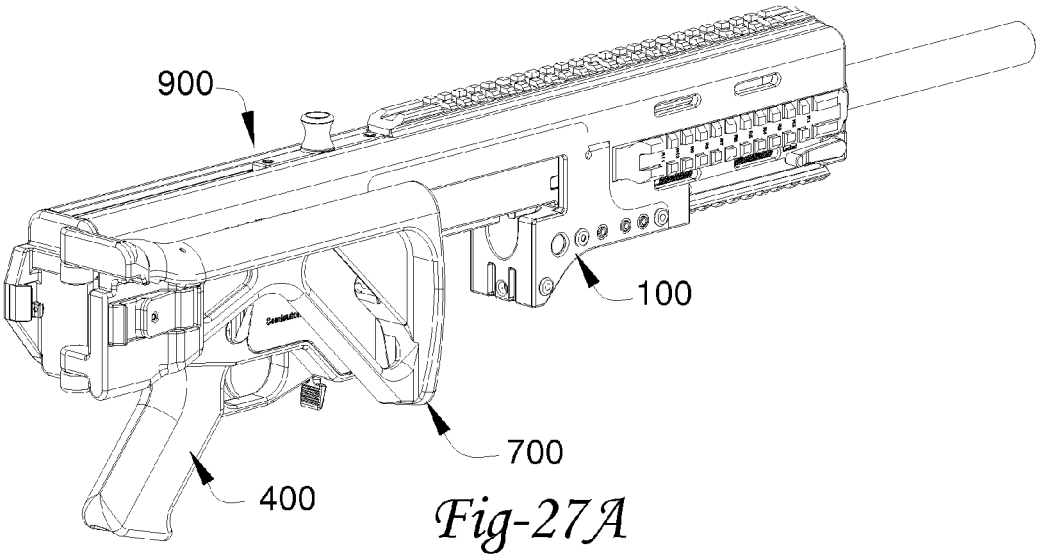

FIG. 27A aft view of the automatic gun 900 with the folding shoulder stock 700 in the stow position. Identified are the pistol grip 400 and the receiver 100

Figure 28:
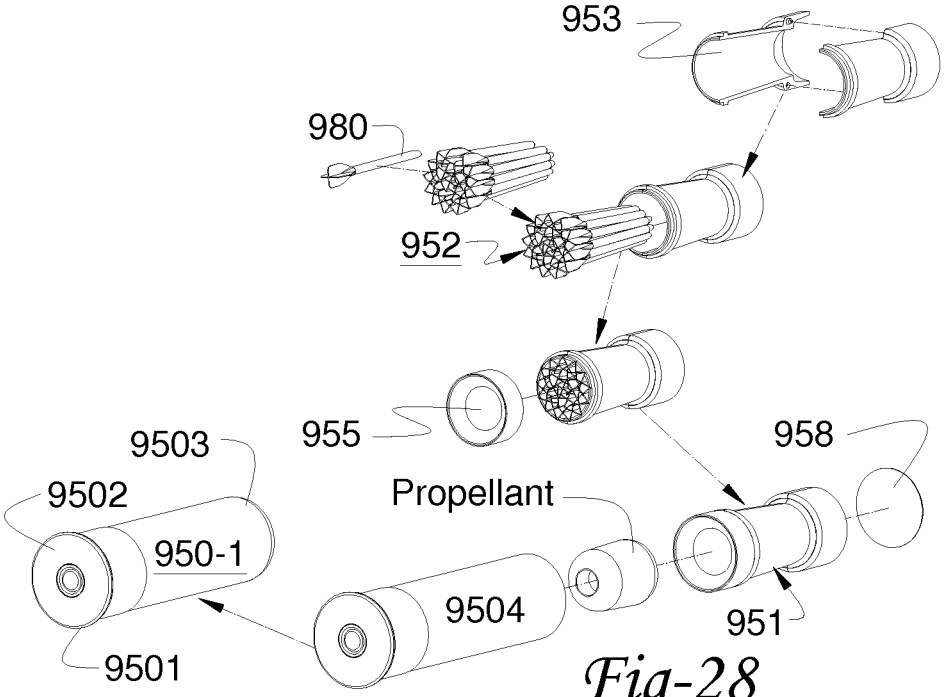

FIG. 28 expanded view of the flechette loaded 3½-inch shotshell 950-1. Shown is a sabot assembly 951 as loaded into the cartridge case 9504. The sabot 951 holds a flechette cluster 952 made up of a plurality of the flechettes 980. The sabot 951 comprises the flechette cluster 952 held between a sabot clamshells sides 953 held together by a sabot base 955. The cartridge case 9504 is loaded with both a charge of propellant and the assembled sabot 951. A cover disk 958 is then inserted to sear the cartridge case 9504 and finish the 3½-inch shotshell 950-1 loading. Identified are the cartridge rim 9501, a cartridge head 9502, and the cartridge nose 9503.

Figure 28A:
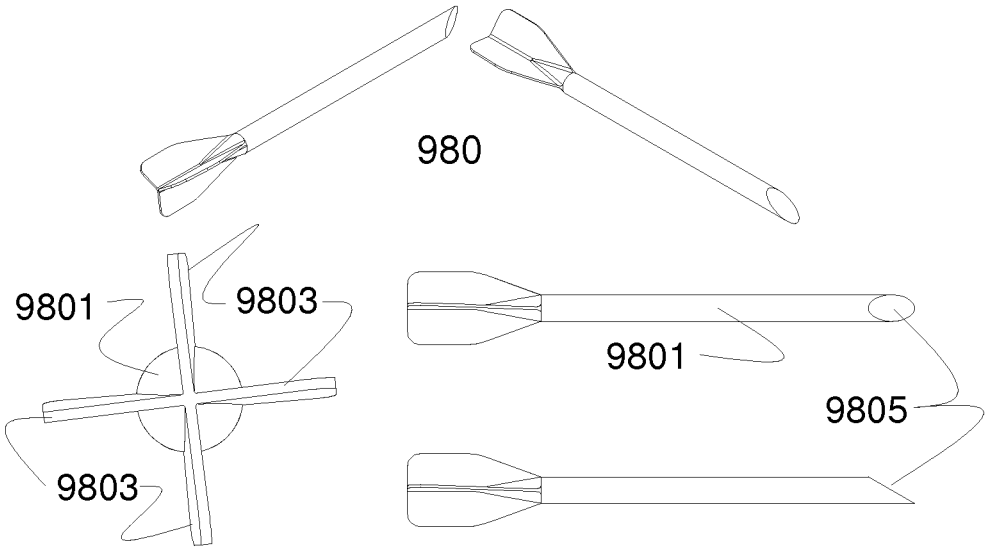

FIG. 28A various views showing the major features of the flechette 980. The flechette 980 comprises a plurality of flechette tail fins 9803, a flechette chisel point nose 9805, and a flechette body 9801.

Figure 29:
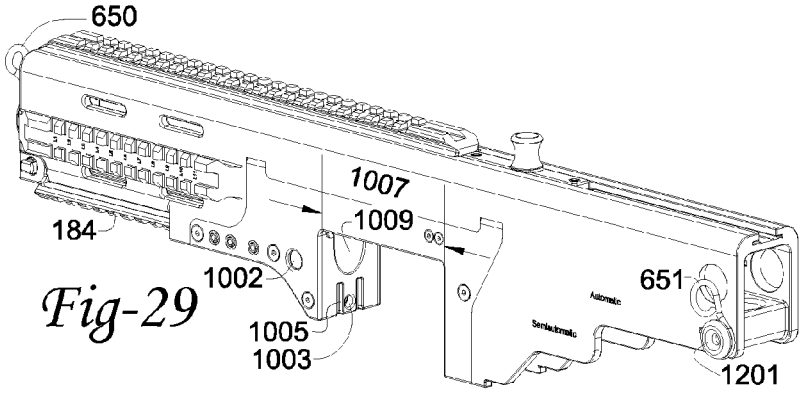

FIG. 29 aft side view of the receiver 100 assembled. Identified are the trunion hole 1002, the feed index plunger socket 1003, a set of magazine lip slots 1005, a magazine well zone 1007, the bottom accessory rail 184, a front sling swivel 650, a aft sling swivel 651, and the feed ramp 1009.

Figure 29A:
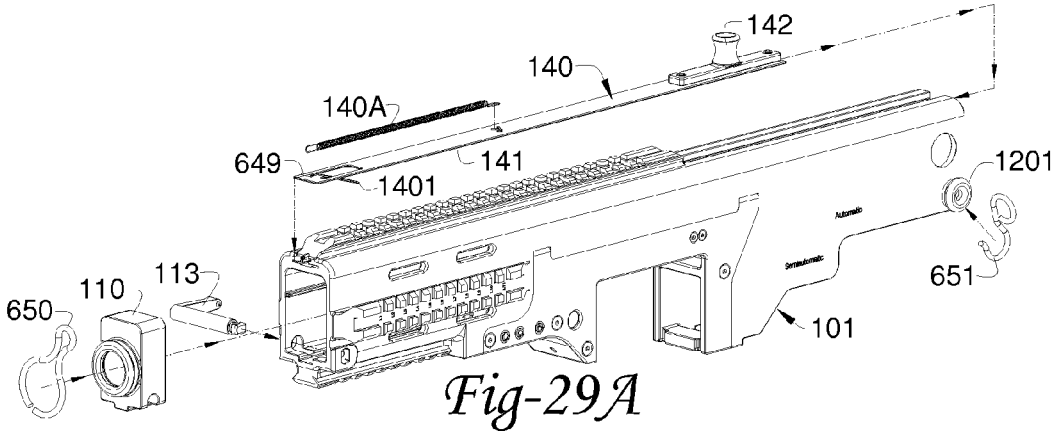

FIG. 29A is a expanded front view of the receiver 100 comprising a receiver body assembly 101 and comprising the gun charger 140. The gun charger return spring 140A is installed and held in the preloaded position within the receiver body 101 by a charger spring retaining pin 649. The barrel bushing 110 is installed into the front of the receiver body 101 and held in place by the barrel bushing lock 113. Over the front of the barrel bushing 110 is attached the front sling swivel 650. Onto a aft sling swivel stud 1201 is attached the aft sling swivel 651.

Figure 30:
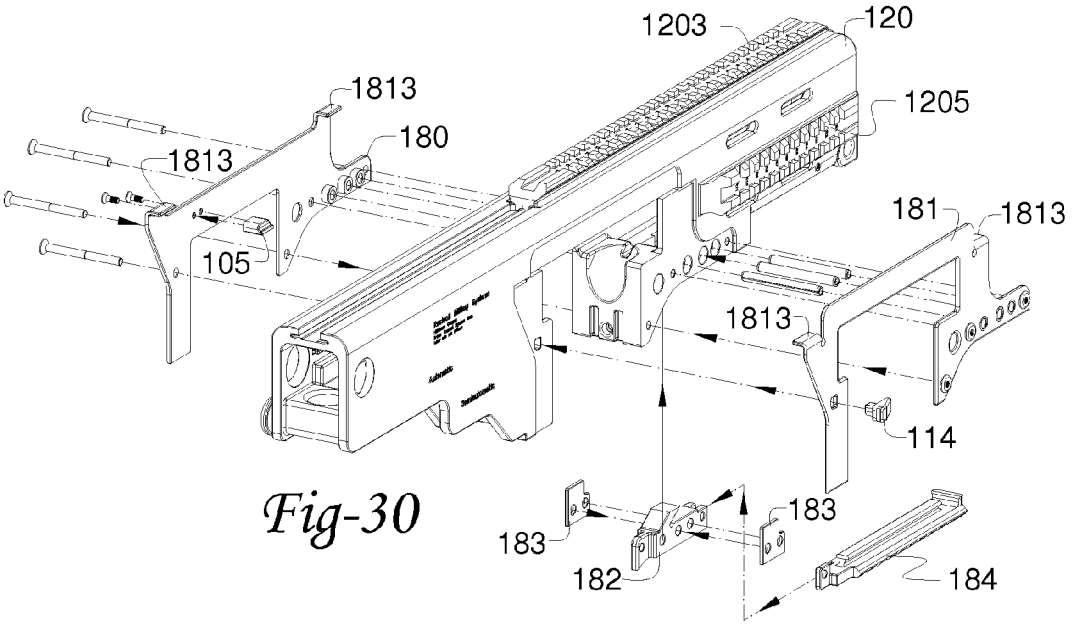

FIG. 30 is a expanded aft view of the receiver body 101 comprising a receiver housing 120, the receiver barrel cam 182, and a set two barrel guide plates 183. Into the left side of the receiver housing 120, a receiver left side plate 180 is attached. The receiver left side plate 180 holds the case ejector 105. Into the right side of the receiver housing 120 a receiver right side plate 181 is attached. The receiver right side plate 181 holds the folding shoulder stock stow stud 114. Into the bottom front of the receiver housing 120 the bottom accessory rail 184 is attached. Identified are a top accessory rail 1203, a side accessory rail 1205, and the receiver bolt guide rib 1813.

Figure 31A:
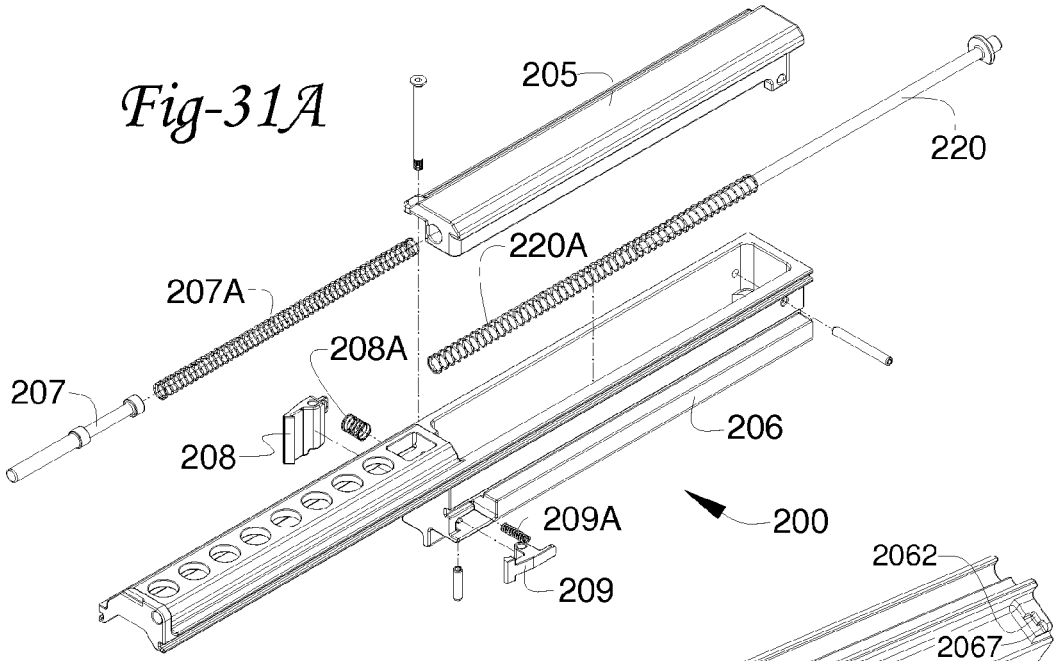

FIG. 31A is a expanded top down view of the bolt 200 comprising a bolt body 206, and the top bolt cover 205. Into the top bolt cover 205 is installed the case guide 207, and the case guide spring 207A. Into the bolt body 206 is installed the firing pin 220, and the firing pin return spring 220A. On the side of the bolt body 206 are attached the case extractor 208, and a case extractor spring 208A along with the case support 209, and a case support spring 209A.

Figure 31B:
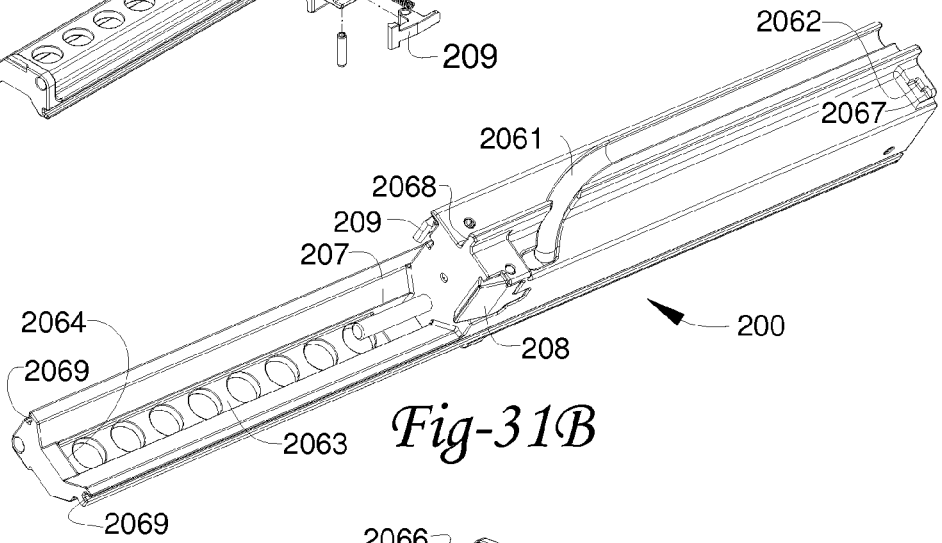

FIG. 31B is a bottom up view of the bolt 200 showing a feed cam path 2061, the bolt barrel guide grove 2063, the bolt auto-sear sear notch 2067, a bolt hold-open sear tang 2062, the bolt barrel stopping face 2064, the bolt guide grove 2069, bolt ram face 2068, and the case guide 207 that is shown in the extended position.

Figure 31C:
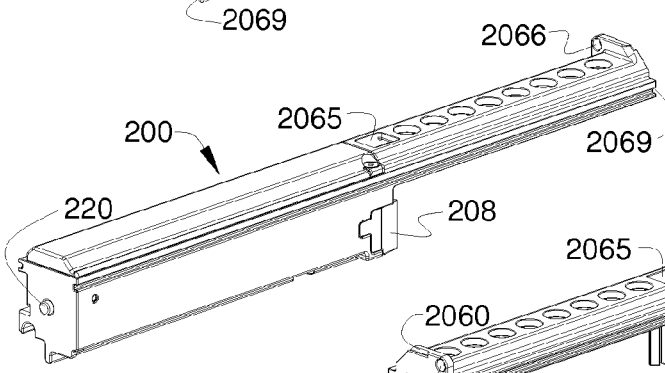

FIG. 31C is a aft view of the bolt 200. Identified are the bolt barrel locking recess 2065, a driving spring support 2066, the firing pin 220, the case extractor 208, and the bolt guide grove 2069.

Figure 31D:
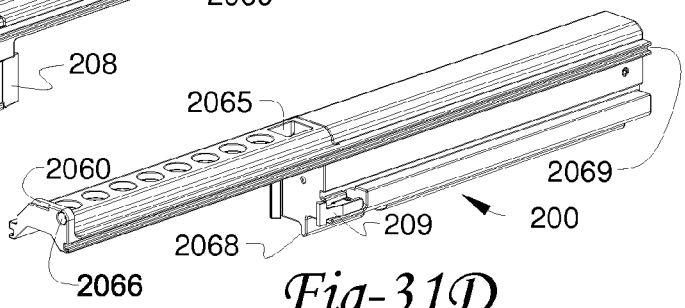

FIG. 31D is a front view of the bolt 200. Identified and not covered in FIG. 31C are a charger notch 2060, the case support 209, and the bolt ram face 2068.

Figure 32A:
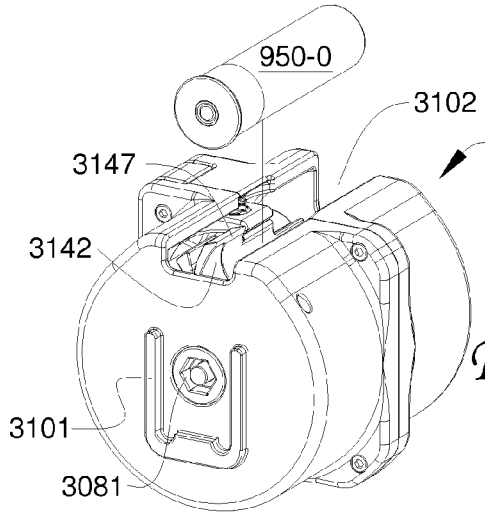

FIG. 32A is a aft view of the single sprocket magazine 310 being loaded with the cartridge 950-0. Identified is the feed tray 3102, a cartridge pocket 3142, the plurality of magazine lips 3101, and a set of cartridge retention clamps 3147.

Figure 32B:
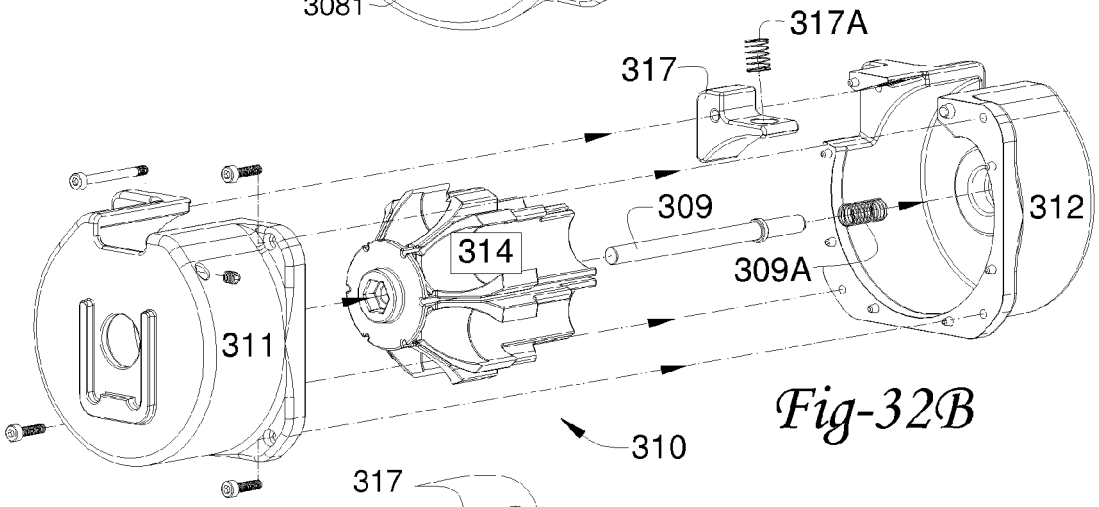

FIG. 32B is a aft expanded view of the single sprocket magazine 310 comprising a single sprocket aft housing 311, a single sprocket front housing 312, and 6 position the feed sprocket wheel 314. Into the top left side of the single sprocket front housing 312 is installed a loading cog 317 with a loading cog spring 317A. Installed within the feed sprocket wheel 314 are the feed index plunger 309 and a feed index plunger spring 309A.

Figure 32C:
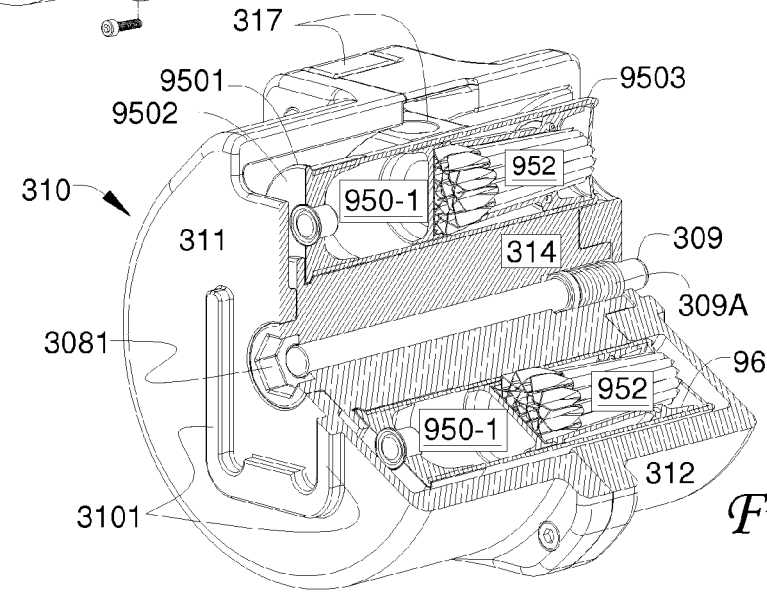

FIG. 32C is a aft sectionalized view of the single sprocket magazine 310 showing the relative placement of the internal components and features. Identified are the loading cog 317, the cartridge 950-0, the cartridge rim 9501, the cartridge head 9502, the cartridge nose 9503, the single sprocket aft housing 311, the single sprocket front housing 312, a hex drive socket 3081, the magazine lips 3101, the flechette 980, the sabot clam shell sides 953, the feed index plunger 309, the feed index plunger spring 309A, and the feed sprocket wheel 314.

Figure 32D:
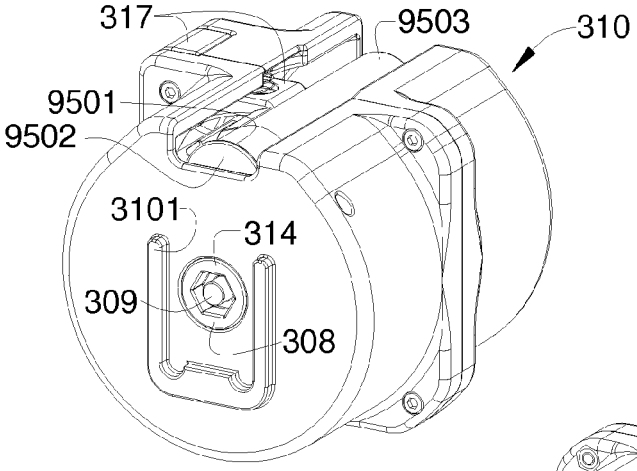

FIG. 32D is a aft view of the single sprocket magazine 310 showing the magazine lips 3101, the hex drive socket 3081, the feed index plunger 309, the cartridge rim 9501, the cartridge head 9502, the cartridge nose 9503, the feed sprocket wheel 314, and the loading cog 317.

Figure 32E:
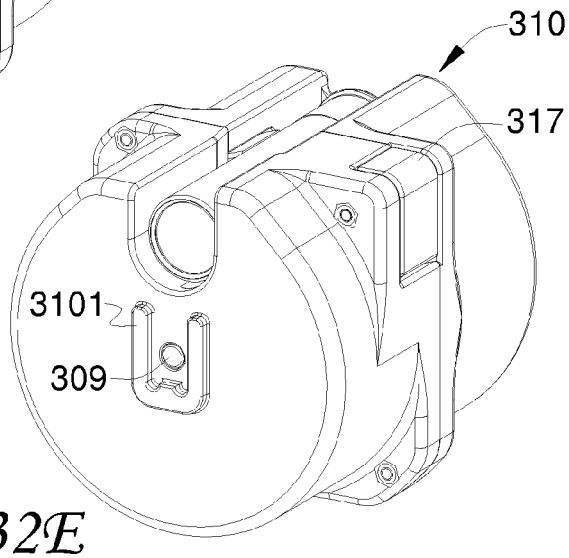

FIG. 32E is a front view of the single sprocket magazine 310 showing the magazine lips 3101, the feed index plunger 309, and the loading cog 317.

Figure 32F:
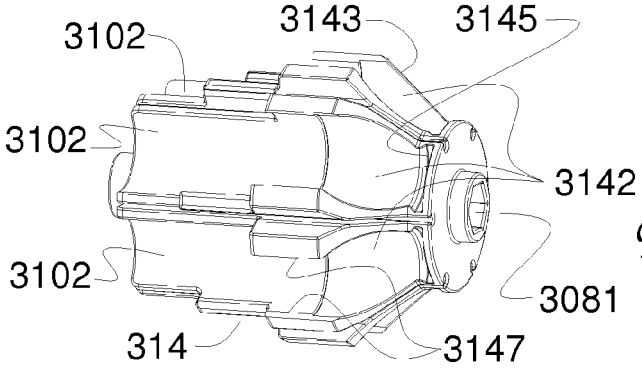

FIG. 32F is a close-up view of the feed sprocket wheel 314. Identified are major features such as the hex drive socket 3081, the plurality of feed trays 3102, a plurality of rim feed ramps 3143, a plurality of cartridge retainers 3145, the plurality of cartridge pockets 3142, and the plurality of cartridge retention clamps 3147.

Figure 33A:
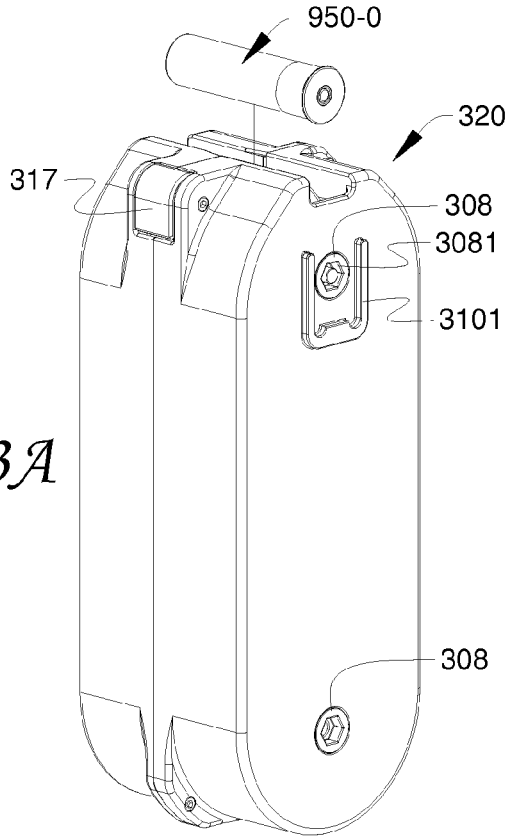

FIG. 33A is a aft view of the dual sprocket magazine 320 being loaded with the cartridge 950-0. Identified are the dual sprocket magazine 320, the magazine lips 3101, the hex drive socket 3081, and the loading cog 317.

Figure 33B:
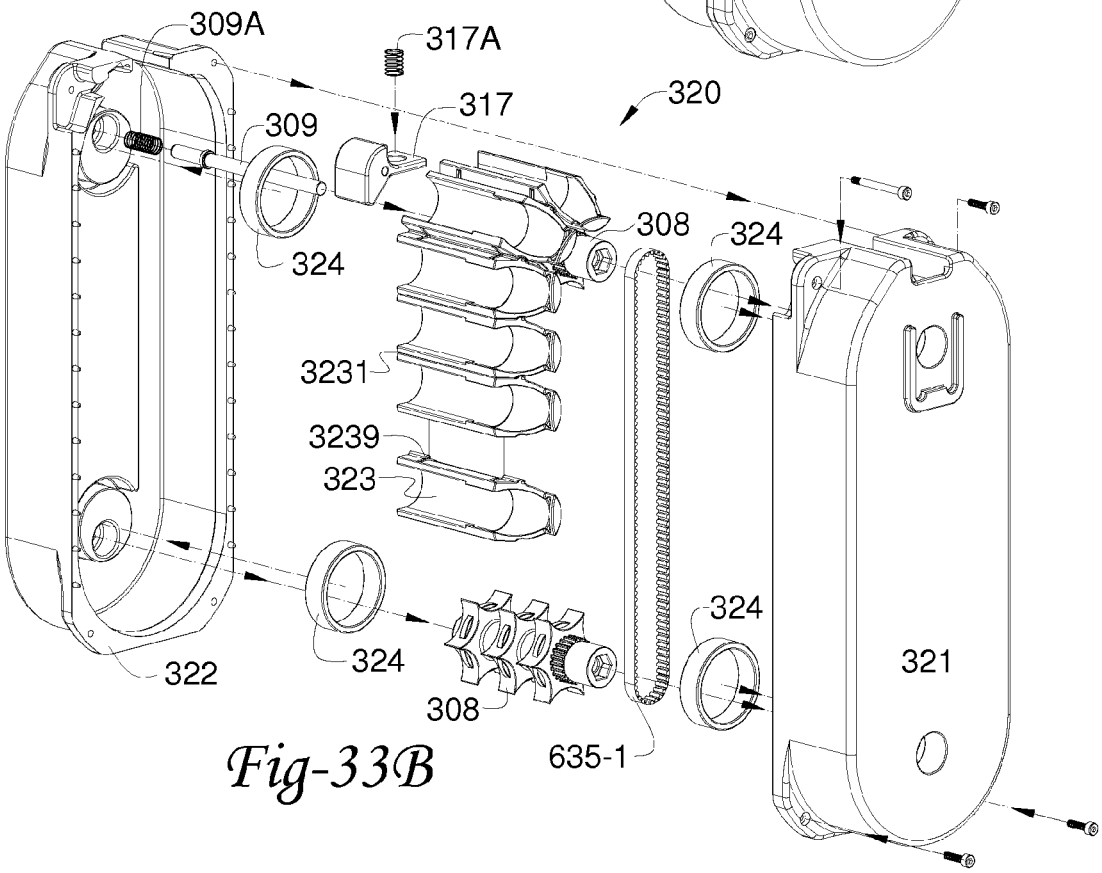

FIG. 33B is a expanded aft view of the dual sprocket magazine 320 comprising a dual sprocket aft housing 321, a dual sprocket front housing 322, a feed sprocket 308, and plurality of a cartridge carrier 323 to transport the cartridge 950-0. FIG. 33B shows the 20 cartridge carriers 323 interconnected with a hinge pin 3239 to make a cartridge carrier chain 3231. A set of carrier chain rollers 324 is installed around the top and bottom of the feed sprockets 308. A Timing belt 635-1 is used to time and transfer power between the top and bottom feed sprockets 308. Within the top feed sprocket 308 is the installed the feed index plunger 309 with the feed index plunger spring 309A. On the top left side of the dual sprocket front housing 322 is installed the loading cog 317 with the loading cog spring 317A.

Figure 33C:
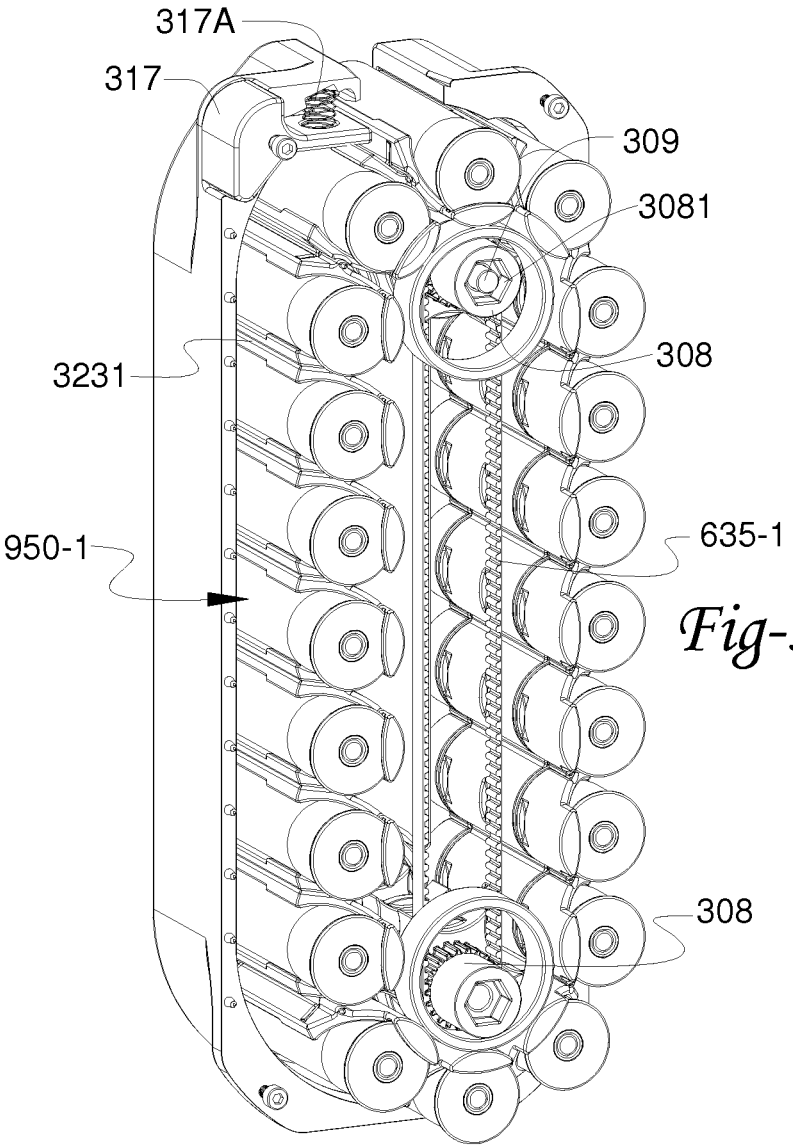

FIG. 33C is a aft view of the dual sprocket magazine 320 but with the aft magazine housing 321 removed to show the relative placement of the internal components. Identified but not covered in FIG. 33A or FIG. 33B is the hex drive socket 3081.

Figure 33D:
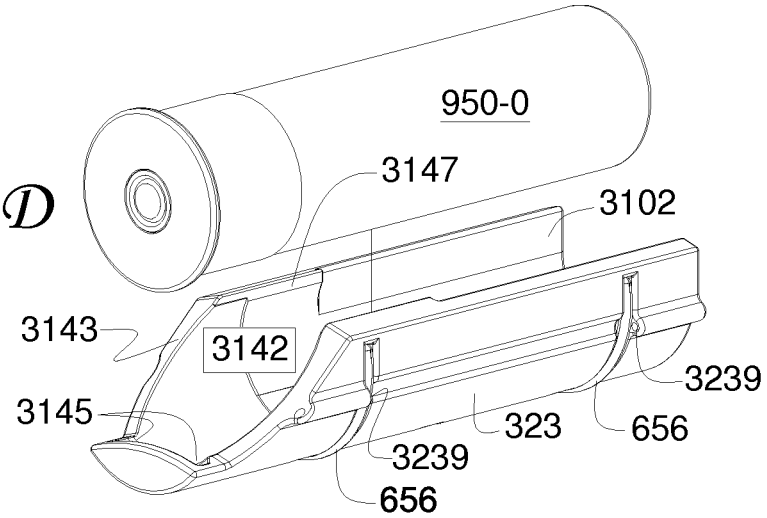

FIG. 33D shows the expanded view of the cartridge 950-0 being loaded into the cartridge carrier 323. Identified are the cartridge 950-0, the rim feed ramp 3143, the cartridge retainer 3145, the cartridge retention clamps 3147, the feed tray 3102, the cartridge pocket 3142, and a stiffing spring clip 656, and the hinge pin 3239.

Figure 34A:
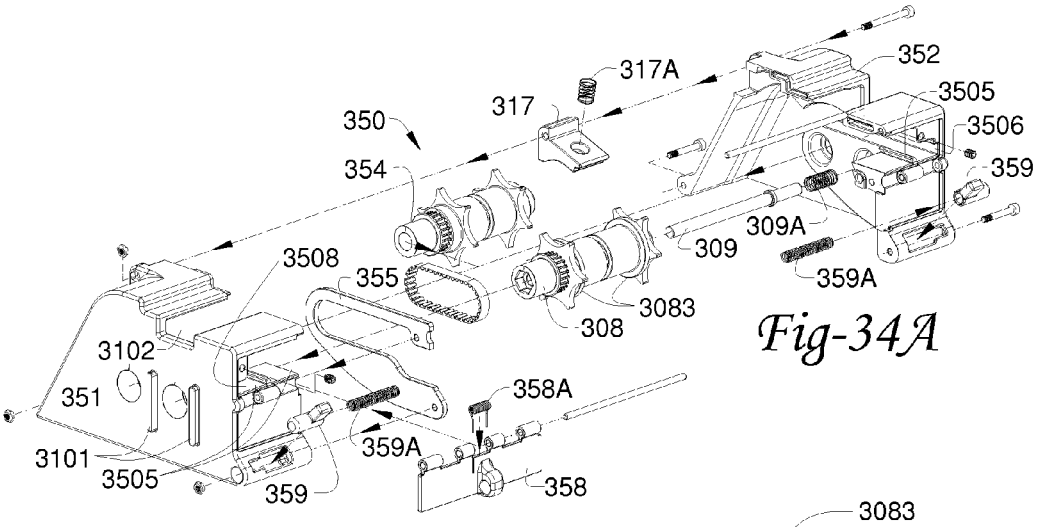

FIG. 34A is a expanded aft view of the feed cover 350 comprising a feed cover aft housing 351, and a feed cover front housing 352 into which a secondary link-belt sprocket 354 and the feed sprocket 308 are installed. Sandwiched between the housings is installed a center guide rib 355. Into the center top left side of the feed cover front housing 352 is installed the loading cog 317 with the loading cog spring 317A. On the outside of the feed sprocket 308 is located a sprocket link thrust rib 3083. Into the feed sprocket 308, index plunger 309 with the feed index plunger spring 309A installed. On the outside of the feed cover front housing 352 are installed a set of ammo box latches 359 with a set of ammo box latch springs 359A. A link eject cover 358 with a link eject cover spring 358A is installed on the right side of the feed cover front housing 352. Identified are a link thrust rib 3505 in the feed cover aft housing 351 and the feed cover front housing 352, a front link guide path 3506 in the feed cover front housing 352. and a aft link guide path 3508 in the feed cover aft housing 351.

Figure 34B:
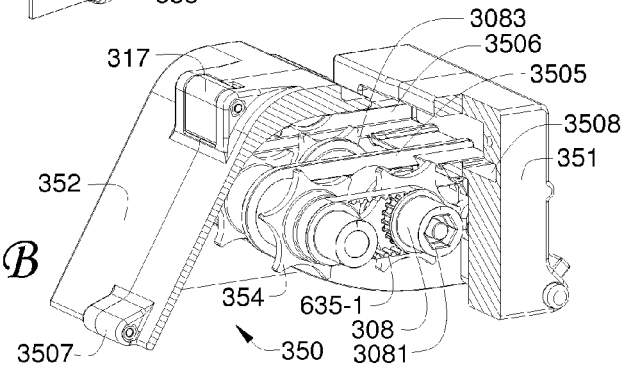

FIG. 34B is a aft sectionalized view of the feed cover 350 showing the relative placement of the internal components. The link eject cover 358 has been removed for clarity. Identified are the hex drive socket 3081, the sprocket link thrust rib 3083, a ammo box lug 3507, the secondary link-belt sprocket 354, the feed cover front housing 352, the feed cover aft housing 351, the link thrust rib 3505, the front link guide path 3506, and the aft link guide path 3508.

Figure 34C:
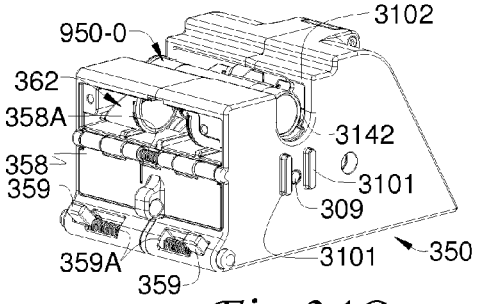

FIG. 34C is a front view of the feed cover 350. Identified are the cartridge 950-0, the feed tray 3102, the set of ammo box latch 359, the ammo box latch spring 359A, the magazine lips 3101, the feed index plunger 309, the cartridge pocket 3142, the link eject cover 358, and the link eject cover spring 358A.

Figure 34D:
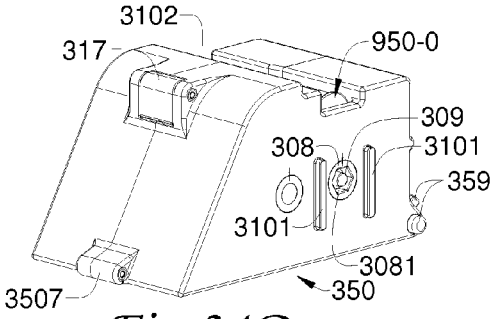

FIG. 34D is a aft view of the feed cover 350. Reference numbers not covered in FIG. 34C are the ammo box lug 3507, the loading cog 317, and the hex drive socket 3081.

Figure 35:
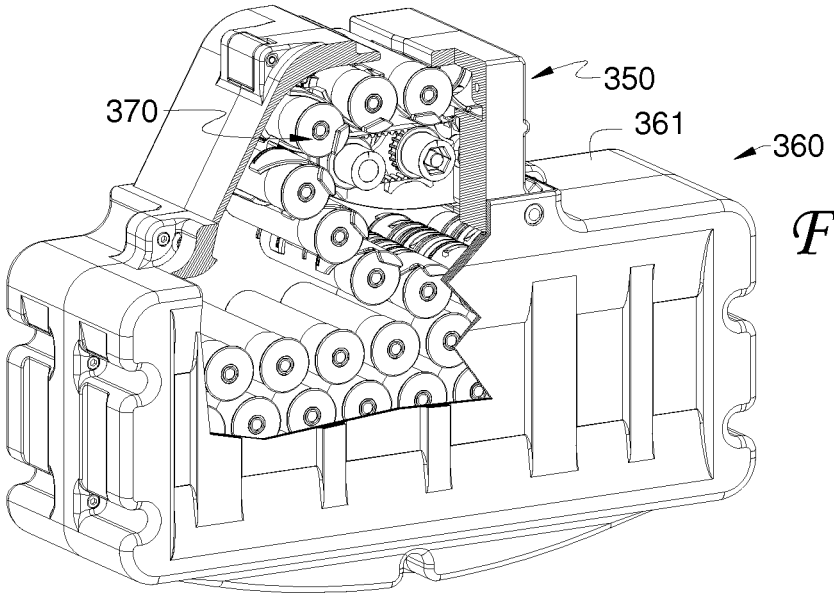

FIG. 35 is a sectionalized aft view of the loaded ready box 360 comprising the feed cover 350, the ammo box 361, and the linked-belt assembly 370. The feed cover 350 is shown loaded and installed on the ammo box 361.

Figure 35A:
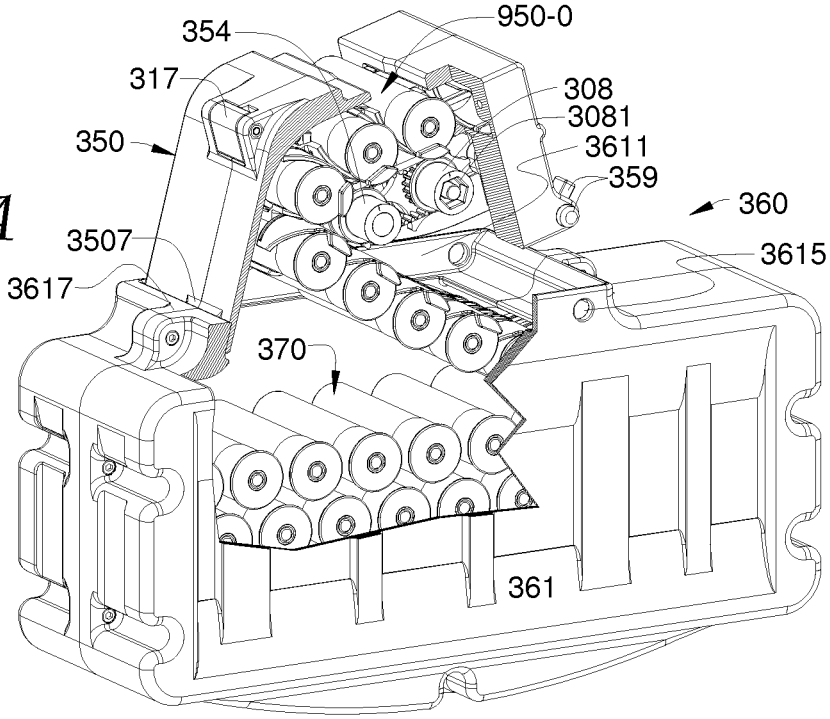

FIG. 35A is a aft sectionalized view of the loading of the ready box 360. The loaded feed cover 350 is being attached to the ammo box 361 and will be held in place by the ammo box latches 359 located within the feed cover 350. Attaching the feed cover 350 to the ammo box 361 makes the ready box 360. The feed cover 350 is loaded from the ammo box 361 containing the linked-belt 370. Identified are the ammo box lug 3507, the hex drive socket 3081, a feed cover well 3611, a set of ammo box latch holes 3615, a ammo box lug pocket 3617, and the loading cog 317.

Figure 36:
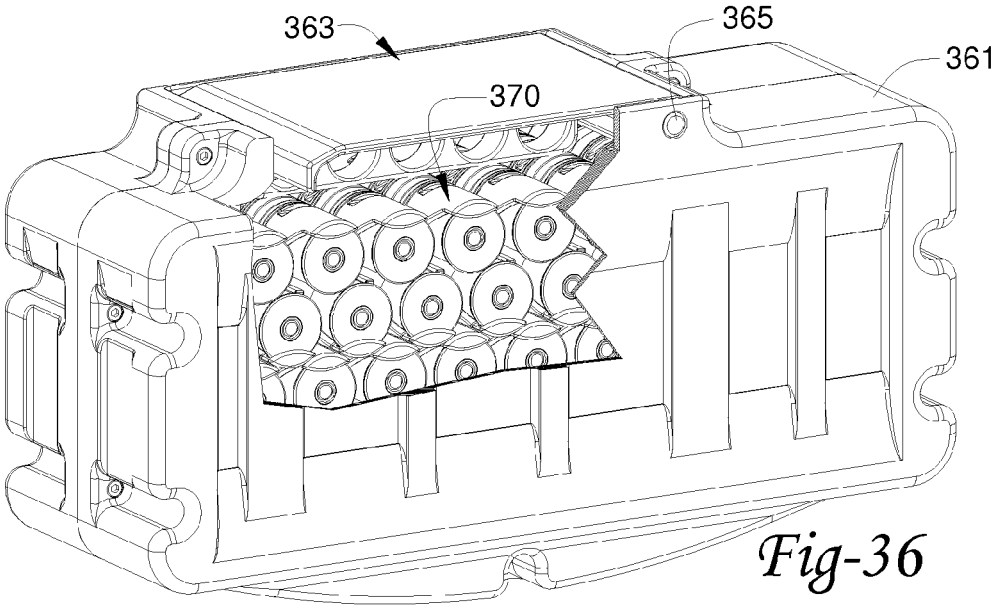

FIG. 36 is a aft sectionalized view of the loaded ammo box 361 ready for shipping to the field. A ammo box lid assembly 363 has been installed onto the ammo box 361 that has been loaded with the linked-belt 370 of the cartridges 950-0. The ammo box lid 363 is latched in place by a set of ammo box lid latches 365.

Figure 36A:
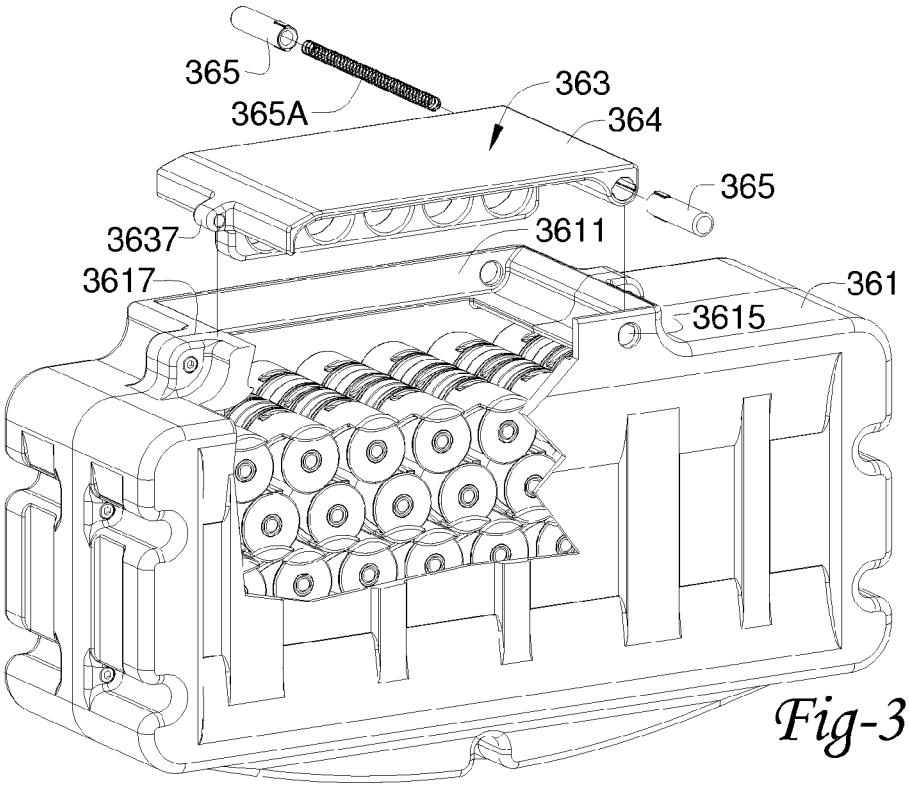

FIG. 36A is an expanded aft-sectionalized view of the ammo box 361 with the ammo box lid 363 being installed onto the ammo box 361 loaded with the linked-belt 370. Identified are the feed cover well 3611, the ammo box latch hole 3615, a ammo box lid attach lug 3637, a ammo box lid body 364, the ammo box lid latches 365, a lid latch spring 365A, and the ammo box lug pocket 3617.

FIG. 37A is a aft expanded view of the linked-belt 370 showing shotshells of various lengths being loaded. The shotshells shown are the 3½-inch shotshell 950-1, a 3-inch shotshell 950-2, and a 2¾-inch shotshell 950-3. A set of cartridge links 371 and shotshells interlock around two cartridge links 371 when assembled and form the linked-belt 370.

FIG. 37B is a aft view of the linked-belt 370 assembled and comprising the 3½-inch shotshell 950-1, the 3-inch shotshell 950-2, and the 2¾-inch shotshell 950-3. Identified features of the cartridge link 371 are the rim feed ramp 3143, the cartridge retainer 3145, and the cartridge retention clamps 3147.

FIG. 37C this is the aft view and the starting position of three views that show how the feed rim ramp 3143 cams the cartridge rim 9501 up and out of the cartridge retention clamps 3147 as the 3½-inch shotshell 950-1 is pushed forward in the cartridge link 371. Identified is the cartridge nose 9503.

FIG. 37D this is the second view of three showing how the feed rim ramp 3143 cams the cartridge rim 9501 up and out of the cartridge retention clamps 3147 as the 3½-inch shotshell 950-1 is pushed forward in the cartridge link 371. Shown is the mid-way position of the 3½-inch shotshell 950-1 as it has been pushed forward within the cartridge link 371 identified in FIG. 37C. The cartridge rim 9501 has moved up and out of the cartridge retention clamps 3147 as it moved up along the cartridge rim feed ramp 3143. As shown in FIG. 16A the cartridge nose 9503 when moved forward out of the cartridge link 371 will ride up the feed ramp 1009 located in the receiver 100.

FIG. 37E this is the third and final view of three showing how the feed rim ramp 3143 cams the cartridge rim 9501 up and out of the cartridge retention clamps 3147 as the 3½-inch shotshell 950-1 is pushed forward in the cartridge link 371. The final position of the cartridge 950-0 is shown after it has moved up and out of the cartridge retention camps 3147.

Figure 38A:
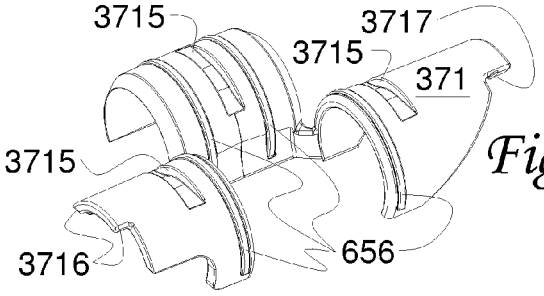

FIG. 38A is the bottom view of the cartridge link 371 comprising a set of the stiffing spring clips 656, a front link guides 3716, a aft link guide 3717, and a set of link thrust groves 3715.

Figure 38B:
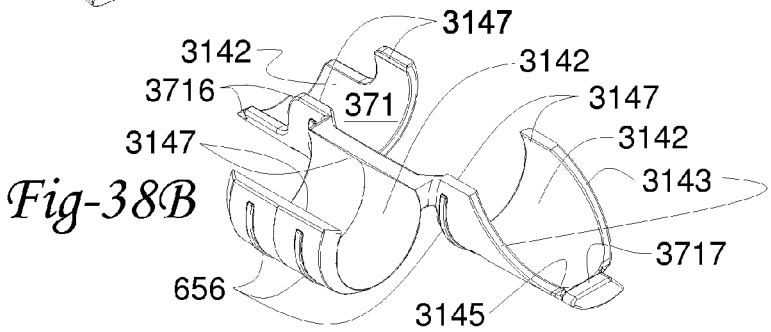

FIG. 38B top view of the cartridge link 371 comprising the cartridge pocket 3142, the feed rim ramp 3143, the cartridge retainer 3145, the set of cartridge retention clamps 3147, the front link guides 3716, the aft link guide 3717, and the set of stiffing spring clips 656.

Figure 39A:
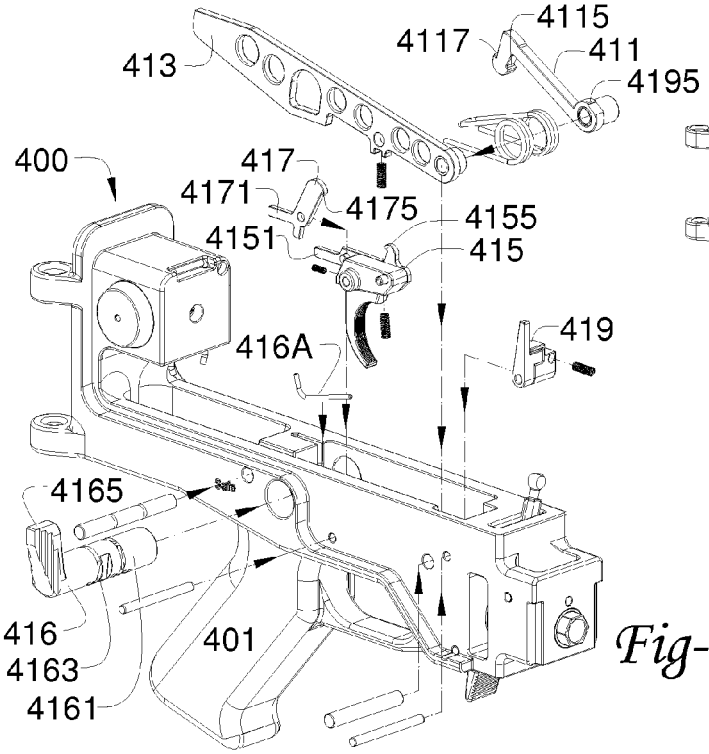
Figure 39A:
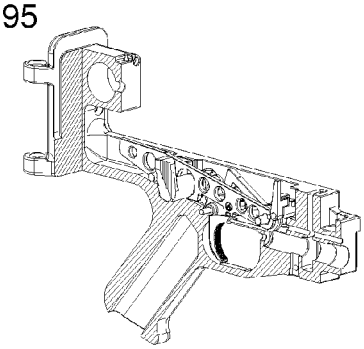

FIG. 39A is a front expanded view of the pistol grip 400 showing only fire control components. Fire control components comprise the hammer 411, the bolt hold-open 413, the fire control selector 416, the trigger 415, the disconnector 417, and the auto-sear 419. Identified are the fire control selector body 4161, the fire control selector slots 4163, the fire control selector arm 4165, the hammer disconnector sear 4117, the hammer trigger sear 4115, the trigger tang 4151, the disconnector tang 4171, the disconnector hammer sear 4175, and the trigger hammer sear 4155.

FIG. 39AA is a front sectionalized view of the pistol grip 400 showing assembled only the fire control components.

Figures 39B, 39C:
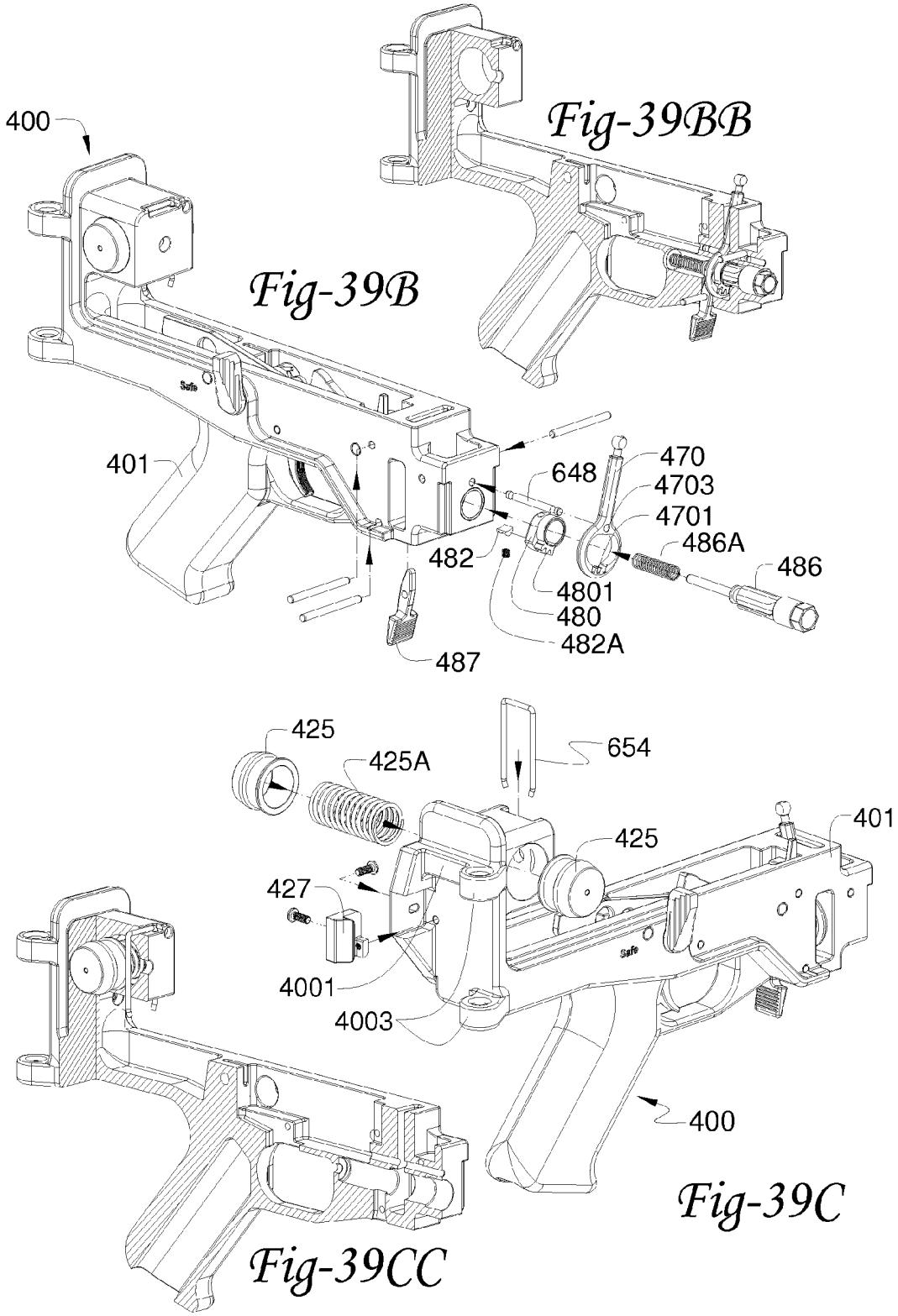

FIG. 39B is a front expanded view of the pistol grip 400 showing only feed drive components. Feed drive components comprise the feed drive shaft 486 with the feed drive shaft spring 486A and the magazine release lever 487. The feed ratchet 480 is installed around the feed drive shaft 486 while above the feed drive flipper 470 pivots on the feed drive flipper pivot pin 648. Within the feed drive flipper 470 a ratchet cog 482 with a ratchet cog spring 482A are installed and rotate around the feed drive shaft 486. Identified are the flipper ring gear teeth 4701, the feed drive flipper pivot hole 4703, and the feed ratchet gear teeth 4801.

FIG. 39BB is a front sectionalized view of the pistol grip 400 showing assembled only feed drive components.

FIG. 39C is a aft expanded view of the pistol grip 400 showing only pistol grip attachment components. Pistol grip attachment components attach the pistol grip 400 to the receiver 100 and provide mounting provisions for the folding shoulder stock 700. The pistol grip 400, attachment components are a set of pistol grip latches 425 and a pistol grip latch spring 425A held into the pistol grip body 401 by a pistol grip latch retainer 654. The folding shoulder stock latch plate 427, the pistol grip folding shoulder stock locking key 4001, and the set of folding shoulder stock hinges 4003 provide attachments for the folding shoulder stock 700.

FIG. 39CC is a front sectionalized view of the pistol grip 400 showing assembled only pistol grip attachment components.

Figure 40:
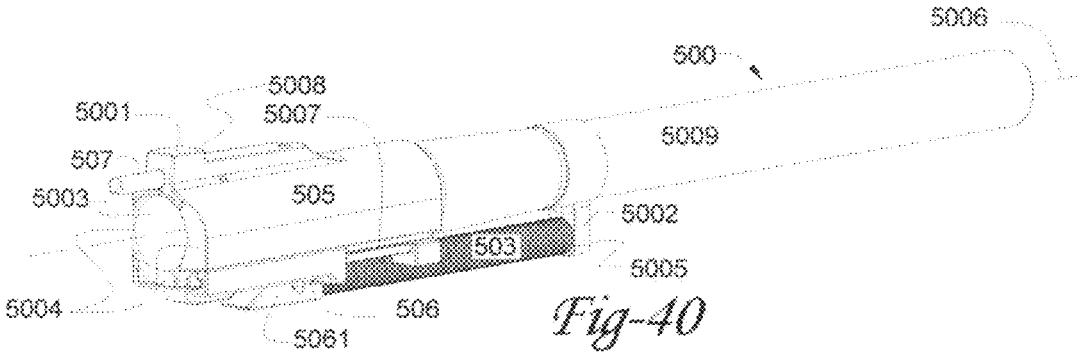

FIG. 40 is the aft view of the barrel assembly 500. Identified are the barrel spring 503, the cartridge guide 507, the barrel body 505, the barrel locking lug 5001, the barrel spring support 5002, the barrel chamber 5003, a barrel face cam surface 5004, the barrel stopping face 5005, a barrel centerline axis 5006, a barrel slider guide rib 5007, the barrel lug stopping face 5008, a barrel tube 5009, the barrel cam slider 506, and the barrel slider lock tang 5061

Figure 40A:
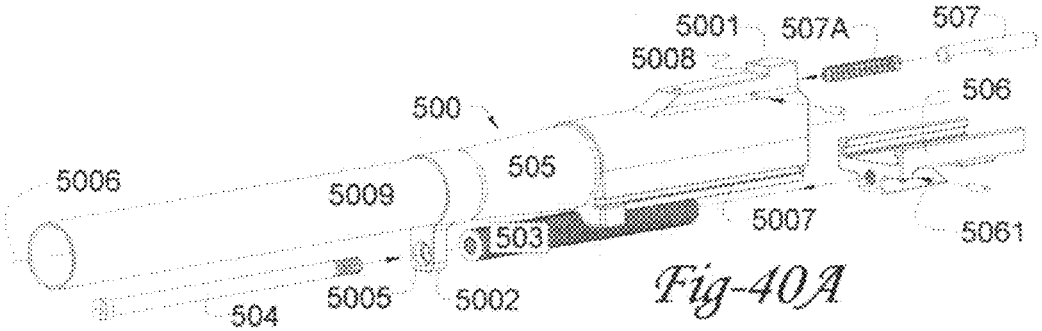

FIG. 40A is a front expanded view of the barrel assembly 500 comprising the barrel spring 503, barrel spring guide 504, the cartridge guide 507 with the cartridge guide bias spring 507A, the barrel body 505, the barrel locking lug 5001, the barrel spring support 5002, the barrel stopping face 5005, barrel centerline axis 5006, the barrel slider guide rib 5007, the barrel lug stopping face 5008, the barrel tube 5009, the barrel cam slider 506, and the barrel slider lock tang 5061.

Figure 41A:
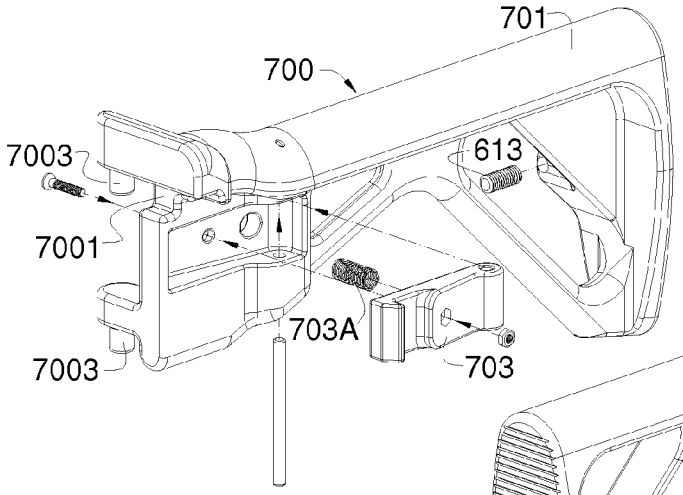

FIG. 41A is a front expanded view of the folding shoulder stock assembly 700 comprising the folding shoulder stock body 701, the folding shoulder stock latch 703 with a folding shoulder stock latch spring 703A, and the folding shoulder stock stow ball detent 613. Identified are the folding shoulder stock pivot studs 7003, and the folding shoulder stock locking key grove 7001.

Figure 41B:
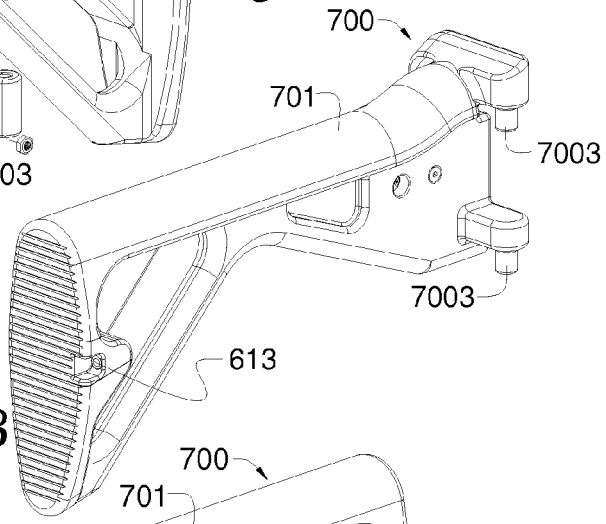

FIG. 41B is a aft view of the folding shoulder stock 700. Identified are the folding shoulder stock body 701, the folding shoulder stock pivot studs 7003, and the folding shoulder stock stow ball detent 613.

Figure 41C:
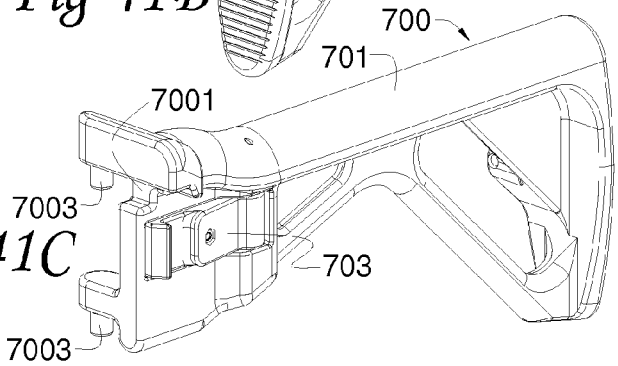

FIG. 41C is a front view of the folding shoulder stock 700. Identified are the folding shoulder stock locking key grove 7001, the folding shoulder stock body 701, the folding shoulder stock pivot studs 7003, and the folding shoulder stock latch 703.

FIG. 42 is a sectionalized aft view of the grenade launcher 8000 installed on the automatic gun 900 that has been loaded with the ready box 360. Identified are a launcher latch release lever 8212, a launcher latch 8236, and a launcher buffer 8416. Shown is area of coverage for FIG. 42A.

FIG. 42A is a close-up view of the grenade launcher 8000 mounted on the bottom accessory rail 184 of the automatic gun 900. Identified are the launcher latch release lever 8212, the launcher latch 8236, and a bottom accessory rail latch notch 1841.

FIG. 43 is a sectionalized aft view of the grenade launcher 8000 being installed on the bottom accessory rail 184 of the automatic gun 900. Identified are a accessory rail grove 84151, the launcher latch 8236, the launcher latch release lever 8212, and the launcher buffer 8416. Shown is area of coverage for FIG. 43A.

FIG. 43A is a close-up view of the grenade launcher 8000 mounting region and components. Identified are the launcher latch release lever 8212, the launcher latch 8236, the bottom accessory rail 184, the bottom accessory rail latch notch 1841, and the accessory rail grove 84151.

FIG. 44 is a sectionalized aft right side view of the grenade launcher 8000 being loaded with a 40 mm NATO grenade cartridge assembly 8950. Identified are a breech assembly 8200, a frame assembly 8400, a cylinder pivot screw 8455, a cylinder assembly 8380, a cylinder body 8387, a cylinder chamber 83871, the 40 mm NATO grenade cartridge 8950, the 40 mm NATO grenade cartridge case 89501, and a launcher ejector 8386. Shown is area of coverage for FIG. 44A.

FIG. 44A is a close-up aft right side view of the cylinder chamber 83871 loading or ejecting a 40 mm NATO grenade cartridge case 89501. Identified is a loading gate 8215 open and viewed from the right side of the grenade launcher 8000, the cylinder body 8387, the breech 8200, the frame 8400, a launcher detent recess 83841, a launcher ball detent 8637, a aft pivot bushing 8384, and the launcher ejector 8386.

Figure 44B:
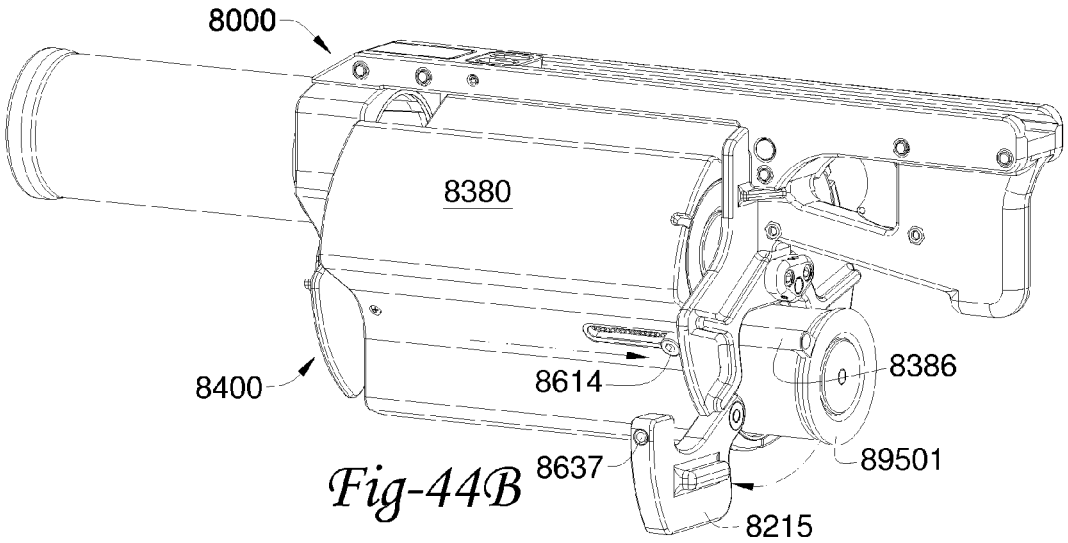

FIG. 44B is a aft left side view of the grenade launcher 8000 loading or ejecting the 40 mm NATO grenade cartridge case 89501 through the open loading gate 8215. Identified is the cylinder 8380, the launcher ejector 8386, the frame 8400, a launcher ejector screw knob 8614, and the launcher ball detent 8637.

Figure 45:
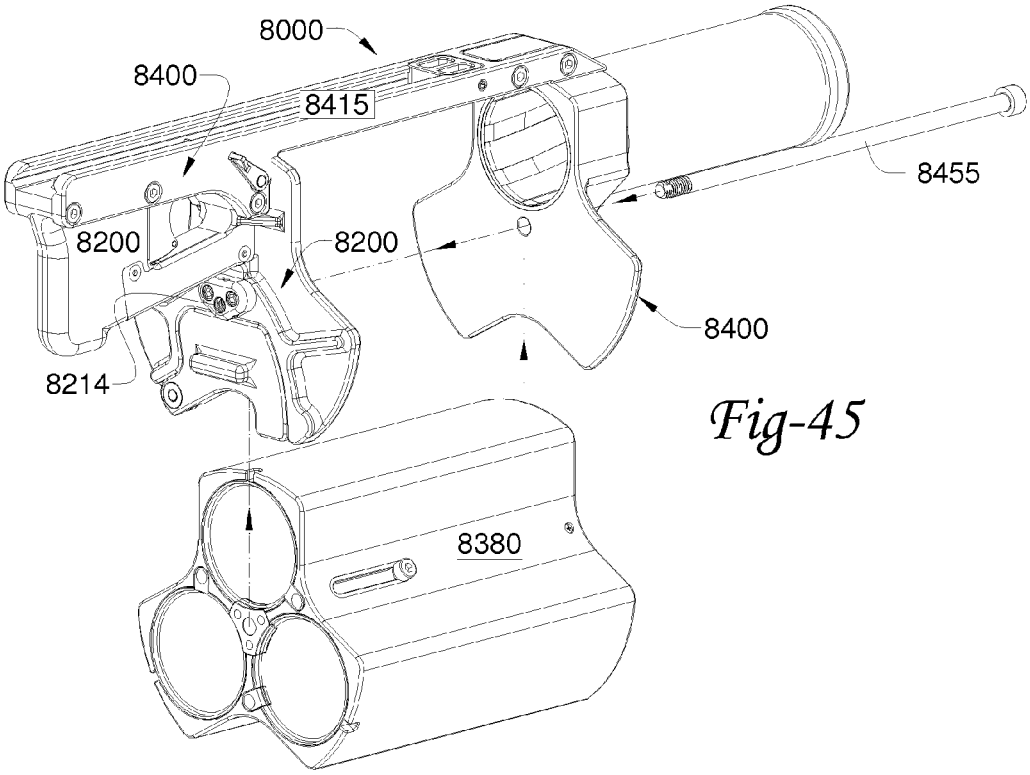

FIG. 45 is a aft expanded view of the cylinder 8380 being installed into the frame 8400. Identified are the cylinder pivot screw 8455, a launcher top strap 8415, the breech 8200, and a breech nut 8214.

Figure 46:
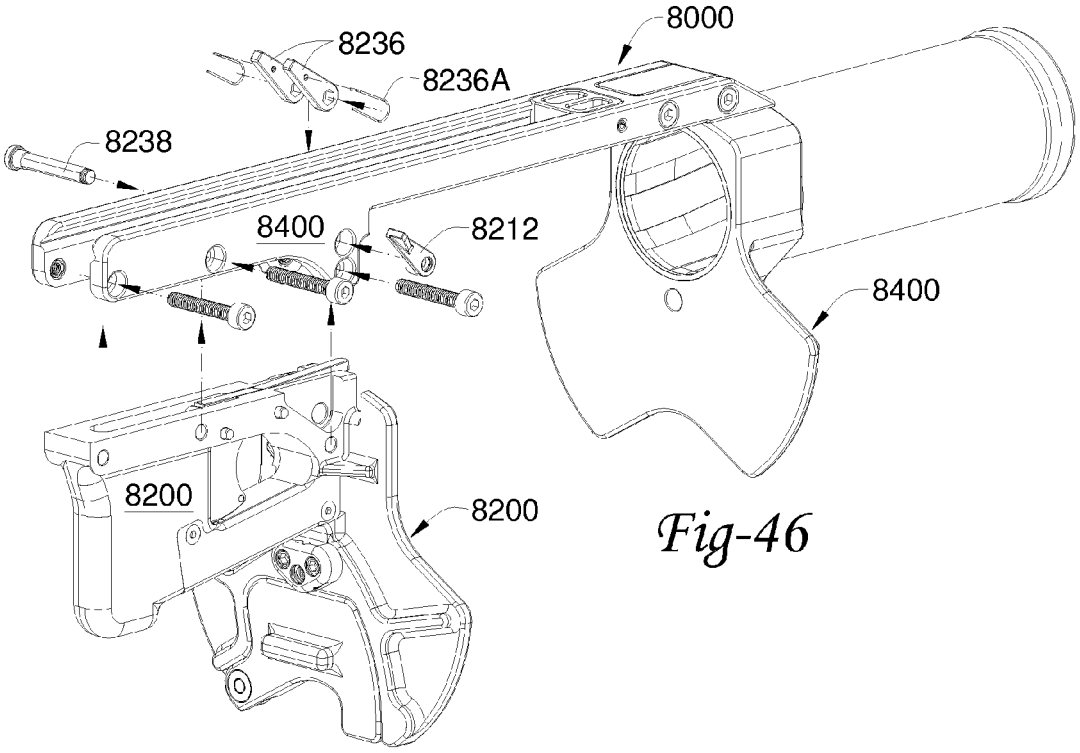

FIG. 46 is a aft expanded view of the frame assembly 8400 showing attachment of the breech 8200 and latch components. Identified are the breech 8200, the launcher latch 8236, a latch spring 8236A, the launcher latch release lever 8212, and a latch shaft 8238.

Figure 47:
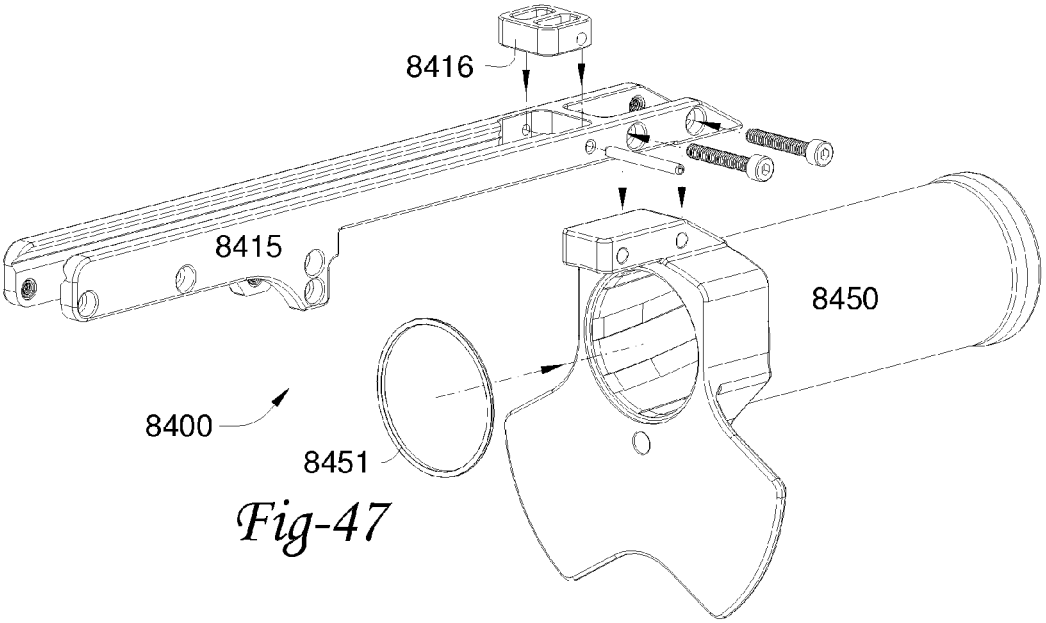

FIG. 47 is a aft expanded view of the launcher top strap 8415, and a launcher barrel 8450 being assembled for incorporation into the frame assembly 8400. Identified are a launcher barrel face seal 8451, and the launcher buffer 8416.

Figure 48:
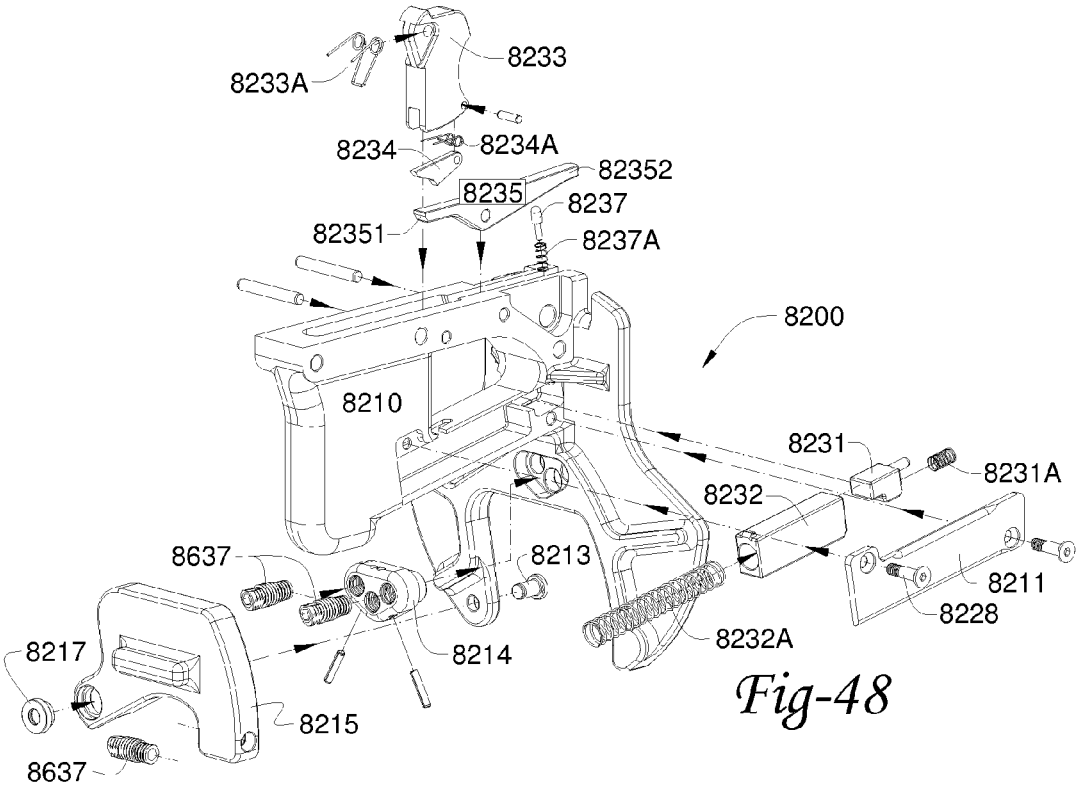

FIG. 48 is a aft expanded view of the breech assembly 8200. Identified are a launcher trigger 8233, a launcher trigger return spring 8233A, a launcher sear 8234, a launcher sear spring 8234A, a cylinder lock 8235, a cylinder lock plunger 8237, a cylinder lock plunger spring 8237A, a breech body 8210, the loading gate 8215, a loading gate bushing 8217, a loading gate pivot 8213, a launcher hammer 8232, a launcher hammer spring 8232A, a launcher firing pin 8231, a launcher firing pin return spring 8231A, a lock plate 8211, a lock plate screw 8228, and the launcher ball detent 8637.

Figure 49:
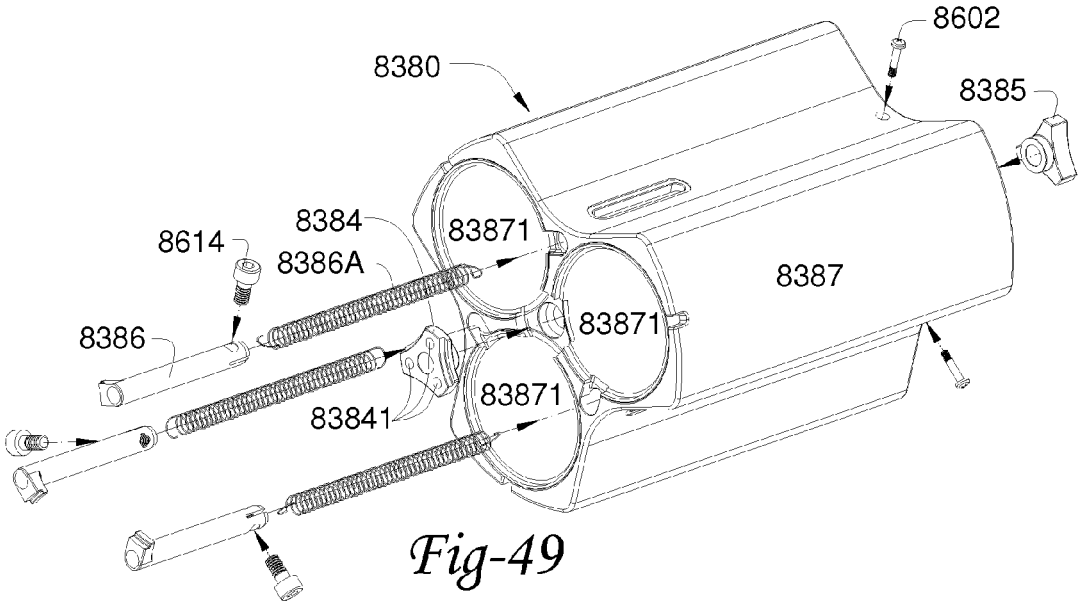

FIG. 49 is a aft expanded view of the cylinder assembly 8380. Identified are the cylinder body 8387, a front pivot bushing 8385, a aft pivot bushing 8384, the launcher ejector 8386, the cylinder chamber 83871, the launcher ejector screw knob 8614, the launcher detent recess 83841, a launcher ejector return spring 8386A, and a launcher ejector spring retaining screw 8602.

Figure 50:
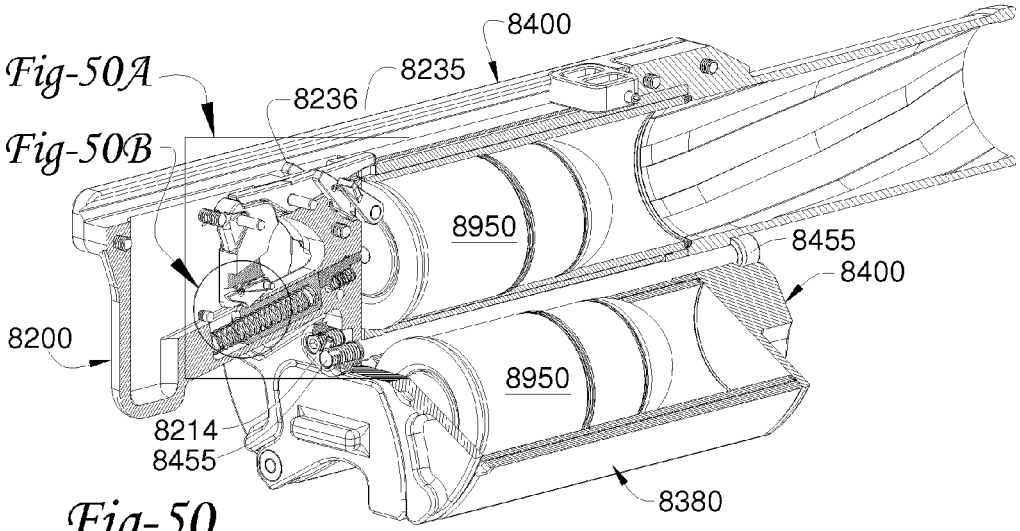

FIG. 50 is a sectionalized aft view of the grenade launcher 8000 ready to be fired. Shown are areas of coverage for FIG. 50A, and FIG. 50B. Identified are the frame 8400, the cylinder pivot screw 8455, the breech nut 8214, the cylinder lock 8235, the launcher latch 8236, the breech 8200, the cylinder 8380, and the 40 mm NATO grenade cartridge 8950. Shown is area of coverage for FIG. 50A and FIG. 50B.

Figure 50B:
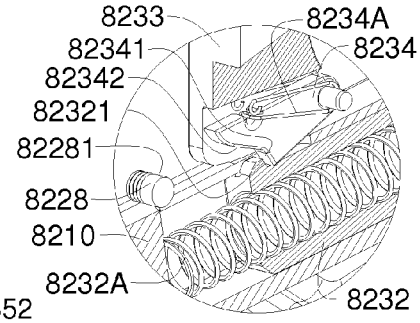
Figure 50A:
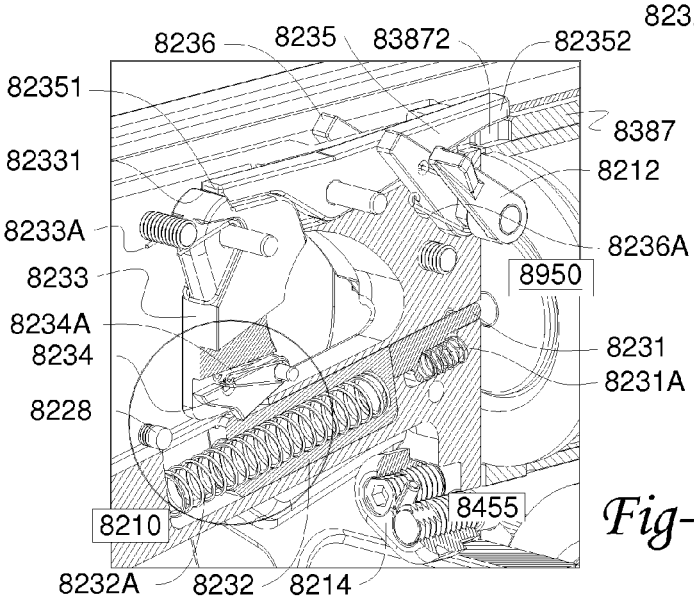

FIG. 50A is a close-up view of the cylinder lock 8235 region and the area of coverage for FIG. 50B. Identified are a lock cylinder tang 82352, a cylinder lock notch 83872, the cylinder lock 8235, the launcher latch 8236, a lock trigger tang 82351, a launcher trigger lock cam 82331, the launcher trigger return spring 8233A, the launcher trigger 8233, the launcher sear spring 8234A, the launcher sear 8234, the lock plate screw 8228, the breech body 8210, the launcher hammer spring 8232A, the launcher hammer 8232, the cylinder pivot screw 8455, the breech nut 8214, the launcher firing pin return spring 8231A, the launcher firing pin 8231, the latch spring 8236A, the launcher latch release lever 8212, and the cylinder body 8387.

FIG. 50B is a close-up view of a launcher hammer sear 82321 and the launcher sear 8234 region. Identified are a screw sear cam face 82281, the launcher hammer sear 82321, a launcher sear cam face 82342, a launcher sear hammer face 82341, the launcher trigger 8233, the launcher sear spring 8234A, the launcher sear 8234, the launcher hammer 8232, the launcher hammer spring 8232A, the breech body 8210, and the lock plate screw 8228.

FIG. 51 is a sectionalized aft view of the grenade launcher 8000 with the launcher trigger 8233 pulled halfway back. Shown is area of coverage for FIG. 51A. Identified are the 40 mm NATO grenade cartridge 8950 and the launcher firing pin 8231, the launcher trigger 8233, and the cylinder lock 8235.

FIG. 51A is a close-up view of the cylinder lock 8235 region with the launcher trigger 8233 halfway back. Identified are the launcher hammer 8232, the launcher hammer sear 82321, the lock plate screw 8228, the launcher sear 8234, the launcher sear hammer face 82341, the launcher trigger 8233, a launcher firing pin hammer face 82311, the launcher firing pin 8231, the cylinder lock 8235, the lock trigger tang 82351, the launcher trigger lock cam 82331, a launcher trigger lock support 82332, the lock trigger tang 82351, and the cylinder lock notch 83872.

Figure 52:
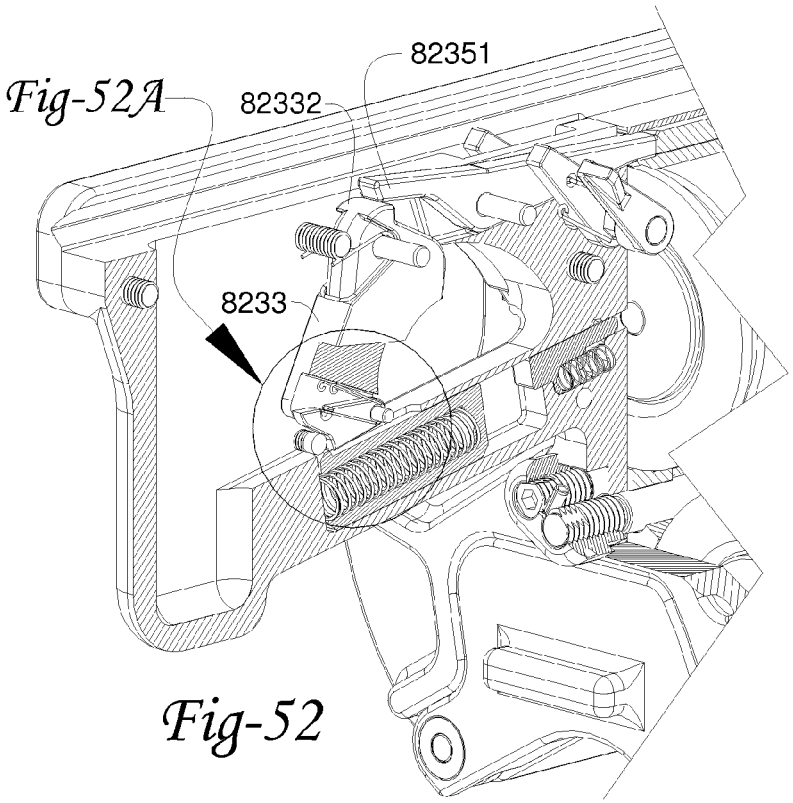

FIG. 52 is a sectionalized aft view of the grenade launcher 8000 with the launcher trigger 8233 pulled all the way back and the launcher sear 8234 shown disengaged from the launcher hammer sear 82321. Shown is area of coverage for FIG. 52A. Identified are the lock trigger tang 82351, the launcher trigger lock support 82332, and the launcher trigger 8233.

Figure 52A:
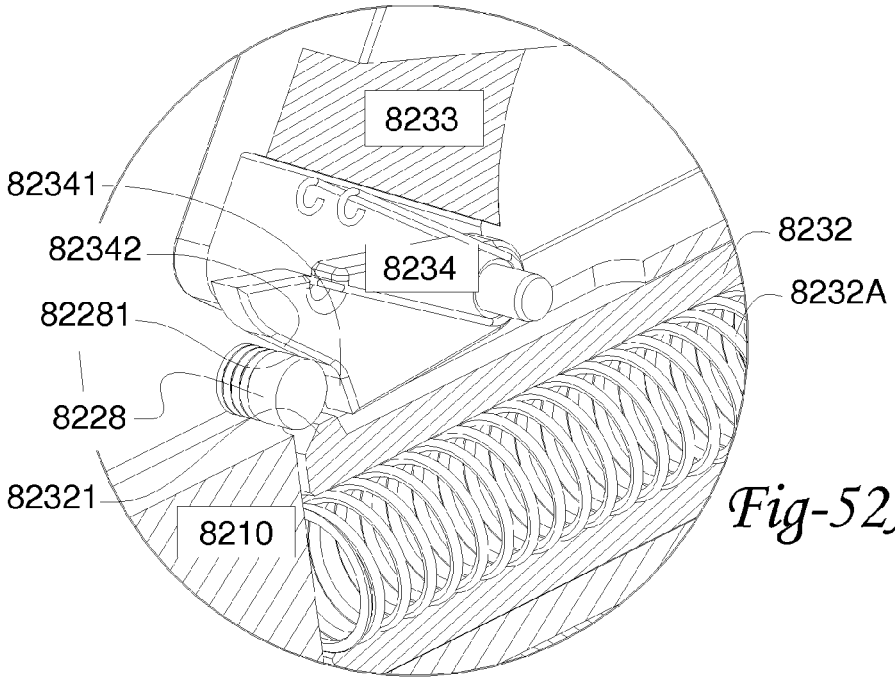
Figure 53:
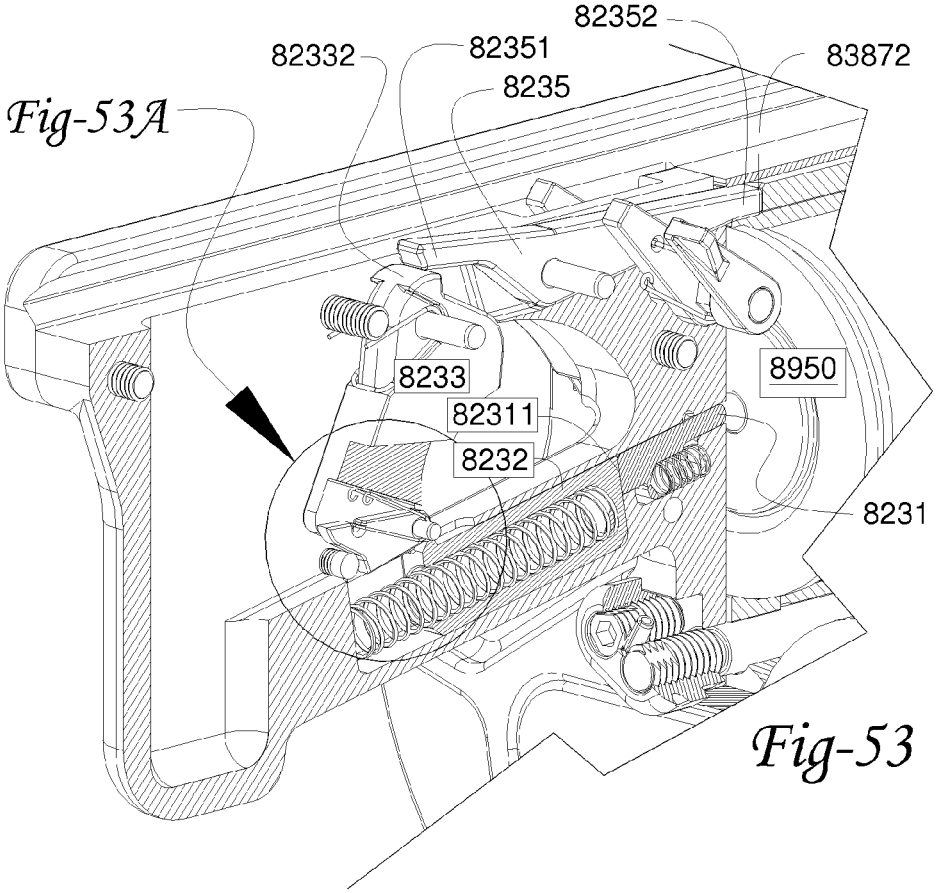

FIG. 52A is a close-up view of the launcher sear 8234 and the launcher hammer 8232 region, with the launcher sear 8234 disengaged from the launcher hammer sear 82321. Identified are the launcher trigger 8233, the launcher sear 8234, the launcher sear hammer face 82341, the launcher sear cam face 82342, the breech body 8210, the lock plate screw 8228, the screw sear cam face 82281, and the launcher hammer sear 82321, FIG. 53 is a sectionalized aft view of the grenade launcher 8000 with the launcher trigger 8233 pulled all the way back and the launcher hammer 8232 down and the 40 mm NATO grenade cartridge 8950 fired. Shown is area of coverage for FIG. 53A. Identified are the launcher trigger lock support 82332, the lock trigger tang 82351, the cylinder lock 8235, the lock cylinder tang 82352, the cylinder lock notch 83872, the, the launcher firing pin 8231, the launcher hammer 8232, and the launcher trigger 8233.

Figure 53A:
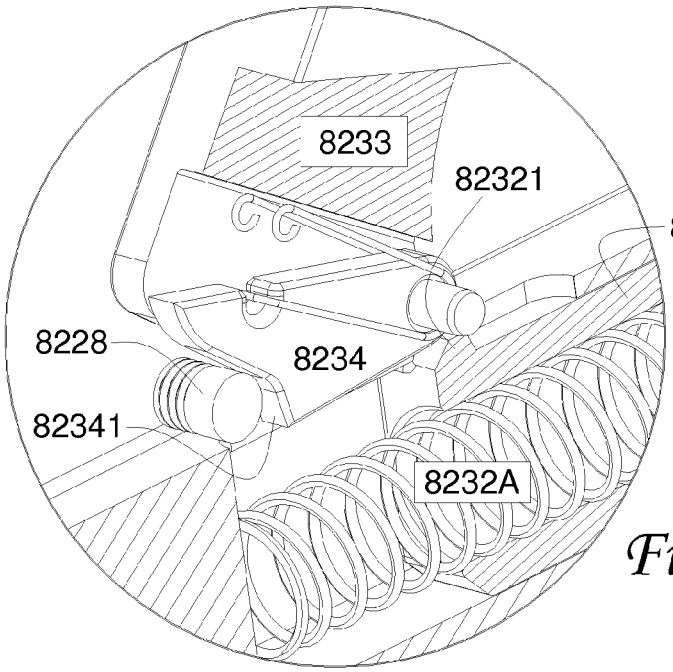

FIG. 53A is a close-up view of the launcher sear 8234 and the launcher hammer 8232 region, with the launcher hammer 8232 shown down. Identified are the launcher trigger 8233, the launcher hammer sear 82321, the launcher hammer 8232, the launcher sear 8234, the lock plate screw 8228, and the launcher sear hammer face 82341.

Operation of Gun, FIG. 1 Through FIG. 41C

In this embodiment the descriptions of gun functions have been broken into 4 sections to better understand how they each work and how they each relate to each other within the unique machine gun envisioned in this embodiment.

Section A: Basic cycle of gun operation. These are the classical functions of Firing, Extraction, Ejection, Chambering and Locking common to all automatic guns.

Section B: Gun feed system. The feed system is sub-divided into two parts:

Part A, how the feed drive unit works.

Part B, how the 3 different feed advance assemblies work.

Section C: Gun fire control system. How the fire control system functions to establish safe, semiautomatic, and automatic fire.

Section D: Gun special features. Special features include the folding shoulder stock, and the flechettes used in the 3½-inch shotshell 950-1.

Operation: Section A—Basic Cycle of Gun Operation.

To better understand the basic cycle of gun operation and how the components within the automatic gun 900 relate to each other a special series of 37 sectionalized views starting at FIG. 9 and going through to FIG. 18C are provided.

Common to all these sectionalized views are the following special conditions:

The receiver body assembly 101 has had the right side of the receiver housing 120; bottom accessory rail 184, barrel bushing 110, and the barrel bushing lock 113 have been sectionalized to aid in clarity. The non-sectionalized components of the receiver 100 can be seen in their entirety in FIG. 29A. The non-sectionalized components of the receiver body 101 can be seen in their entirety in FIG. 30.

The receiver body assembly 101 has had the receiver right side plate 181 and the barrel guide plate 183 on the right side omitted. The omitted components of the receiver body 101 can be seen in FIG. 30.

The bolt assembly 200 has had the right side of the bolt body 206 and the top cover 205 partially sectionalized to show the internal components of the bolt assembly 200. The non-sectionalized bolt body 206 and top cover 205 can be seen in their entirety in FIG. 31A.

The pistol grip assembly 400 has had the right side of the pistol grip body 401 partially sectionalized to show the internal components. The non-sectionalized components of the pistol grip assembly 400 and the missing components can be seen in its entirety in the following views, FIG. 39A, FIG. 39B, and FIG. 39C In the pistol grip assembly 400 most fire control component bias springs omitted to aid clarity. The pistol grip assembly 400 can be seen in its entirety in the following expanded views, FIG. 39A, FIG. 39B, and FIG. 39C. When a bias spring was critical to explain the function that spring is shown in the pertinent sectionalized view.

The barrel assembly 500 has had the right side of both the barrel body 505 and the barrel cam slider 506 sectionalized to aid clarity. The non-sectionalized components of the barrel assembly 500 can be seen in their entirety in FIG. 40A The folding shoulder stock 700 assembly as shown in FIG. 41A has been omitted from all sectionalized views.

Starting in FIG. 15 and going through FIG. 18C the sectionalized single sprocket magazine assembly 310 has been added. The sectionalized view of the loaded single sprocket magazine 310 is shown in FIG. 32C FIG. 9, the Automatic Gun 900 has Just Fired.

FIG. 9 shows that the automatic gun 900 has just fired the cartridge 950-0 but recoil travel of the components have not yet started. In reality the view shown in FIG. 9 is physically impossible. This is because as soon as the automatic gun 900 fires the projectile will start to move forward, while the locked unit comprising the barrel 500 and the bolt 200 will move aft in recoil—both at the same time. For clarity the projectile has been omitted, but the rest of the automatic gun 900 components are in the correct relative position to each other at the moment of firing.

FIG. 9A shows the barrel body 505 and the bolt 200 locked together as a unit in what is called in this embodiment the lockup.

FIG. 9C shows this lockup at the maximum forward position permitted within the automatic gun 900 envisioned in this embodiment.

FIG. 9C also shows the barrel stopping face 5005 of the barrel spring support 5002 touching the barrel bushing 110. This is because the barrel body 505 stops the lockup counter-recoil travel when the barrel stopping face 5005 of the barrel spring support 5002 strikes the aft face of the barrel bushing 110. Reference FIG. 40A for further detail of the barrel stopping face 5005 and the barrel spring support 5002.

When the gun is firing in automatic fire the auto-sear 419 releases the hammer 411 to fire the automatic gun 900—not the trigger assembly 415.

FIG. 9B shows that the auto-sear 419 is timed to fire the automatic gun 900 just before the barrel stopping face 5005 strikes the barrel bushing 110 that is shown in FIG. 9C. To fire the automatic gun 900 the bolt auto-sear notch 2067 strikes the auto-sear tang 4192—rotating the auto-sear 419 forward. In this embodiment the firing is done slightly before the barrel stopping face 5005 strikes the barrel bushing 110 to prevent counter-recoil spike loading.

At the moment of firing the automatic gun 900 components are positioned as shown in FIG. 9A, FIG. 9C, and FIG. 9B.

Shown in FIG. 9B the trigger 415 has been pulled aft depressing the bolt hold-open 413. Located on the trigger 415 is the trigger cam pin 642 that rides inside the bolt hold-open trigger hole 4131. When the trigger cam pin 642 is rotated down it pulls the bolt hold-open 413 down. The bolt hold-open trigger hole 4131 is oversized to permit the spring-loaded bolt hold-open 413 to be depressed when the trigger cam pin 642 is up and the trigger 415 rotated forward. This permits the depression of the bolt hold-open 413 by the passage of the bolt 200 during gun charging, or during automatic fire as the last round in a burst is being fired.

FIG. 9B shows that the bolt auto-sear notch 2067 on the bolt 200 has pushed forward the auto-sear tang 4192 of the auto-sear 419. The auto-sear tang 4192 and the auto-sear hammer sear 4195 can be better seen in FIG. 21B. The rotational movement of the auto-sear 419 moves it up and out of engagement with the hammer 411 to allow the hammer 411 to fall and strike the firing pin 220

FIG. 9B shows the fire control selector arm 4165 in the vertical position, which in the embodiment is the automatic fire mode.

Reference FIG. 19 to understand the trigger assembly 415. FIG. 19 is a expanded view of the trigger assembly 415 showing that the disconnector 417 is mounted on the disconnector pivot pin 647 that is pressed into the trigger sear plate 415-2. The disconnector 417 is free to rotate upon the disconnector pivot pin 647 and spring bias by the disconnector spring 417A.

Now reference FIG. 20A, FIG. 20B, FIG. 21A, and FIG. 21B. These views show that when the trigger 415 is pulled aft in automatic fire mode, the fire control selector body 4161 depresses the disconnector tang 4171, and moves the disconnector 417 away from the hammer disconnector sear 4117. Thus the disconnector hammer sear 4175 will remain disengaged from the hammer disconnector sear 4117 regardless of the position of the trigger 415.

FIG. 9A shows both the case guide 207 and the cartridge guide 507 fully depressed. The case extractor 208 is shown fully engaged on the cartridge rim 9501 of the cartridge case 9504.

From this instance of time on the barrel body 505 and the bolt 200 lockup will be in recoil travel.

FIG. 9C and in reference on FIG. 31C and FIG. 31D show that during any recoil travel of the bolt 200 the driving spring support 2066 on the bolt 200 will compress the driving spring 750A. As shown in FIG. 9C and more clearly in FIG. 10C during the lockup recoil travel of the locked unit comprising the bolt 200 and the barrel 500, only the driving spring 750A is compressed.

Figure 10:
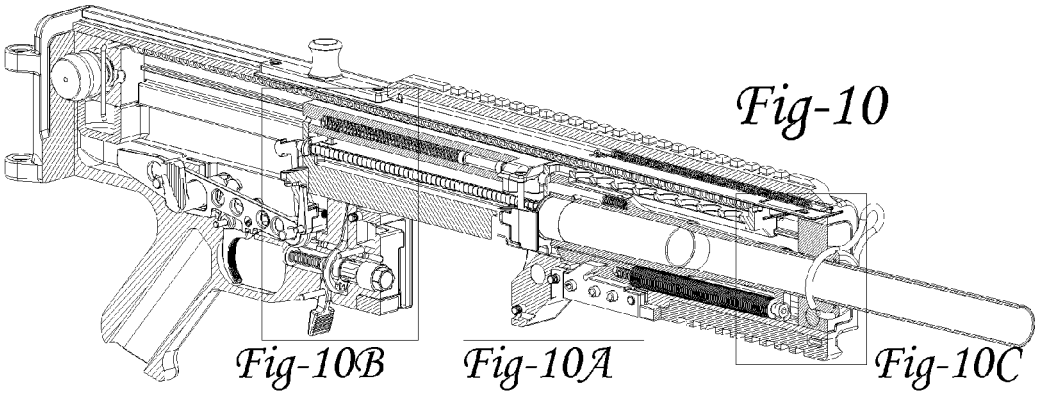

FIG. 10 Shows Lockup Dwell Finished

Figure 10A:
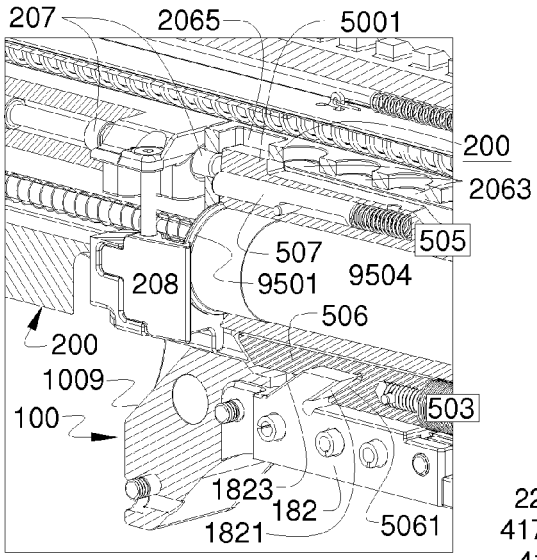

As shown in FIG. 10A the lockup has moved in recoil and the lockup dwell has ended. After the lockup dwell has ended the barrel slider lock tang 5061 engages the front barrel cam locking face 1821. Additional recoil travel allows the front barrel cam locking face 1821 to work on the barrel slider lock tang 5061 to cam down the barrel slider lock tang 5061 as shown from FIG. 9A to FIG. 10A. The downward movement of the barrel cam slider 506 onto the receiver barrel cam 182 locks the barrel cam slider 506 from any further movement.

Clearly seen in FIG. 10A the downward movement of the barrel body 505 has unlocked the barrel locking lug 5001 from the bolt barrel locking recess 2065 while locking the barrel cam slider 506 into the receiver barrel cam 182.

Figure 10C:
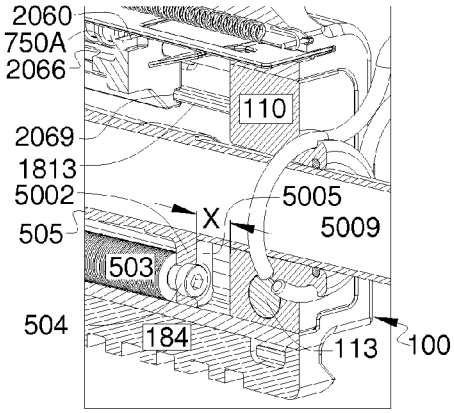

The barrel assembly 500 guidance is shown in FIG. 10A, FIG. 10C, and reference on FIG. 29A, FIG. 30, and FIG. 40A.

FIG. 10C and reference FIG. 29A show that the barrel body 505 is guided and restrained in the front by the barrel tube 5009 sliding within the barrel bushing 110.

Reference FIG. 40A to see that the barrel cam slider 506 is slidably installed on the barrel slider guide ribs 5007 that are located on the bottom of the barrel body 505.

Reference FIG. 30 to see the barrel guide plates 183 reside on either side of the receiver barrel cam 182 and restrain a barrel slider lock support 5065 on the barrel cam slider 506 from sideward movement, thus working with the receiver barrel cam 182 to control the barrel cam slider 506 during its short recoil movement.

As shown in FIG. 10A the receiver barrel cam 182 is securely holds the barrel slider 506 locked from any further movement. The barrel locking lug 5001 of the barrel body 505 is either engaged in the bolt barrel locking recess 2065 or after unlocking the barrel locking lug 5001 is slidably held within the bolt barrel guide grove 2063.

Figure 13C:
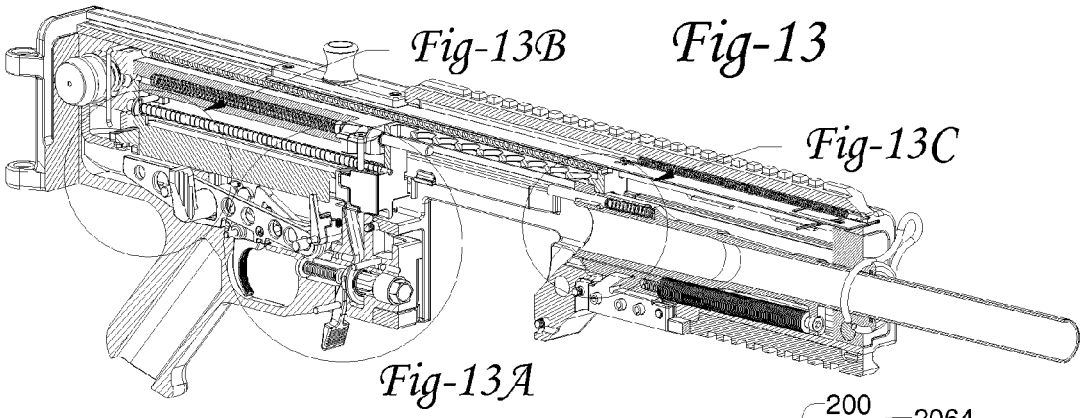
FIG. 13C is a close-up view of the barrel lug stopping face 5008 striking a bolt barrel stopping face 2064. Identified is the driving spring 750A.
Figure 13C:
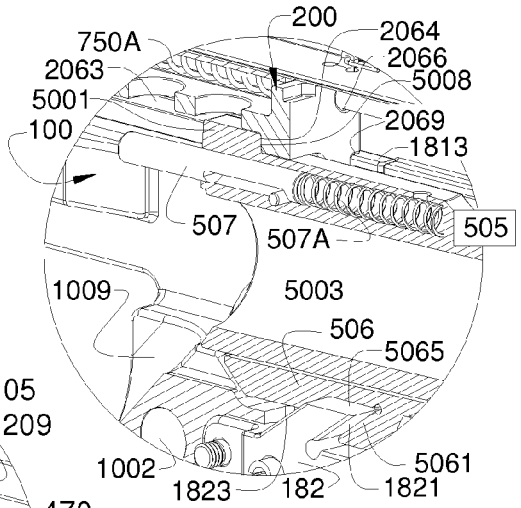

The bolt 200 guidance is shown in FIG. 10C and better shown in FIG. 13C. These views show the bolt guide grove 2069 and how it rides over the receiver bolt guide ribs 1813 located on either side of the receiver body 101. The bolt guide groves 2069 can be seen for reference in FIG. 31B, FIG. 31D, and FIG. 9C. The receiver bolt guide ribs 1813 can be seen for reference on FIG. 30.

As shown in FIG. 13C when the bolt 200 moves in recoil the metal bolt guide groves 2069 of the bolt 200 ride over the metal receiver bolt guide ribs 1813 found on a receiver left side plate 180 and the receiver right side plate 181 and shown in FIG. 30. As shown in FIG. 10C the polymer receiver bolt guide rib 1813 located in the receiver 100 are used only to guide the bolt 200 into the correct position within the receiver 100 during bolt 200 installation and are NOT used during operation.

FIG. 10A, FIG. 10C, and reference FIG. 11A views show that unlocking of the bolt 200 from the barrel body 505 allows recoil travel of the bolt 200 to compress the driving spring 750A with the driving spring support 2066. Reference FIG. 31C, and FIG. 31D for more views of the driving spring support 2066.

FIG. 10C shows the distance the bolt 200 and the barrel body 505 travels to unlock as a value <X>. The value of <X> in this embodiment is a total of a dwell distance and distance needed for unlock. During value <X> travel only the driving spring 750A is compressed and not the barrel spring 503.

FIG. 10A shows the limit of recoil travel permitted the barrel cam slider 506 and the attached barrel spring guide 504. However from this recoil point on the barrel body 505 is still free to continue recoil and compress the barrel spring 503.

FIG. 10A shows the barrel body 505 has moved down and in doing so has pulled the cartridge case 9504, and the cartridge rim 9501 down under the spring loaded case extractor 208.

Figure 10B:
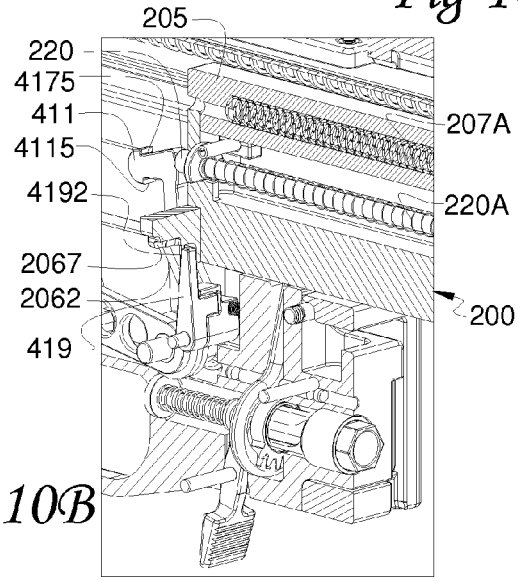

As shown in FIG. 10B the first part of the lockup dwell recoil moves aft the bolt auto-sear notch 2067, which allows the auto-sear tang 4192 to rotate aft. The auto-sear notch 4192 can be seen in FIG. 21B. This movement allows the auto-sear 419 to reset for later engagement with the hammer auto-sear notch 4119.

FIG. 10B also shows that the bolt 200 recoil has started to re-cock the hammer 411. The rotational movement of the hammer 411 aft has allowed the firing pin spring 220A to reset the firing pin 220 aft within the bolt 200 for the next firing FIG. 11 Shows Start of First Recoil Cycle of the Barrel Body 505.

FIG. 11A and reference FIG. 31B show that the bolt barrel guide grove 2063 extends forward from the bolt barrel locking recess 2065 to the bolt barrel stopping face 2064.

As shown in FIG. 11A the bolt barrel guide grove 2063 guides and by using the barrel locking lug 5001 also limits the recoil distance permitted the bolt 200 after the bolt 200 has been unlocked from the barrel body 505.

FIG. 11C is a close-up view to show the bolt barrel guide grove 2063 riding over the barrel locking lug 5001. The bolt barrel guide grove 2063 is also shown as reference in FIG. 31B. Also shown in FIG. 11C the recoil travel of the bolt 200 and the barrel body 505 are now independent of each other. However as shown in FIG. 11A the recoil travel permitted the bolt 200 will be limited by the length of the bolt barrel guide grove 2063.

FIG. 11A shows that the receiver barrel cam 182 has pulled down and locked from movement the barrel cam slider 506. However the barrel body 505 is still free to continue recoil travel and compresses the barrel spring 503 over the barrel spring guide 504.

FIG. 11A shows the start of the extraction of the cartridge case 9504 from the barrel chamber 5003. The case extractor 208 is pulling the cartridge case 9504 from the barrel chamber 5003 by the cartridge rim 9501. As shown in FIG. 11C as the cartridge case 9504 is extracted both the case guide 207 and the cartridge guide 507 are extending from being fully depressed.

FIG. 11A shows the barrel body 505 has moved the value R1 while the bolt 200 has moved almost twice that amount. In this embodiment the weight of the bolt 200 and the barrel 500 are similar. The differences in recoil travel for the bolt 200 and barrel body 505 is simply because the barrel spring 503 is much stronger than the driving spring 750A.

As shown in FIG. 11A it is envisioned and shown that the barrel spring 503 is a stack of spring washers—although other types of springs can be used. The barrel spring guide 504 holds the barrel spring 503 between the barrel spring support 5002 and the barrel cam slider 506. When the barrel spring support 5002 recoils it compresses the barrel spring 503 between the stationary barrel cam slider 506 and over the stationary barrel spring guide 504.

As shown in FIG. 11A the strong barrel spring 503 has stopped the barrel body 505 recoil at the relative short distance <R1>. Furthermore FIG. 11A clearly shows that the recoil of the barrel body 505 is stopped without striking any element of the receiver 100.

The driving spring 750A identified in FIG. 11A is not required to be a strong spring. The driving spring 750A need only have a reasonable spring rate and high preload when installed. The functions of the driving spring 750A are two fold:

1. When firing from the closed-bolt the driving spring 750A must keep the locked bolt 200 and barrel 500 in battery.
2. When firing from the open-bolt the driving spring 750A must be strong enough to push the bolt 200 forward in counter-recoil and strip the fresh cartridge 950-0 from the feed advance assemblies, chamber it and then fire it after lockup dwell.

FIG. 11B shows that as discussed under FIG. 10B the auto-sear 419 has been reset and is ready to engage the hammer auto-sear notch 4119 after the hammer 411 has been fully cocked by the recoil travel of the bolt 200. The auto-sear notch 4192 can be seen on FIG. 21B. As shown in FIG. 11B the trigger cam pin 642 mounted on the trigger 415 is holding the bolt hold-open 413 down.

Figure 12A:
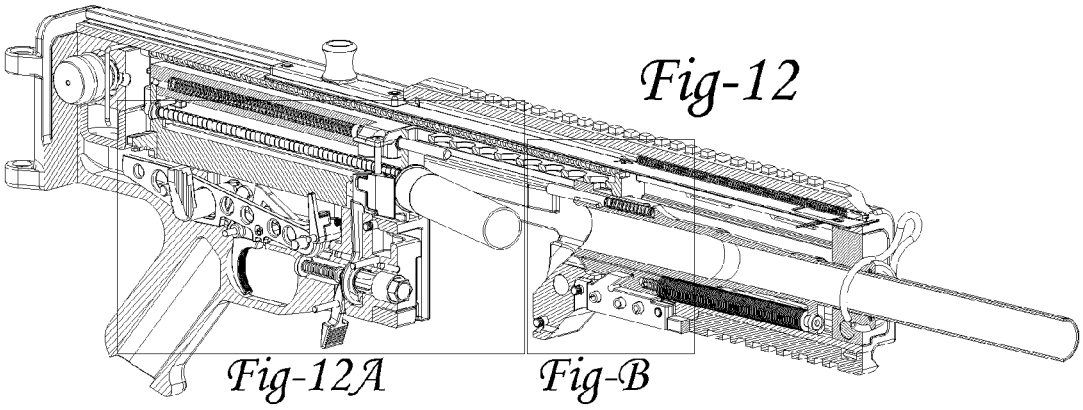
Figure 12A:
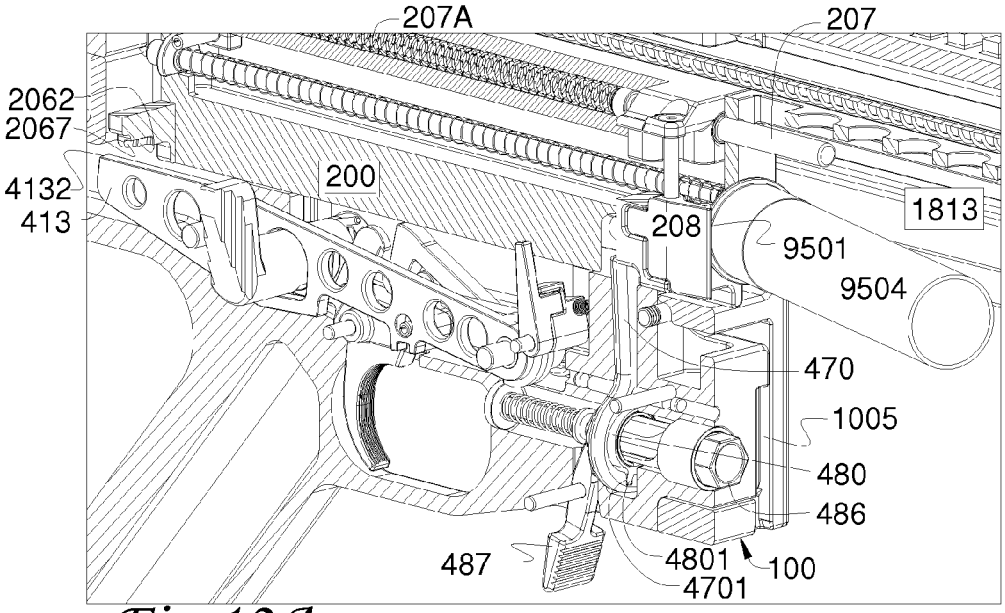

FIG. 12 Shows the Bolt 200 in Free Recoil Cycle.

The barrel spring 503 has returned the barrel body 505 forward to battery. The bolt 200 is in free recoil and has begun to eject from the receiver the fired cartridge case 9504.

Figure 12B:
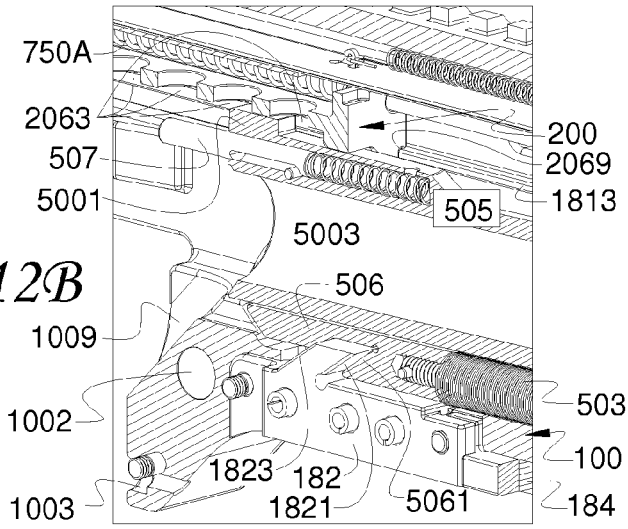

FIG. 12B is a close-up showing that the barrel body 505 forward and at rest. The barrel body 505 is still held down because the barrel cam slider 506 has locked itself onto the receiver barrel cam 182. The bolt barrel guide grove 2063 prevents the barrel locking lug 5001 from riding up a receiver barrel cam facing slope 1823 of the receiver barrel cam 182.

Shown in FIG. 12B and in reference in FIG. 13C, the bolt 200 is free to move in recoil along the bolt guide grove 2069 on the receiver bolt guide ribs 1813. This is possible because only the rather weak driving spring 750A restrains the bolt 200 recoil travel. The weak driving spring 750A permits the bolt 200 to complete its recoil travel to the extent permitted by the bolt barrel guide grove 2063 with very little energy going into the driving spring 750A. This is important because the bolt 200 recoil travel must accomplish two critical gun functions.

1. The most demanding function is the powering of the feed system, which will be discussed in length in Section B.

2. The second but less energy demanding function is to re-cock the hammer 411 so it can fire the next cartridge 950-0.

Reference both FIG. 11A and FIG. 12A and note the relative positions of the bolt 200 and the barrel body 505. This relative difference in recoil travel distance between the bolt 200 and the barrel body 505 is important because this relative separation makes possible the extraction and ejection of the cartridge case 9504 from the automatic gun 900.

Envisioned in this embodiment case extraction and ejection is accomplished by two group of components located within two different major assemblies.

Case Extractor 208, and the Case Support 209, Component Parts of the Bolt 200

Figure 13A:
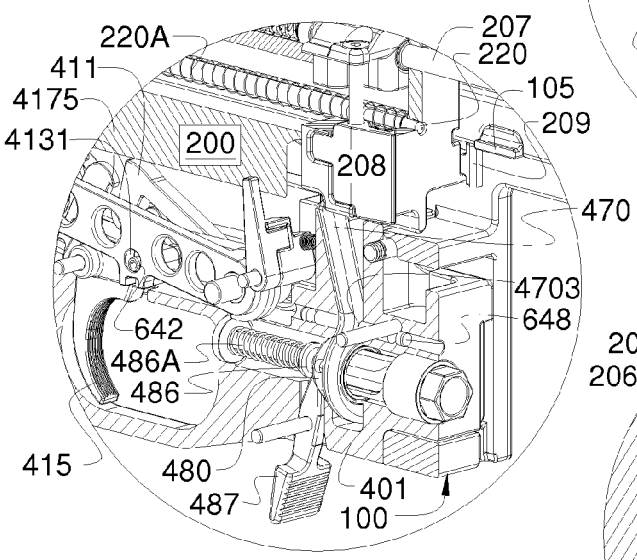
FIG. 13B is a close-up view of the bolt hold-open 413 and bolt 200.

FIG. 31A and FIG. 31B shows both the case extractor 208 and the case support 209. FIG. 13A shows that both are located in the face of the bolt 200. Both the case extractor 208 and the case support 209 work together to hold the cartridge case 9504 onto the face of the bolt 200 after the barrel body 505 has been unlocked from the bolt 200. While the barrel body 505 is locked to the bolt 200 the barrel face cam surface 5004 cams out and out of engagement with the cartridge rim 9501 both the case extractor 208 and case support 208.

FIG. 11A, and FIG. 12A show that the relative movement of the bolt 200 in recoil travel to the barrel body 505 is greater and this separation between the bolt 200 and the barrel body 505 pulls the fired cartridge case 9504 from the barrel chamber 5003. This style of case extraction is well know to those of ordinary skill in the art and is usually referred to as a spring-loaded extractor.

As envisioned in this embodiment the automatic gun 900 is not limited in using this style of extractor. The automatic gun 900 in this embodiment can also use either a style called a fixed extractor or the style called a T-bolt extractor; both of which are well-known extractor styles known to those of ordinary skill in the art.

As shown in FIG. 12A after an appropriate separation between the barrel body 505 and the bolt 200 the cartridge case 9504 is pulled over a ejector 105 that can be seen clearly in FIG. 13A.

Ejector 105, Component Part of the Receiver Body 101

Clearly seen in FIG. 13A, and FIG. 15A the ejector 105 is the second component of the extraction and ejection cycle envisioned and shown in this embodiment. As shown in FIG. 30 the ejector 105 is located in the receiver left side plate 180, which is part of the receiver body 101.

The ejector 105 shown in FIG. 13A, and referenced to in FIG. 30, protrudes from the inside left face of the receiver housing 120 to strike the cartridge head 9502 as the case extractor 208 drags it pass. Striking of the cartridge head 9502 by the ejector 105 causes the cartridge case 9504 to rotate about the cartridge rim 9501 that is under the case extractor 208—thus ejecting the cartridge case 9504 from the gun.

This style of case ejection is well know to those of ordinary skill in the art and is usually referred to as a fixed ejector. The automatic gun 900 of this embodiment is not limited to use a fixed ejector. The automatic gun 900 in this embodiment can also use a spring-loaded ejector and other ejector styles that are known to those of ordinary skill in the art.

FIG. 12A with reference to FIG. 39B shows the feed drive components. The feed cam path 2061 shown in FIG. 31B starts to move aft relative to the feed drive flipper 470 as soon as the bolt 200 starts its recoil. However the feed cam path 2061 will not start to rotate the feed drive flipper 470 until after the bolt 200 is unlocked from the barrel 500. The rate of change of the feed cam path 2061 shown in FIG. 31B is slow and imparts a constant acceleration to the feed drive flipper 470 over the full length of the working stroke. The rotation of the feed drive flipper 470 is timed to finish rotating the fresh cartridge 950-0 into the front of the bolt 200 only after the cartridge case 9504 has been ejected from the receiver 100.

FIG. 12A shows the relative position of the feed drive flipper 470 and the other visible feed drive components in the bolt 200 recoil cycle when the fired cartridge case 9504 is being ejected. The feed drive flipper 470 is shown past midway in its rotational movement of the feed ratchet 480 and the feed drive shaft 486.

As shown in FIG. 39B and explained in detail in the feed drive section the oscillatory rotation of the feed drive flipper 470 drives the flipper ring gear teeth 4701 and through them the feed ratchet gear teeth 4801. The oscillatory rotation of the feed ratchet 480 through the ratchet cog 482 converts the oscillatory rotation into intermittent directional rotation of the feed drive shaft 486.

FIG. 12B shows that while the cartridge case 9504 is being ejected from the gun the barrel body 505 is not in recoil and the barrel cam slider 506 is locked onto the receiver barrel cam 182. The cartridge guide 507 is now fully extended from the barrel body 505.

FIG. 13 Shows the Start of the Second Recoil Cycle of the Barrel Body 505.

Unlike other automatic guns in use today the automatic gun 900 in this embodiment does not use a receiver, a driving spring, or a bolt buffer to stop the recoil travel of its bolt. The Armalite AR18 assault rifle described in the Miller U.S. Pat. No. 3,318,192 characterizes the use of the receiver to stop the recoil travel of the bolt. The assault rifle described in the Sullivan U.S. Pat. No. 4,502,367 characterizes the use of the driving spring to stop the bolt. The US M16 assault rifle characterizes the use of a bolt buffer to stop the recoil travel of the bolt.

Figure 13B:
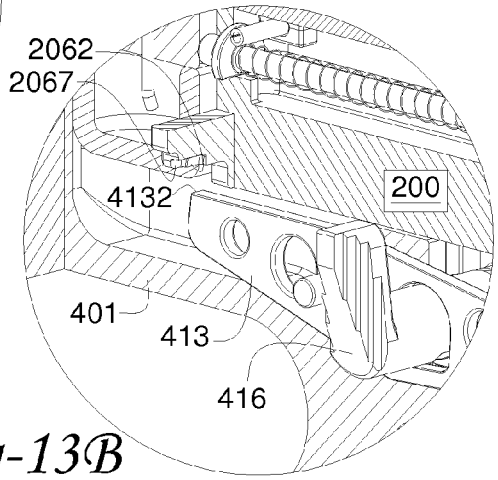

FIG. 13B shows the bolt 200 has recoiled far enough to be behind the bolt hold-open 413 and the bolt hold-open sear tang 2062. If the trigger 415 identified in FIG. 13A was to be released the bolt hold-open 413 could then rotate up to let the bolt hold-open sear 4132 engage the bolt hold-open sear tang 2062.

As shown in FIG. 20A when the trigger 415 is released the hammer trigger sear 4115 will engage the trigger hammer sear 4155 and hold the trigger 415 in the cocked position. However if the trigger 415 is still held aft the bolt hold-open 413 is held down thus letting the bolt 200 go into the counter-recoil cycle while the hammer 411 is held from falling by the auto-sear hammer sear 4195 engaged into the hammer auto-sear notch 4119.

FIG. 13C shows that when the automatic gun 900 of this embodiment is operating the bolt 200 will never strike the receiver 100 at the end of its recoil stroke. As shown in FIG. 13C and unique to the automatic gun 900 of this embodiment the bolt 200 is stopped in recoil travel only by the barrel lug stopping face 5008 and through the barrel body 505 the barrel spring 503. No other automatic gun has used or is using this unique method of stopping the recoil travel of bolt.

The advantage of this unique method of stopping a bolt is that there is no spike recoil load from the impact of the stopping the bolt transferred into the receiver. The absents of bolt slap and other features discussed below means that as the automatic gun 900 in this embodiment fires there is no kick felt by the user shooting the gun. The user only feels a protracted push. The absence of recoil spikes not only makes the automatic gun 900 more comfortable to shoot but it also permits the automatic gun 900 to be controlled while firing in the automatic mode.

The unique recoil system that delivers to the user only a protracted push is made possible by the careful blending of three separate design features unique to the automatic gun 900 shown in this embodiment.

1. The first reason is because of the use of the short recoil operating action. The short recoil action allows the lockup to move in free recoil from the instance of firing. This free recoil prevents the transference of the firing spike load into the receiver 100 when the cartridge fires. In ALL gas-operated gun actions the lockup cannot recoil at the moment of firing because the barrel is fixed to the receiver. At the instance of cartridge firing the cartridge firing impulse is transmitted directly into the receiver as a firing spike load—and through the receiver onto the user shooting the gun. Spike loading from the cartridge firing impulse is present in all gas-operated gun actions; it is impossible not to have it or to stop it from occurring.

2. The second reason is because only the barrel spring 503 and not the receiver 100 stop the recoil of the barrel body 505. In the automatic gun 900 shown in this embodiment the barrel body 505 after it is unlocked from the bolt 200 is left to recoil freely until it is slowed down and eventually stopped by the barrel spring 503. Thus the recoil of the barrel body 505 is stopped without striking the receiver 100.

Unlike other short and long recoil operated gun actions the barrel body 505 of the automatic gun 900 shown in this embodiment does not produce spike loads when it is stopped in recoil travel.

3. Third reason is that the barrel body 505 and through it the barrel spring 503 stops the bolt 200 recoil travel. The receiver 100 does not stop the bolt 200 recoil travel thus preventing the occurrence of the bolt slap spike load that is common to almost all automatic guns.

FIG. 13A is a close-up view that shows the feed advance components have finished their advancement of the feed advance assemblies. The feed drive flipper 470 has been fully rotated about the feed drive flipper pivot hole 4703.

Compare the placement of the feed drive flipper 4701 in FIG. 13A and FIG. 9B to see the relative change in position. As changed from FIG. 9A the flipper ring gear teeth 4701 have continued to be rotated by the feed ratchet gear teeth 4801 of the feed ratchet 480. Also reference FIG. 39B to better see the flipper ring gear teeth 4701, feed ratchet gear teeth 4801, and the feed ratchet 480.

As shown in FIG. 13A the rotation of the feed ratchet 480 has fully rotated the feed drive shaft 486 and the feed advance power stroke is finished. In counter-recoil the bolt 200 will reset the feed advance components for the next cycle.

Special note. Because the bolt 200 is in the open-bolt position without the cartridge 950-0 present the close-up views shown in FIG. 13A and FIG. 15A are the only views that clearly show together the ejector 105, the case extractor 208, and the case support 209.

FIG. 14 Shows Maximum Barrel Recoil from the Second Barrel Recoil Cycle.

Reference back to FIG. 13C and note the impact of the bolt barrel stopping face 2064 onto the barrel lug stopping face 5008. When this impact occurs these components bounce free from each other. The barrel body 505 goes into another recoil cycle while the bolt 200 goes into counter-recoil travel. FIG. 14A is a close-up showing the placement of the barrel body 505 and the bolt 200 after this bounce has occurred. The barrel is shown in FIG. 14A at maximum recoil after impact with the bolt 200 moving forward in counter-recoil. It is the bolt 200 bounce coupled with the impetus derived from the driving spring 750A that puts the bolt 200 into counter-recoil.

FIG. 14B shows that the second recoil cycle of barrel 505 is shorter with a value of <R2> than the first barrel recoil cycle shown in FIG. 11A with a value of <R1>. FIG. 14B also shows that once again the barrel spring 503 stops the barrel body 505 secondary recoil travel.

FIG. 15 Shows the Bolt 200 Moving Forward in Counter-Recoil

FIG. 15, FIG. 15A, and FIG. 15B for the first time show the sectionalized view of the loaded single sprocket magazine 310.

FIG. 15A is a close-up showing the bolt 200 in counter-recoil positioned to ram the cartridge 950-1 forward with the bolt ram face 2068.

As shown in FIG. 21A and FIG. 21B in automatic fire mode at this stage in the operating cycle the trigger 415 is still pulled aft and holding the bolt hold-open 413 depressed. The depression of the bolt hold-open 413 prevents the bolt 200 from staying in the open-bolt position after having reached its maximum recoil travel shown in FIG. 13B.

Again as shown in FIG. 21A and FIG. 21B, since the trigger 415 is held aft it is also holding the disconnector tang 4171 of the disconnector 417 depressed against the fire control selector body 4161 of the fire control selector 416. Both the trigger 415 and the disconnector 417 are prevented from engaging the hammer 411. The auto-sear 419 is the only component holding the hammer 411 cocked.

In counter-recoil travel of the bolt 200 will reset the feed drive flipper 470 as shown in FIG. 17A and as shown in FIG. 15A strip the fresh 3½-inch shotshell 950-1 from any of the feed advance assemblies loaded into the receiver 100. All feed advance assemblies will be discussed in Section B.

FIG. 15A shows that the bolt ram face 2068 is now in a position to ram the 3½-inch shotshell 950-1 from the feed sprocket wheel 314. FIG. 15B shows that when the 3½-inch shotshell 950-1 is rammed forward it will engage and ride up the feed ramp 1009.

Reference FIG. 32F to identify the special features on the feed sprocket wheel 314. These special features are then shown on the cartridge carrier 323 in a sequence of views from FIG. 37C, FIG. 37D, and FIG. 37E. This sequence of views shows how the cartridge rim 9501 is camed up the rim feed ramp 3143.

FIG. 15B is a close-up view showing that the ramming of the 3½-inch shotshell 950-1 forward will force the cartridge nose 9503 to ride up the feed ramp 1009 of the receiver 100 and into the barrel chamber 5003 of the barrel body 505 as it is guided by the sidewalls of the feed tray 3102.

FIG. 15B also shows that the feed index plunger 309 of the single sprocket magazine 310 is fully engaged into the feed index plunger socket 1003 compressing the feed index plunger spring 309A.

FIG. 15C shows that the barrel body 505 is now forward having finished its second recoil cycle. The recoil distance of the stationary barrel body 505 is now <X>, or the same as shown in FIG. 10C after unlocking and at the start of the recoil cycle.

FIG. 16 Shows the Chambering Operation.

FIG. 16 shows the striped 3½-inch shotshell 950-1 being rammed forward to be chambered into the barrel chamber 5003. The 3½-inch shotshell 950-1 is guided into the barrel chamber 5003 by the four guides located in the following: the feed advance assemblies as represented in FIG. 16A by the single sprocket magazine 310, the bolt 200, and the barrel 500.

1. Shown in the close-up view FIG. 16B is the feed tray 3102. The feed tray 3102 is common to all the feed advance assemblies. The feed tray 3102 is identified in the feed sprocket wheel 314 shown in FIG. 32F and FIG. 32C, identified in the cartridge carrier 323 shown in FIG. 33D, and identified in the feed cover 350 shown in FIG. 34D. As shown in FIG. 16B the walls of the feed tray 3102 position and guide the 3½-inch shotshell 950-1 as it is being stripped from the feed sprocket wheel 314. Common to all feed advance assemblies the feed tray 3102 guide the cartridge case 9504 and the cartridge nose 9508 into correct align with the feed ramp 1009 and holds this alignment as the cartridge nose is ramped up the feed ramp 1009 and the cartridge case is camed up and out of the cartridge retention clamps 3147.

2. Shown in the close-up FIG. 16A are the two guides and centering components located in the bolt 200. As the 3½-inch shotshell 950-1 is pushed forward by the bolt ram 2068, the cartridge head 9502 and cartridge rim 9501 are held, centered, and restrained on the face of the bolt 200 between the case extractor 208 on the right side and the case support 209 on the left side. Unfretted views of both the case extractor 208 and the case support 209 are shown in FIG. 31A, FIG. 31B, FIG. 31C, and FIG. 31D.

The case extractor 208 and the case support 209 have dual roles. As shown in FIG. 16A the first role is to center for ramming the cartridge head 9501 as the cartridge case 9504 is camed up and out of the cartridge retention clamps 3147 located in the feed sprocket wheel 314 and the cartridge nose 9508 rides up the feed ramp 1009 and out of the guidance provided by the feed tray 3102.

As shown in the close-up view FIG. 12A and discussed the second role of the case extractor 208 and the case support 209 is the extraction and ejection of the fired cartridge case 9504 from the receiver 100.

3. Shown in the close-up view FIG. 16A and referenced in FIG. 12A the third guide is located in the bolt 200 and called the case guide 207. As shown in reference on FIG. 31A and FIG. 31B the case guide 207 is extended from the face of the bolt body 206 by the case guide spring 207A. The extended case guide 207 prevents the cartridge head 9502 from moving up into the bolt barrel locking recess 2065 of the bolt 200 during ramming causing a stovepipe jam. This style of jam is well known to those of ordinary skill in the art.

4. Shown in FIG. 16A, FIG. 16B, and referenced in FIG. 40 and FIG. 40A, the fourth guide is the cartridge guide 507 located in the barrel body 505. As shown in FIG. 16B and FIG. 40A the cartridge guide 507 is extended from the aft face of the barrel body 505 by the cartridge guide spring 507A. FIG. 16A and FIG. 16B show that the extended cartridge guide 507 prevents the cartridge nose 9503 from overshooting the barrel chamber 5003 and causing a stovepipe jam.

Close-up view FIG. 16A clearly shows that both the case guide 207 and the cartridge guide 507 are held extended by springs. Shown in FIG. 18B both the case guide 207 and the cartridge guide 507 are depressed flush when the bolt 200 and barrel 500 are locked together.

FIG. 17 Shows the Start of Locking the Barrel into the Bolt.

FIG. 17 shows the position of both the bolt 200 and the barrel body 505 at the start of the locking cycle in which the barrel 500 will lock into the bolt 200.

Close-up view FIG. 17A, and referenced in FIG. 15, FIG. 16, FIG. 21A, FIG. 21B all show the trigger 415 still pulled back preventing it and the disconnector 417 from engaging the hammer 411. The auto-sear 419 is the only component holding the hammer 411 in the cocked position.

FIG. 17A shows that the feed drive flipper 470 has been reset. The feed ratchet 480 referenced in FIG. 39B has been reset and is ready to once again rotate the feed drive shaft 486 on the next bolt 200 recoil cycle.

Close-up view FIG. 17B shows that the 3½-inch shotshell 950-1 that was being chambered in FIG. 16A and FIG. 16B is now fully chambered within the barrel chamber 5003. The case support 209 and the case extractor 208 have been camed out from the barrel centerline axis 5006 by the barrel face cam surface 5004 that are not shown in view FIG. 17B. Reference views FIG. 40 and FIG. 40A both show the barrel face cam surfaces 5004.

Close-up view FIG. 17B shows the case extractor 208 has moved out and over the cartridge rim 9501 of the chambered 3½-inch shotshell 950-1 and are in a position to engage the cartridge rim 9501 for subsequent extraction at the commences of the next bolt 200 recoil cycle.

Close-up view FIG. 17B also shows that the barrel cam slider 506 is still down in the receiver. However now the barrel 500 is able to move up and into the bolt barrel locking recess 2065. The barrel slider lock tang 5061 of the barrel cam slider 506 can now start to move up on the front receiver barrel cam locking face 1821 of the receiver barrel cam 182, pivoting upward the entire barrel assembly 500. The upward pivoting movement of the barrel 500 positions the barrel locking lug 5001 into the bolt barrel locking recess 2065, locking the barrel 500 to the bolt 200.

Reference FIG. 17B, FIG. 17C and FIG. 10A, FIG. 10C. These close-up views all show the barrel body 505 unlocked from the bolt and at the same recoil travel of <X>. Only views FIG. 10A and FIG. 10C show the operational cycle at the start of the recoil cycle, while FIG. 17B, FIG. 17C show the operational cycle at the end of the counter-recoil cycle. This is because both set of views show the bolt 200 and barrel body 505 at the end or start of the lockup cycle. As shown in FIG. 17B further forward movement of both the bolt 200 and barrel 500 will merge them both into a locked relationship as finalized and shown in FIG. 18B. Lockup transpires within the travel distance stated as <X> and shown in FIG. 17C and FIG. 10C.

FIG. 18 After Lockup and the Start of the Lockup Dwell

FIG. 18 shows the components in almost the same position as FIG. 17, however the components shown are after lockup but before firing.

Shown in close-up view FIG. 18A and reference in FIG. 9B, FIG. 20A and FIG. 21A, after lockup is finished the bolt auto-sear notch 2067 on the bolt body 206 will have moved forward enough to make contact with the auto-sear tang 4192 to rotate the auto-sear 419 forward. The forward rotation of the auto-sear hammer sear 4195 disengages the hammer auto-sear notch 4119 to allow the hammer 411 to fall and fire the chambered 3½-inch shotshell 950-1 shown in FIG. 18B. The auto-sear hammer sear 4195 and hammer auto-sear notch 4119 can only be seen on FIG. 20A and FIG. 21A.

As shown in close-up view FIG. 18A, and referenced in FIG. 22A and FIG. 22B, after the bolt auto-sear notch 2067 of the bolt body 206 has rotated the auto-sear 419 and the hammer 411 has fallen to fire the chambered round, all of the components will be in the same relative position as first shown in the FIG. 9B—which started this section on basic gun cycle of operation.

Close-up view FIG. 18B shows that the barrel locking lug 5001 of the barrel body 505 is fully engaged in the bolt barrel locking recess 2065. However FIG. 18A shows the gun cannot fire the chambered 3½-inch shotshell 950-1 because the bolt auto-sear notch 2067 on the aft face of the bolt 200 has not yet rotated the auto-sear tang 4192 forward.

After lockup the remaining forward travel left to the bolt 200 and barrel 500 locked unit is called dwell and is shown in FIG. 18C as <Y>. If the automatic fire mode has been selected firing will occur during dwell <Y>.

Special Note on Basic Gun Cycle of Operation:

Only the single sprocket magazine 310 feed advance assembly was used in the sectionalized figure series FIG. 15 through FIG. 18B. However the basic gun cycle of operation described would be the same for the dual sprocket magazine assembly 320 and the feed cover assembly 350 feed advance assemblies of this embodiment.

Operation: Section B—Introduction to the Gun Feed System.

This Section B covers the feed system and how it works. To aid clarity the description of how the feed system works has been divided into two parts:

1. Part A: describes the feed drive unit shown in FIG. 39B. The feed drive mechanism derives its operating power from the recoil of the bolt 200. The feed drive unit powers the various feed advance assemblies. The feed cam path 2061 drives the feed drive unit. All feed drive components are contained within the pistol grip 400.

2. Part B: describes the three feed advance assemblies that are shown in FIG. 32B, FIG. 33B, and FIG. 34A. The feed advance assemblies are used to transport the ammunition within the gun.

The feed system of the automatic gun 900 of this embodiment is a improvement of the feed system first described in the Rostocil U.S. Pat. No. 4,066,000. One of the principle claims of the Rostocil U.S. Pat. No. 4,066,000 was a feed system divided into a feed drive unit and a belt feed advance unit.

The division of the feed system into two separable functional units permitted the intact removal of the feed advance portion from the gun while permitting the feed drive portion to remain intact within the gun.

As described in the Rostocil U.S. Pat. No. 4,066,000 the removal of the feed advance unit permitted fast reloading of the machine gun with a linked-belt.

The feed system of this embodiment has both improved and expanded on this basic approach by adding the following unique components and features to the feed system first described in the Rostocil U.S. Pat. No. 4,066,000.

As shown in FIG. 39B the improved feed drive unit that is more rugged and positive in delivery of power the feed advance assemblies.

As shown in FIG. 32B, FIG. 33B, and FIG. 34A are the three feed advance assemblies. The link-belt fed advance assembly shown in FIG. 34A is an improvement of the feed system described in the Rostocil U.S. Pat. No. 4,066,000. The single sprocket magazine 310 and the dual sprocket magazine 320 of this embodiment are new in concept and incorporation. There were NO magazine feed advance assembly addressed in the Rostocil U.S. Pat. No. 4,066,000.

Figure 4:
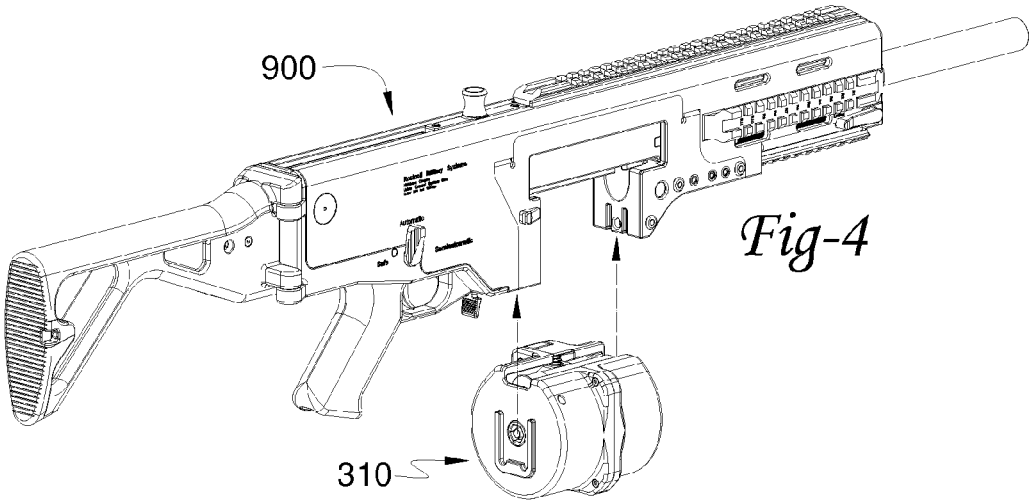
Figure 5:
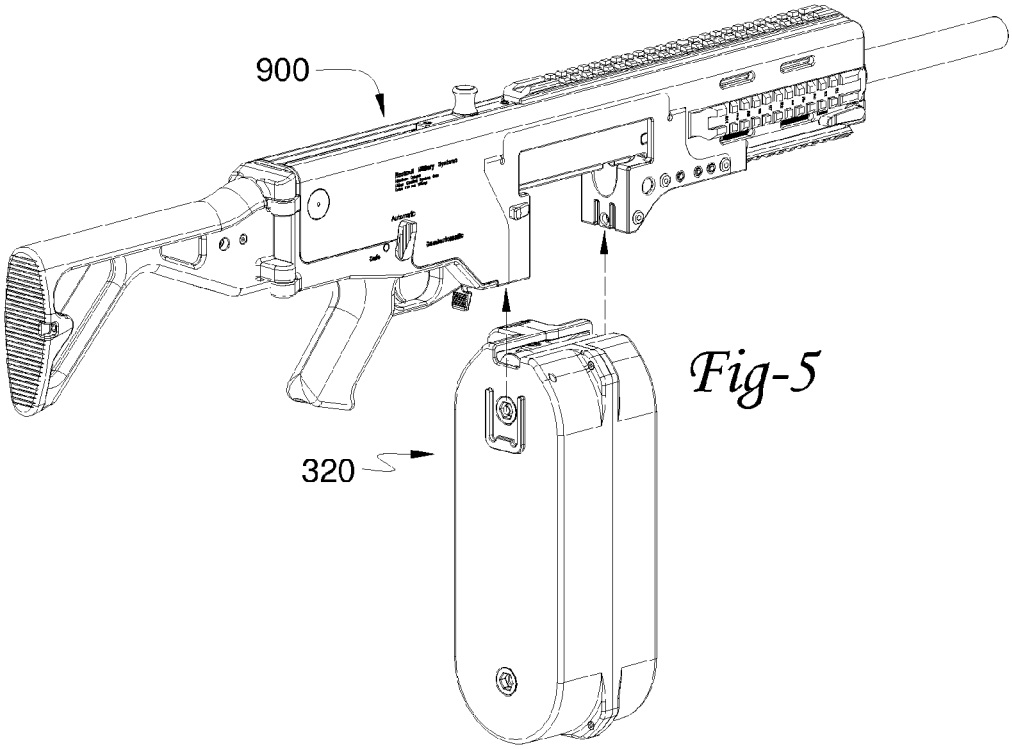
Figure 8:
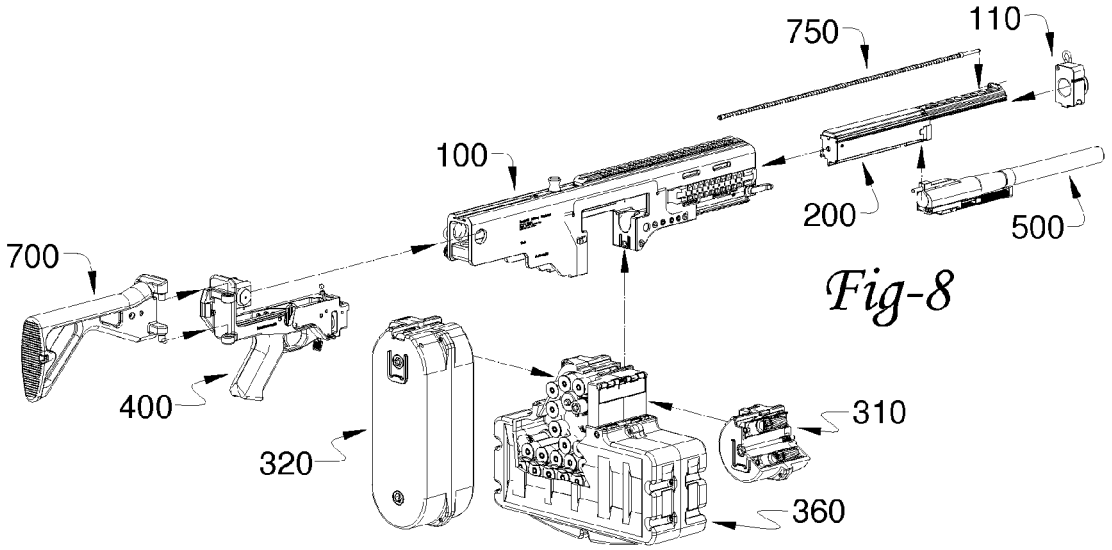

As shown in FIG. 4, FIG. 5, and FIG. 6 all feed advance assemblies of this embodiment are interchangeable with each other and use the same feed drive unit for operational power. In summary the feed advance assemblies are:

1. Feed Cover 350 and the Ready Box 360 Shown in FIG. 34A and FIG. 35.

The improved link-belt feed assembly that provides positive controls for both the linked-belt 370 and the cartridge link 371 permitting the use of shotshells in a linked-belt feed automatic gun 900 that is suitable for use as either a LMG or SAW.

As shown in FIG. 38A, and FIG. 38B the cartridge link 371 is a new and unique disintegrating push-out polymer molded configuration that incorporates the cartridge retention clamps 3147, a positive cartridge index and the cartridge retainer 3145, and the unique rim feed ramp 3143. All of these unique features are molded into the cartridge link 371 and identified FIG. 38A and FIG. 38B.

2. Single Sprocket Magazine 310 Shown Sectionalized in FIG. 32C

The unique single sprocket magazine 310 uses the unique direct drive for transport power. Unlike other magazines the single sprocket magazine 310 does not use a magazine spring to transport ammunition within the magazine.

As shown in FIG. 32F the unique rim feed ramp 3143, the cartridge retention clamps 3147, all cartridge index features are molded directly into the feed sprocket wheel 314 shown in FIG. 32B.

3. Dual or Multiple Sprocket Magazine 320 Shown in FIG. 33B

The new and unique dual sprocket magazines 320 uses the unique direct drive to power magazines of capacities greater than a single sprocket wheel can contain. The dual sprocket magazine is only presented in this embodiment as representative of the spirit of the design approach and in no way the limit of what can be done using this multiple sprocket design approach.

As shown in FIG. 33B and FIG. 33C of this embodiment the dual sprocket magazine 320 is a 20 round magazine. The dual sprocket magazine 320 uses two feed sprocket 308 to transport the cartridge carrier chain 3231 containing 20 of the cartridge carrier 323.

As shown in FIG. 33D the unique rim feed ramp 3143, the cartridge retention clamps 3147, and the cartridge retainer 3145 features are molded into the body of the cartridge carrier 323. The cartridge carrier 323 is used to transport the cartridge 950-0 within the multiple sprocket magazines.

As shown in FIG. 33B the cartridge carriers 323 are linked together by the hinge pin 3239, or other suitable means, to make the continuous cartridge carrier chain 3231 that can be any desired length. The cartridge carrier chain 3231 is driven within the magazine by the two or more feed sprockets 308 that in turn derive their rotational power from the feed drive unit. The timing belt 635-1 is used within the dual or multiple sprocket magazines 320 to time the feed sprocket 308 together and provide rotational power all feed sprockets 308.

Operation: Section B Gun Feed System; Part A Feed Drive Unit:

As shown in the view FIG. 39B the feed drive components are all contained within the pistol grip 400 and common to all feed advance assemblies.

As shown in FIG. 31B the feed cam path 2061 is located on the bottom of the bolt 200 and is used to translate the bolt 200 linear movements into rotational movement within the feed drive unit.

Obvious to those of ordinary skill in the art the feed drive unit is driven by the recoil stroke of the bolt 200 and reset on the counter-recoil stoke.

Feed Cam Path 2061

The feed cam path 2061 that is shown in FIG. 31B is shaped so that it will provide a constant acceleration to the feed drive flipper 470 and the feed ratchet assembly 480. A constant acceleration of the feed drive unit is desired because it keeps the stress levels in the cartridge links 371 and the cartridge carriers 323 at the lowest level possible during feed advance. This is very important since the cartridge links 371 and the cartridge carriers 323 are made from polymer materials.

As shown in FIG. 13A the feed cam path 2061 is timed with the bolt 200 recoil movement so as not to have the feed drive unit position a round into the path of the bolt 200 during recoil travel.

As shown in FIG. 31B the feed cam path 2061 envisioned in this embodiment is cut in a single flat plane parallel to the horizontal plane of the gun.

Feed Drive Unit Planetary Gears

FIG. 9B and FIG. 39B show that the feed drive flipper 470 is part of the planetary gear cluster housed within the pistol grip 400. As the bolt cam path 2061 translates in recoil and counter-recoil it drives the feed drive flipper 470 to pivot around the feed drive flipper pivot hole 4703 on the feed drive flipper pivot pin 648.

In this embodiment the feed drive flipper 470 transcribes an arc of approximately 30 degrees—approximately 15 degrees on each side of the gun vertical centerline axis.

Shown from FIG. 9B to FIG. 13A and referenced in FIG. 39B the approximate 30 degrees of feed drive flipper 470 arc is magnified by a segment of the flipper ring gear teeth 4701 to a segment of feed ratchet gear teeth 4801 located on the feed ratchet 480. Both the flipper ring gear teeth 4701 and the meshing feed ratchet gear teeth 4801 are clearly shown in FIG. 9B.

After magnification the original 30 degrees of the feed drive flipper 470 rotation has been changed into approximately 64 degrees of the feed ratchet 480 rotation. As clearly shown in FIG. 13A and FIG. 39B the planetary gear arrangement is made possible because the feed drive flipper 470 pivots on the feed drive flipper pivot pin 648 while the feed ratchet 480 pivots over and on the feed drive shaft 486.

Again in the FIG. 13A and FIG. 39B views show that the oscillatory rotational movement of approximately 64 degrees by the feed ratchet 480 transfers an intermittent directional rotation through the ratchet cog 482 into the feed drive shaft 486. The ratchet cog 482 and its ratchet cog spring 482A are within the feed ratchet 480 and provide the directional rotation.

The close-up view FIG. 13A shows that the feed drive shaft 486 is spring-loaded by the feed drive shaft spring 486A to the extended position. The magazine release lever 487 restrains the extended movement of the feed drive shaft 486.

Also shown in the close-up view FIG. 13A the feed drive shaft 486 is allowed to extend from the front face of the pistol grip body 401. As shown in FIG. 15A the forward extension of the feed drive shaft 486 allows it to extend into the hex drive socket 3081 located on the aft face of the feed sprocket wheel 314. When the feed drive shaft 486 is extended into either the feed sprocket wheel 314 or the feed sprocket 308 hex drive socket 3081 it not only provides rotational power but it also holds the feed advance assemblies up in the magazine well zone 1007 as seen in FIG. 29.

As shown in FIG. 13A and FIG. 15A to remove the feed advance assemblies from the automatic gun 900 the magazine release lever 487 located in the pistol grip 400 is pushed forward. Forward movement of the magazine release lever 487 pulls the feed drive shaft 486 back and out of the hex drive socket 3081 on either the feed sprocket wheel 314 or the feed sprocket 308. Once the feed drive shaft 486 is retracted the feed advance assemblies will drop from the bottom of the receiver 100 as shown in FIG. 4, FIG. 5 and FIG. 6.

As shown in FIG. 4, FIG. 5, and FIG. 6 because the feed advance assemblies drop down from the gun the position of the bolt 200 is not critical. The feed advance assemblies can be removed with the bolt 200 in either the closed-bolt or the open-bolt position. The automatic gun 900 can even be jammed for some unknown reason that prevents the bolts 200 movement and still the feed advance assemblies can be removed from the gun.

Operation: Section B Gun Feed System, Part B Feed Advance System

As described in the introduction to section B, there are three different feed advance assemblies for the automatic gun 900 shown in this embodiment. The three feed advance assemblies are:

1. The single sprocket magazine 310.
2. The dual (or multiple) sprocket magazine 320.
3. The feed cover 350 & the ready box 360 using the linked-belt 370.

Common to the entire feed advance assemblies described in this embodiment are the following unique features.

Cartridge Retention:

As shown in FIG. 32F, FIG. 33D, and FIG. 38B the cartridge is securely retained to the proper location within the feed sprocket wheel 314, the cartridge carrier 323 and the cartridge link 371 by two separate design features that are common to all.

Cartridge Retention Clamps

As shown in FIG. 32F, FIG. 33D, FIG. 38A and FIG. 38B the cartridge retention clamps 3147 provide positive cartridge retention. The cartridge retention clamps 3147 prevent the cartridge 950-0 from moving up and out of the cartridge pocket 3142 that is molded into the feed sprocket wheel 314, the cartridge carrier 323, or the cartridge link 371.

FIG. 32F shows that on the 6 pockets feed sprocket wheel 314 there are 6 sets of the cartridge retention clamps 3147.

FIG. 33D shows that on the cartridge carrier 323 there are a set of two cartridge retention clamps 3147.

FIG. 38B shows that on the cartridge link 371 the cartridge retention clamps 3147 are grouped into sets of two in three locations.

The cartridge retention clamps 3147 serve the same function as the feed lips of a magazine or the retaining hoops on a side stripping metal cartridge link. The major difference in the design in this embodiment is that the cartridge retention clamps 3147 are molded from a polymer material.

As shown in FIG. 33D, FIG. 38A and FIG. 38B, additional clamping force from the metal stiffing spring clip 656 can be added to the cartridge carrier 323 and the cartridge link 371. The feed sprocket wheel 314 shown in FIG. 32F does not require the use of the metal stiffing spring clip 656.

Cartridge Rim Retainer

The cartridge retainer 3145 is a grove that is molded into the aft surface of the feed sprocket wheel 314, the cartridge carrier 323 or the cartridge link 371.

As shown in FIG. 32F, FIG. 33D and FIG. 38B when the cartridge is seated in the cartridge pocket 3142 the cartridge retainer 3145 locates and holds the rim of the cartridge 9501 to prevent it from moving aft. The front slope of the cartridge retainer 3145 is ramped forward to permit it to work in conjunction with the rim feed ramp 3143.

When the round is pushed forward both the cartridge retainer 3145 and the rim feed ramp 3143 works together to cam the cartridge 950-0 up and out of the cartridge retentions clamps 3147.

The cartridge rim retainer assures that the correct location of the shotshell is accomplished regardless of the length of shotshell used. This is because both the cartridge retainer 3145 and the cartridge retention clamps 3147 work together to hold the cartridge in and located it in the correct relative location within the feed sprocket wheel 314, the cartridge carrier 323, or the cartridge link 371.

Holding the same and correct location of the cartridge head 9502 from one shot to the next is very important for reliable feeding. This critical function is made even more important because the length of the shotshell can vary from under 2¾-inches to as much as 3½ inches.

In the automatic gun 900 of this embodiment any mix of shotshell lengths can be loaded into the feed system at any one time. The variable length of the shotshells used does not affect the gun in this embodiment because the cartridge retainer 3145 locates the rim of the shotshell in the same location for every round loaded.

Rim Feed Ramp:

As shown in, FIG. 32F, FIG. 33D and FIG. 38B the rim feed ramp 3143 is molded into the cartridge pocket 3142 of the feed sprocket wheel 314, the cartridge carrier 323 or the cartridge link 371. The rim feed ramp 3143 is located just forward from the cartridge retainer 3145 and slopes upward towards the cartridge retention clamps 3147.

The sequence of three consecutive views FIG. 37C, FIG. 37D and FIG. 37E the movement of the 3½-inch shotshell 950-1 forward that shows forward movement of the cartridge rim 9501 onto the rim feed ramp 3143 cams the cartridge case 9504 up and out of the cartridge retention clamps 3147.

Shown in FIG. 37C and FIG. 37D the 3½-inch shotshell 950-1 as it is pushed forward is also being camed up and out of the cartridge retention clamps 3147. As shown in FIG. 16A as the rim feed ramp 3143 is pushing the 3½-inch shotshell 950-1 up by the cartridge rim 9501 the feed ramp 1009 located in the receiver 100 is pushing the cartridge nose 9503 of the 3½-inch shotshell 950-1 up and out of the feed tray 3102. Thus both the cartridge head 9502 and the cartridge nose 9503 lift the 3½-inch shotshell 950-1 up and out of the feed tray 3102. As shown in FIG. 16A the 3½-inch shotshell 950-1 is lifted upward almost level into alignment with the barrel chamber 5003.

The rim feed ramp 3143 feature provides two critical functions.

First as shown in FIG. 37E the rim feed ramp 3143 cams the 3½-inch shotshell 950-1 up and out of the cartridge retention camps 3147 that holds it into the feed sprocket wheel 314, the cartridge carrier 323 or the cartridge link 371.

Second as shown in FIG. 37E the rim feed ramp 3143 cams the cartridge 950-0 up to bring the axis of the 3½-inch shotshell 950-1 into closer alignment with the barrel chamber 5003.

As shown in FIG. 16A using the rim feed ramp 3143 allows the 3½-inch shotshell 950-1 to begin the feed ramping function much sooner in the counter-recoil cycle than other link-belt feed systems would have permitted.

As FIG. 16A shows even before the 3½-inch shotshell is ¼ of the way forward out of the cartridge link 371 the cartridge case 9504 has been lifted up out of engagement with the cartridge retention clamps 3147 and moved vertically into near axial alignment with the barrel chamber 5003. Early cartridge feed ramping allows the bolt 200 shown in this embodiment to move a shorter recoil distance than other link-belt fed machine guns.

It is common design practice in other belt feed automatic guns that use the push forward or side stripping link design that the fresh cartridge is fully stripped from the link retention clamps before feed ramping of the cartridge starts. In practice this has resulted in a minimum distance from the front of the link-belt to the barrel chamber face of 1 to 2 cartridge lengths. Using the rim feed ramp 3143 the automatic gun 900 of this embodiment shortened this distance to less than one-half (½) cartridge length.

Foreshortening the cartridge 950-0 ramping distance and the style of short recoil the bolt 200 to the barrel 500 lock system used in the automatic gun 900 of this embodiment has permitted the foreshortening of bolt 200 recoil travel. The gun of this embodiment requires the bolt 200 to recoil of only 1½ cartridge lengths to obtain cyclic operation. Most LMG's require 4 to 6 cartridge lengths of bolt recoil to obtain cyclic operation.

The shorter bolt 200 recoil stroke used in the automatic gun 900 of this embodiment directly translated into a high rate of fire obtained with a low bolt 200 recoil velocity. The lower bolt 200 recoil velocity permitted the use of polymers to fabricate functional components that otherwise would have had to be fabricated from metal.

Loading and Unloading the Feed Advance Assemblies.

The same procedure is used to load the automatic gun 900 in this embodiment with the single sprocket magazine 310 FIG. 4, the dual sprocket magazine 320 FIG. 5, or the feed cover 350 FIG. 6. The procedure is as follows.

1. First check that the automatic gun 900 has been cleared of any feed advance assemblies. If there is a feed advance assembly installed remove it before proceeding. Removal of feed advance assemblies is covered in the unloading section located at the end of this sub-section.

2. As shown in FIG. 12A rotate the fire control selector arm 4165 to automatic position, which is vertical in automatic gun 900 shown in this embodiment.

3. Reference FIG. 29A. If the bolt 200 is not in the open-bolt position grab a charger handle 142 and pull the gun charger 140 aft to charge the automatic gun 900.

4. As shown in FIG. 11B after charging the fire control selector arm 4165 can be left in the automatic mode or rotated to point aft for the safe mode. Either fire control modes will work and are safe to use for the loading operation.

5. Shown in FIG. 32D, FIG. 32E, FIG. 33A, FIG. 34C and FIG. 34D are the magazine lips 3101 that are aligned with the magazine lip slots 1005 shown in FIG. 29 and FIG. 12A.

6. As shown in FIG. 4, FIG. 5, and FIG. 6, from the bottom of the receiver 100 the feed advance assemblies are inserted vertically into the magazine well zone 1007 shown in FIG. 29.

7. Inserting the feed advance assemblies vertically into the magazine well zone 1007 cams back into the pistol grip 400 the feed drive shaft 486.

8. As shown in the close-up view FIG. 15A when the feed advance assemblies are fully seated in the receiver 100 the feed drive shaft 486 will snap forward into the hex drive socket 3081 located on the aft face of either the feed sprocket wheel 314 or the feed sprocket 308.

9. Shown in the close-up view FIG. 15B the movement of the feed drive shaft 486 into the hex drive socket 3081 pushes the feed index plunger 309 forward from the feed advance assemblies and into the feed index plunger socket 1003 located in the receiver 100.

10. As shown in FIG. 15A and FIG. 15B the feed advance assemblies are now securely held on the aft face by the feed drive shaft 486 and on the front face by the feed index plunger 309. The magazine lips 3101 keyed in the magazine lip slots 1005 prevent the feed advance assemblies from rotation around the axis of the feed drive shaft 486.

The automatic gun 900 is now loaded and ready to be fire from the open-bolt position, or the fire control selector arm 4165 rotated forward to fire the automatic gun in the semiautomatic fire.

Unloading.

To unload any of the feed advance assemblies from the automatic gun 900 the magazine release lever 487 as shown in FIG. 12A is pushed forward. Pushing the magazine release lever 487 forward pulls the feed drive shaft 486 aft and out of engagement in the hex drive socket 3081. Once the feed drive shaft 486 is free of the hex drive socket 3081 the feed advance assemblies will drop free of the magazine well zone 1007.

Feed advance assemblies can be removed from the automatic gun 900 at any time. Feed advance assemblies can be removed loaded with ammunition or empty, with the bolt 200 in either the open-bolt or closed-bolt position.

Direct Drive.

The magazine assemblies in this embodiment do not require magazine springs to operate. The automatic gun 900 directly powers all versions of feed advance assemblies shown in this embodiment. Not requiring a magazine spring is unique to all drum magazines and box magazines in use today.

The feed advance magazine assemblies of this embodiment use only the feed drive unit to provide direct drive power. FIG. 15A shows the feed drive shaft 486 engaged into the feed sprocket wheel 314 of the single sprocket magazine 310.

Direct drive means that there is no magazine spring to weaken or break—either of which will render the magazine useless.

Loading Cog.

Shown in FIG. 32C for the single sprocket magazine 310, FIG. 33C for the dual sprocket magazine 320, and FIG. 34B for the feed cover 350, is the loading cog 317 that is common to all feed advance assemblies shown in this embodiment.

The loading cog 317 is used to permit the feed sprocket wheel 314 or the feed sprocket 308 to rotate in only one direction. In all feed advance assemblies the loading cog 317 is located on the upper left side of the feed advance housing. The loading cog 317 is pushed down by the loading cog spring 317A. From the down position it blocks the back rotation of the feed sprocket 308 or the feed sprocket wheel 314. Blocking back rotation of either the feed sprocket wheel 314 or the feed sprocket 308 permits the feed drive unit discussed above to reset as the bolt 200 moves forward in counter-recoil.

Feed Advance Assembly—the Single Sprocket Magazine 310.

FIG. 32B shows all of the components comprising the single sprocket magazine 310. FIG. 32C shows a sectioned view of an assembled and loaded single sprocket magazine 310. FIG. 32D, FIG. 32E, and FIG. 32A are provided to further identify components and define special features.

As seen in FIG. 53B the single sprocket magazine 310 is very simple in assembly and operation. Within the single sprocket magazine 310 each cartridge is contained within the cartridge pocket 3142 molded into the feed sprocket wheel 314. The feed sprocket wheel 314 in this embodiment uses the six cartridge pockets 3142. However the number of the cartridge pockets 3142 in the feed sprocket wheel 314 can be increased or decreased as desired.

As shown in FIG. 16A the bolt ram 2068 will ram the fresh 3½-inch shotshell 950-1 forward from the cartridge pocket 3142 and up the rim feed ramp 3143 that is molded into the aft face of the feed sprocket wheel 314. The rim feed ramp 3143 is described in the rim feed ramp section. The cartridge retention clamp 3147 and the cartridge retainer 3145 features are explained in detail in cartridge retention and retainer.

As shown in FIG. 32F these unique features are molded into each of the cartridge pockets 3142 of the feed sprocket wheel 314.

Loading and Unloading the Single Sprocket Magazine 310

As shown in FIG. 32A to load the single sprocket magazine 310 the fresh cartridge 950-0 is pressed into the empty cartridge pocket 3142 of the feed sprocket wheel 314. Then the loading cog 317 is depressed to permit the feed sprocket wheel 314 to be hand rotated back to store the cartridge 950-0 within the single sprocket magazine 310. This sequence is repeated until the single sprocket magazine 310 is full.

To unload the single sprocket magazine 310 the cartridge 950-0 is pulled up and out of the cartridge retention clamp 3147. Then the feed sprocket wheel 314 is hand advanced to permit the removal of the next cartridge 950-0. This sequence is repeated until the single sprocket magazine 310 is empty.

Polymer Component Fabrication

Unlike the feed cover described in the Rostocil U.S. Pat. No. 4,066,000 that was made from metal, the single sprocket magazine 310 shown in this embodiment is molded entirely from polymer materials. Only the 2 springs used are made from metal. This is possible because the components used in the single sprocket magazine are not designed to be machined from metal but rather molded from polymers.

The strength requirements for the feed advance assemblies are less due to the lower bolt 200 velocity made possible by the use of the rim feed ramp 3143 and lockup design. The use of polymer materials for the fabrication of the components of the single sprocket magazine 310 permit it to be low in weight, low in fabrication cost, and able to withstand extreme environmental conditions.

Feed Advance Assembly; the Dual Sprocket Magazine 320

FIG. 33B shows the components comprising the dual sprocket magazine 320 and to identify those components and define special features. FIG. 33C shows the assembled dual sprocket magazine 320 with the aft housing body 321 removed. FIG. 33A shows how to load the dual sprocket magazine 320.

As shown in FIG. 33B and FIG. 33C the dual sprocket magazine 320 is simple in assembly and operation. Within the dual sprocket magazine 320 each of the cartridges 950-0 are contained in the cartridge carrier 323. The cartridge carriers 323 are linked together with the hinge pin 3239 into making the cartridge carrier chain 3231.

As shown in FIG. 33B a set of two of the feed sprocket 308 are used to transport the cartridge carrier chain 3231 within the dual sprocket magazine 320. In this embodiment the 20 cartridge carriers 323 were used to make the cartridge carrier chain 3231, however the quantity of the cartridge carriers 323 can be increased or decreased as desired.

To power the dual sprocket magazine 320 the feed drive shaft 486 plugs into the hex drive socket 3081 of the top feed sprocket 308.

Shown in the view FIG. 33B the timing belt 635-1 is used to transfer power from the top feed sprocket 308 to the bottom feed sprocket 308. The timing belt 635-1 also keeps the top and bottom feed sprocket 308 timed together without depending upon the carrier chain 3231 to do this critical function.

The bolt ram 2068 shown in FIG. 15A will strip the fresh 3½-inch shotshell 950-1 from a cartridge carrier 323 as shown in FIG. 33D. As shown in FIG. 37E the cartridge 950-0 will move up the rim feed ramp 3143 of the cartridge carrier 323. The rim feed ramp 3143, the cartridge retention clamps 3147, and the cartridge retainer 3145 features are explained in the rim feed ramp and the cartridge retention and rim retainer sections. As shown in FIG. 33D all of these unique features are molded into the cartridge carrier 323.

Loading and Unloading the Dual Sprocket Magazine 320

As shown in FIG. 33A to load the dual sprocket magazine 320 simply push the cartridge 950-0 into the empty cartridge carrier 323. Then depress the loading cog 317 to permit hand back rotation of the cartridge carrier chain 3231 to store the fresh cartridge 950-0 within the dual sprocket magazine 320.

Since the top and bottom feed sprockets 308 are timed together by the timing belt 635-1 the rotation of the top feed sprocket 308 will also rotate the bottom feed sprocket 308 and move the entire carrier chain 3231. This loading sequence is repeated until the dual sprocket magazine 320 is loaded.

To unload the dual sprocket magazine 320 the cartridge 950-0 is pulled up and out of the cartridge carrier 323. Then the carrier chain is advanced to permit the removal of the next cartridge. This unloading sequence is repeated until the dual sprocket magazine 320 is empty.

Polymer Component Fabrication

Unlike the feed cover described in the Rostocil U.S. Pat. No. 4,066,000 that was made from metal, the dual sprocket magazine 320 shown in this embodiment is molded entirely from polymer materials. Only the 2 springs used are made from metal. This is possible because the components used in the dual sprocket magazine were not designed to be machined from metal but rather molded from polymers.

The strength requirements for the feed advance assemblies are less due to the lower bolt 200 velocity made possible by the use of the rim feed ramp 3143 and lockup design. The use of polymer materials for the fabrication of the components of the dual sprocket magazine 320 permit it to be low in weight, low in fabrication cost, and able to withstand extreme environmental conditions.

Feed Advance Assembly; Feed Cover 350, Ammo Box 361, and Ready Box 360

The link-belt feed system shown in this embodiment is an improvement on the basic design concepts described in the Rostocil U.S. Pat. No. 4,066,000. In that patent when the feed cover was loaded and attached to the ammo can it made what was called a ready box. The feed cover 350, the ammo box 361, and the ready box 360 of this embodiment take the original design concepts as described in the Rostocil U.S. Pat. No. 4,066,000 and add new features and new components to greatly improve the versatility, performance, cost of fabrication, and serviceability of the link-belt feed system.

FIG. 34A shows how the components of the feed cover 350 are assembled and relate to each other.

FIG. 35 and FIG. 35A shows how the ready box 360 is assembled using the feed cover 350 and the ammo can 361. FIG. 6 shows how the ready box 360 is loaded into the automatic gun 900.

For clarity this explanation of the link-belt feed is divided into two Sections.

- The feed cover 350: This sub-section describes the feed cover 350 and how it works. The unique polymer cartridge link 371 is also described along with its unique features.
- The ready box 360 & the ammo box 361: This sub-section describes how the feed cover 350 is loaded with the link-belt 370 and then attached to the ammo box 361 to create the ready box 360.

The Feed Cover 350

FIG. 34A shows how the feed cover 350 components are assembled. FIG. 34B is a sectioned aft view of the feed cover 350 identifying features.

The basic design concept of the Rostocil U.S. Pat. No. 4,066,000 was to use a removable feed cover that contained a feed sprocket to advance a link-belt of from an attached ammo box. In the Rostocil U.S. Pat. No. 4,066,000 this assembled unit of the feed cover and ammo box was called the ready box.

However how the feed cover 350 works and the addition of the secondary link-belt sprocket 354, the loading cog 317, and cartridge link 371 guidance and control features are all unique to the feed cover 350 shown in this embodiment.

The feed cover 350 components of this embodiment are molded from polymer materials, and this fabrication method different from the metal feed cover components described in the Rostocil U.S. Pat. No. 4,066,000.

The following covers the new components and unique features of the feed cover 350 shown in this embodiment.

Secondary Link-Belt Sprocket 354:

The feed sprocket in the original feed cover Rostocil U.S. Pat. No. 4,066,000 brought a metal link-belt into the feed cover directly over a single pivot point—the feed sprocket—to presented a fresh cartridge for ramming in the feed sprocket 12 o'clock position.

The problem with the Rostocil U.S. Pat. No. 4,066,000 approach was the cartridge links of the first and second cartridges were not flat with each other but draped over the sprocket at 30 degrees.

The 30 degrees angle between links occur because the basic disintegrating link design approach pivots the link around the cartridge centerline. The disintegrating link uses two sets of clamping hoops to bridge between two cartridges to form a linked-belt of cartridges. The distance between these two cartridge hoops define the belt pitch, which is defined as the distance between two adjacent rounds.

The problem with using a single feed sprocket as the axis of pivot for the link-belt being fed is that the two links that clamp onto the cartridge being fed do not align together their retention hoop clamp openings. When using a feed sprocket with 6 cartridge pockets as in the original Rostocil U.S. Pat. No. 4,066,000, the mis-alignment is 30 degrees.

To permit the two links to align their hoop openings then either one of the two following design approaches must be used:

1. First design approach is represented in the HK21 machine gun by HECKLER & KOCH. In the HK21 the feed sprocket is offset from the gun vertical centerline by one link-belt pitch. From the offset location the feed sprocket pulls in the link-belt and then pushes on a horizontal plane a fresh cartridge over to the gun centerline. This design approach involves putting the cartridge to be fed on top of or under a spring-loaded feed roller to push the fresh cartridge either up or down into a feed tray. Once in the feed tray the bolt strips the cartridge from the two sets of aligned link hoops. In the HK21 the feed sprocket also need to be spring-loaded vertically to push the fresh linked cartridge into the feed tray.

The major problem with this design approach is that the feed sprocket must be offset one belt pitch or more from the gun vertical centerline, forcing the feed drive unit in the gun to be offset by the same amount. The offset of the feed drive unit in the gun and requiring the spring loading of both the feed sprocket and the feed roller all goes to making this style of sprocket feed complex. It also can increase the overall width of the receiver. In a gun firing a 12 gauge shotshells the head diameter is over 24 mm and the increased in receiver width to use this design approach would be prohibitive.

2. The second design approach is to have the cartridge link clock one of the hoop openings to match the mis-alignment. In a 6 position feed sprocket that would mean a clocking of 30 degrees from vertical. If clocked 30 degrees then at the 12 o-clock position on the feed sprocket the two cartridge link hoops would be in alignment.

The problem with this design approach is that the strength of the cartridge link is compromised. When the linked-belt is pulled it will come apart because the link hoop that is offset from the vertical when pulled is no stronger than the side striping force.

This limitation becomes crucial when the cartridge link is molded from polymer materials. The strength and modulus of polymer material cannot match the strength and modulus of spring steel. Thus polymer cartridge links are inherently weaker than comparable links made from steel. If a polymer cartridge link is to be used then offsetting any of the retention clamp openings from the vertical is not a prudent design approach.

So what is left if the above two design approaches cannot be used?

The sectionalized view FIG. 34B shows the feed cover 350 of this embodiment. The problem is overcome by the addition of the driven secondary link-belt sprocket 354 to the feed cover 350. The secondary link-belt sprocket 354 is used to pull the linked-belt 370 into the feed cover 350, while the feed sprocket 308 is used to position the cartridge link for ramming. The feed sprocket 308 is driven by the feed drive shaft 486 and through the timing belt 635-1 drives the secondary link-belt sprocket. This arrangement allows the cartridge links 371 to be horizontal and the feed drive to remain on the centerline of the gun. For feed ramming the cartridge hoops will be in vertical alignment and the strength of the cartridge link 371 is not compromised.

Loading Cog 317

Shown in the sectionalized view FIG. 32B is the loading cog 317, another added improvement to the original Rostocil U.S. Pat. No. 4,066,000. Within the feed cover 350 of this embodiment the loading cog 317 is the component that prevents the feed sprocket 308 and the secondary link-belt sprocket 354 from back rotation.

The original Rostocil U.S. Pat. No. 4,066,000 used a steel flat spring to push down onto the cartridge that was to be rammed forward by the bolt. When the feed sprocket rotated the steel flat spring was pushed up by the incoming cartridge and then remained on top of the fresh cartridge just past the round centerline—at approximately the 11 o-clock position. The steel flat spring did not hold the link after the round was striped because it worked directly only on the round and not the link. Because there was no way to disengage it unloading the feed cover was tedious.

As shown in FIG. 32C, which is representative of loading cog 317 operation in this embodiment, the loading cog 317 works on both the cartridge 950-0 of any length and the cartridge link 371, cartridge carrier 323, and the feed sprocket wheel 314.

The loading cog 317 prevents the feed sprocket 308 and through it the feed drive shaft 486 from back rotation during bolt 200 counter-recoil, allowing the feed ratchet 480 to reset.

For unloading the loading cog is simply depressed to allow the linked-belt 370 of ammunition to be pulled free of the feed cover 350.

Polymer Link 371

Shown in FIG. 38A and FIG. 38B the cartridge link 371 of this embodiment is molded from polymer materials unlike the spring steel cartridge link of the original Rostocil U.S. Pat. No. 4,066,000. The cartridge link 371 is still a disintegrating side stripping link, only molded from polymer materials.

As shown in FIG. 37B any number of the cartridge links 371 can be interlocked together to form the linked-belt 370 of any length. As shown in FIG. 37A when a single shotshell is removed from the link-belt 370 the corresponding cartridge link 371 is freed.

The size of the ammo box 361 determines the number of shotshell that can be loaded. However in the linked-belt 370 can also be fed into the feed cover 350 from anywhere outside of the gun through what is know to those skilled in the art as a flex feed chute. Through the flex feed chute the linked-belt 371 could be drawn from a large storage box containing many rounds. Such installations could be made for use on any type of vehicle or ground installation.

The trunion hole 1002 as shown in FIG. 29 is provided for the mounting of the automatic gun 900 into those type of installations. The purpose of the trunion hole 1002 is to provide a hard point for mounting the automatic gun 900 into various mounts designed for use on various air or ground vehicles and ground installations such as tripods.

Shown in FIG. 38B the cartridge link 371 also incorporates a plurality of stiffening spring clip 656 to provide added stiffness to the polymer cartridge link 371. The stiffing spring clip 656 also adds strength to the cartridge retention clamps 3147 and increases the overall pull-apart strength of the linked-belt 370. However the stiffing spring clip 656 is not a requirement and may or may not be used.

Link Guidance and Control; the Front Link Guide 3716 and the Aft Link Guide 3717

Another improvement on the original Rostocil U.S. Pat. No. 4,066,000 is the addition of link guidance provisions to control the position of the cartridge link 371 within the feed cover 350.

The metal link used in Rostocil U.S. Pat. No. 4,066,000 had no provision to control its location other than the cartridge it was clamped onto. In the Rostocil U.S. Pat. No. 4,066,000 after the cartridge was striped from the link there is nothing to hold, position, or control the location of the metal cartridge link.

As shown in FIG. 38A and FIG. 38B the cartridge link 371 of this embodiment has the front the walls of the cartridge pocket 3142 notched to provide the front link guide 3716. On the aft face of the cartridge link 371 the cartridge retainer 3145 has been configured to provide the aft link guide 3717.

The front link guides 3716 shown in FIG. 38A moves within the front link guide path 3506 shown in FIG. 34A and FIG. 34B, which is molded into the front feed housing 352. The aft link guide 3707 shown in FIG. 38B move within the aft link guide path 3507 shown in FIG. 34A and FIG. 34B, which is molded into the aft feed housing 351. These link guides provide control of the cartridge link 371 while it is within the feed cover 350.

Link Thrust Grove 3715

As shown in FIG. 38A another improvement on the original Rostocil U.S. Pat. No. 4,066,000 is the addition of the link thrust groves 3715 to the cartridge link 371.

When the cartridge 950-0 is being stripped from the two links that lie in the cartridge pocket 3142 there is a strong cocking force applied to both cartridge links. The stripping force tries to cock them out of alignment with each other.

The metal link used in the Rostocil U.S. Pat. No. 4,066,000 had no provision to support the links as the cartridge was being stripped out of the two metal cartridge links. Other than putting support up in front of the link there was no attempt made to stabilized the two links in the cartridge pocket. This is common practice for most disintegrating link-belt feed systems.

Shown in FIG. 38A the cocking of the cartridge link 371 has been eliminated by the addition to the underside of the cartridge link 371 the link thrust grove 3715.

As shown in FIG. 34A and FIG. 34B the link thrust grove 3715 is keyed to the link thrust ribs 3505 located in the aft feed cover housing 351 and the front feed cover housing 352 to provide support to the cartridge link 371 being ejected. The center guide rib 355 shown in FIG. 34A provides support to the center link thrust grove shown in FIG. 38A. Shown in FIG. 34A and FIG. 34B the link thrust rib 3083 molded into the feed sprocket 308 engage both the cartridge links 371 of the cartridge 950-0 being stripped and.

Link Eject Cover 358

Shown in FIG. 34A and FIG. 34C is another improvement over the Rostocil U.S. Pat. No. 4,066,000. This is the addition of the link eject cover 358. When the feed cover 350 is attached to the gun the spent cartridge link 371 ejection port on the right side of the automatic gun 900 is open. The link eject cover 358 was added to the feed cover 350 to cover this opening when it is not in use.

The link eject cover 358 is spring-loaded with the link eject cover spring 358A to stay open and held closed by a detent. The cartridge link 371 when it is being ejected pushes the link eject cover 358 open so the cartridge link 371 can clear the feed cover 350. After firing the link eject cover 358 can be closed by hand.

Polymer Component Fabrication

Unlike the metal feed cover described in the Rostocil U.S. Pat. No. 4,066,000 the feed cover 350 shown in this embodiment is fabricated from polymer materials. Only the four springs used are made from metal. This is possible because the components used in the feed cover 350 were designed to be molded from polymers.

The strength requirements for the feed advance assemblies are less due to the lower bolt 200 velocity made possible by the use of the rim feed ramp 3143 and lockup design. The use of polymer materials for the fabrication of the components of the feed cover 350 permit it to be low in weight, low in fabrication cost, and able to withstand extreme environmental conditions.

The Ammo Box 361 and the Ready Box 360

Loading the Feed Cover to Make the Ready Box

FIG. 35 and FIG. 6 show the ready box 360 that permits the loading of the linked-belt 370 of ammunition into the automatic gun 900 to be fast and intuitive.

As shown in FIG. 35A after the feed cover 350 is loaded with the linked-belt 370 from the ammo box 361 the feed cover 350 is attached to the ammo box 361 to create the ready box 360.

FIG. 35A shows that to load the linked-belt 370 of ammunition into the feed cover 350 the leading cartridge link of the linked-belt 370—the end with the two hoops—is inserted into the bottom of the feed cover 350 and rolled up and over the secondary link-belt sprocket 354 and onto the feed sprocket 308.

As shown in FIG. 35A the linked-belt 370 is now past the loading cog 357 that will hold the linked-belt 370 securely in the feed cover 350. The loaded feed cover 350 can be directly loaded into the automatic gun 900 as described in the Section loading. Or the loaded feed cover 350 can be attached to the ammo box 361 to create the ready box 360.

Quick Attachment of the Feed Cover 350 to the Ammo Box 361

The creation of the ready box 360 shown in FIG. 35 is the same design concept described in the original Rostocil U.S. Pat. No. 4,066,000. However in the original Rostocil U.S. Pat. No. 4,066,000 the feed cover—called a mounting member—was attached to the ammo box using a set of detachable ammo box handles. If the ammo box handles were lost or damaged then the ammo box could not be attached to the feed cover.

The basic problem with the design concept of the Rostocil U.S. Pat. No. 4,066,000 was the attachment method used to secure the ammo box to the feed cover depended upon components that could be misplaced or lost.

As shown in FIG. 34A to overcome this problem the feed cover 350 in this embodiment uses the ammo box latches 359 and the ammo box latch springs 359A. The ammo box latches 359 are located in the feed cover 350 and are used to attach the ammo box 361 to the feed cover 350.

Attachment of the feed cover 350 onto the ammo box 361 is shown in FIG. 35A. At a slight angle insert the ammo box lug 3507 into the ammo box lug pocket 3617. Then snap the feed cover 350 down into the feed cover well 3611. This action will cam into the feed cover 350 the ammo box latches 359 to then snap out into the ammo box latch holes 3615.

The assembly procedure is both simple and quick. As shown in FIG. 34C the ammo box latches 359 are located on the lower right side of the feed cover 350 while FIG. 34D shows that the ammo box lug 3507 is located on the lower left side. There are no removable components that can be misplaced or lost and thus prevent the feed cover 350 from being attached to the ammo box 361.

Vertical Loading and Unloading of the Ready Box 360

An improvement to the Rostocil U.S. Pat. No. 4,066,000 is that the feed cover 350 of this embodiment is loaded into the gun from the bottom of the receiver 100 and not from the side.

The problem with loading the feed cover 350 into the automatic gun 900 from the side is that it cannot be removed or installed from the automatic gun 900 unless the bolt 200 is in the open-bolt position. Bottom insertion permits the feed cover 350 to be removed from the automatic gun 900 regardless of the position of the bolt 200.

The Improved Ammo Box 361

The ammo box 361 shown in FIG. 36 is an improvement over the ammo box described in Rostocil U.S. Pat. No. 4,066,000. Shown in FIG. 36 and FIG. 36A the ammo box 361 is provided with the removable ammo box lid 363. When the ammo box 361 is to be attached to the feed cover 350 the ammo box lid 363 is removed and the feed cover 350 attached as shown in the expanded view FIG. 35A.

Unlike the ammo box described in Rostocil U.S. Pat. No. 4,066,000 the ammo box 361 in this embodiment can be used over and over again in the field. As shown in FIG. 59A the ammo box lid 363 can be removed and then re-attached.

As shown in FIG. 36A the ammo box lid assembly 363 is made from two of the ammo box lid latch 365 and a single lid latch spring 365A, all housed within the ammo box lid body 364. The ammo box lid latches 365 work the same as the ammo box latches 359 and the installation of the ammo box lid 363 is the same as the installation of the feed cover 350 discussed above and shown in FIG. 35A.

Operation: Section C: Gun Fire Control System

The function of the fire control system is to set the automatic gun 900 mode of fire. The modes of fire are:

1. Automatic fire. The automatic gun 900 will continue to fire as long as the trigger 415 is pulled and there exist ammunition in the feed system. When firing automatic the bolt 200 is stopped and fired from the open-bolt position.

2. Semiautomatic fire. The automatic gun 900 will fire only the single cartridge 950-0 for each pull of the trigger 415. When firing semiautomatic the bolt 200 is stopped and fired from the closed-bolt position.

3. Safe. The automatic gun 900 will not fire when the trigger 415 is pulled. The trigger 415 is blocked from movement and the bolt hold-open 413 is blocked from movement. Safe mode will lock the bolt 200 in the closed-bolt position.

As shown in FIG. 39A the fire control system is entirely contained within the pistol grip 400. Fire control components comprise:

Hammer 411
Bolt hold-open 413
Trigger 415
Fire control selector 416
Disconnector 417
Auto-sear 419

As shown in FIG. 20A and FIG. 20B to select a fire mode the fire control selector arm 4165 is rotated either forward, up, or aft—relative to the receiver 100.

Rotate the fire control selector arm 4165 forward and the automatic gun 900 is positioned to only fire semiautomatic.

Rotate the fire control selector arm 4165 vertical and the automatic gun 900 is positioned to only fire automatic.

Rotate the fire control selector arm 4165 aft and the automatic gun 900 is safe. Both the trigger 415 and the bolt hold-open 413 are blocked from movement.

The fire control selector 416 can be pulled from the pistol grip 400 by the user and re-installed from either the left or right side of the pistol grip 400. This permits the fire control selector 416 to be used by either left-hand or right-hand users.

When the fire control selector 416 is installed in either the left or right side of the pistol grip 400 the direction the fire control selector arm 4165 for the three different fire mode positions does not change. Thus the user will know that to safe the automatic gun 900 the fire control selector arm 4165 rotated aft—regardless of which side of the pistol grip 400 the fire control selector 416 is installed.

The ability to change from left-hand to right-hand operation using a simple assembly and easily removed and changed by the user is very different from current assault rifles.

Current assault rifles can be characterized by the Sullivan U.S. Pat. No. 4,475,437 and the Armalite AR18 assault rifle described in the Miller U.S. Pat. No. 3,318,192. Both of these assault rifles cannot change the fire control selector from the right side to the left side nor can the fire control components be removed from the receiver for field maintenance.

FIG. 39A shows the components that comprise the fire control of this embodiment. The fire control selector 416 has the fire control selector slots 4163 cut into the fire control selector body 4161 that either permit or stop the movement of the trigger tang 4151 on the trigger 415, or the trigger tang 4151 on the disconnector 417, or the bolt hold-open 413 controls the automatic gun 900 mode of fire.

By changing the placement of the fire control selector slots 4163 cut into the fire control selector body 4161 the relative position of the fire control selector arm 4165 of any mode of fire can be changed. By simply rotating the fire control selector arm 4165 the mode of fire can be changed.

Furthermore by arranging the placement of the fire control selector slots 4163 cut into the fire control selector body 4161 the fire control selector 416 can be made to function with the same relative rotation from either side of the pistol grip 400.

In either automatic or semiautomatic positions when the trigger 415 is pulled it does two functions.

1. Trigger 415 movement will release the hammer 411.

2. Trigger 415 movement will pull down the bolt hold-open 413.

If the bolt 200 is in the open-bolt position the downward movement of the bolt hold-open 413 will releases the bolt 200 to move forward in counter-recoil travel.

Automatic Fire

FIG. 13A, FIG. 20A, and FIG. 20B show the relative position of the fire control system components for automatic fire. In automatic fire the cycle starts with the bolt 200 in the open-bolt position.

1. Rotate the fire control selector arm 4165 to vertical.

2. Pull the trigger 415. This movement rotates the trigger tang 4151 upward into the slot cut into the fire control selector body 4161.

3. Pulling the trigger 415 also pulls the bolt hold-open 413 down to releases the bolt 200 to move forward in counter-recoil.

4. Pulling the trigger 415 also release the hammer trigger sear 4115 from the trigger hammer sear 4155 to allow the hammer 411 to rotate slightly forward. Continued rotation of the hammer 411 is stopped by the auto-sear hammer sear 4195.

5. Final dwell movement of the locked bolt 200 going into battery will rotate the auto-sear hammer sear 4195 releasing the hammer 411 to fall and strike the firing pin 220. The automatic gun 900 fires.

6. After firing the recoil of the bolt 200 re-cocks the hammer 411 and resets the auto-sear 419 so it can engage the hammer 411 as soon as the bolt 200 turns around and goes into counter-recoil travel.

7. Final dwell movement of the locked bolt 200 going into battery will once again rotate the auto-sear 419 forward releasing the hammer 411 to fall and fire the automatic gun 900.

The automatic firing cycle will continue as long as the trigger 415 is pulled and there remains ammunition in the feed system.

This is made possible because cut into the fire control selector body 4161 of the fire control selector 416 are the fire control selector slots 4163 that permit only the trigger tang 4151 of the trigger 415 and the bolt hold-open 413 to move into the fire control selector body 4161 after the trigger 415 has been pulled.

As shown in FIG. 20A and FIG. 21A in the automatic fire there are no fire control selector slot 4163 that is in alignment with the disconnector tang 4171 of the disconnector 417. So when the trigger tang 4151 of the trigger 415 is rotated up into the slot cut into the fire control selector body 4161 of the fire control 416 the disconnector tang 4171 of the disconnector 417 is stopped from upward movement—forcing the disconnector 417 to rotate back and out of any potential engagement with the hammer 411 as the trigger 415 is pulled aft.

Blocking the disconnector 417 from functioning permits the hammer 411 to rotate slightly up after the bolt 200 cocked it. This slight upward rotation by the hammer 411 brings it out of any potential engagement with the trigger 415 or the disconnector 417. Thus the auto-sear 419 will be the only component to stop further forward rotation of the hammer 411.

FIG. 21A and FIG. 21B show the mid-cycle position of the fire control components for automatic fire. The hammer 411 is out of engagement with the trigger 415 and the tang of the disconnector 4171 is held depressed by the fire control selector body 4161. The auto-sear hammer sear 4195 is holding the hammer 411 back. As discussed above the auto-sear 419 will be rotated forward later in the cycle by the bolt 200 also to release the hammer 411 after a lockup dwell of approximately 10 mm.

Semiautomatic Fire

FIG. 23A, FIG. 23B, FIG. 24A, and FIG. 24B show the relative position of the fire control components when the automatic gun 900 also is positioned for semiautomatic fire. The semiautomatic cycle starts with the bolt 200 also in the closed-bolt position and the cycle of operation is as follows.

1. Rotate the fire control selector arm 4165 forward.

2. Pull the trigger 415. This movement rotates the trigger tang 4151 of the trigger 415 upward into the slot cut into the fire control selector body 4161.

3. Pulling the trigger 415 also rotates the bolt hold-open 413 down.

4. Pulling the trigger 415 also releases the hammer 411 from the trigger hammer sear 4155 and allows the hammer 411 to rotate forward to strike the firing pin 220.

5. When the automatic gun 900 is fired from the closed-bolt position the auto-sear 419 has already been rotated forward by the act of closing of the bolt and is thus out of engagement with the hammer 411. So when the hammer 411 falls after being released by the trigger hammer sear 4155 the auto-sear 419 will not stop it from striking the firing pin 220.

6. The automatic gun 900 fires a single round.

7. The bolt 200 goes into recoil and re-cocks the hammer 411.

8. Since the trigger 415 has been pulled aft the trigger hammer sear 4155 cannot engage the hammer trigger sear 4115 when the trigger 415 is held aft.

9. However fire control selector 416 has rotated into alignment a slot for the disconnector tang 4171 to move up. As shown in FIG. 19 the disconnector 417 is mounted between the trigger sear plate 415-2 and the trigger body 415-1, so when the trigger 415 is rotated aft the disconnector tang 4171 of the disconnector 417 is allowed to move forward to engage the hammer 411.

10. The trigger cam pin 642 is still holding the bolt hold-open trigger hole 4131 down so the bolt 200 returns forward chambering the fresh cartridge 950-0 and finishing lockup and lockup dwell. However the automatic gun 900 will not fire.

11. As shown in FIG. 23A the automatic gun 900 does not fire because even though the trigger 415 is still held aft the disconnector 417 is now holding the hammer disconnector sear 4117 and thus the hammer 411 in the cocked position—stopping the firing of the automatic gun 900.

12. The trigger 415 must be released to be allowed to rotate forward.

13. As shown in FIG. 24A releasing the trigger 415 the disconnector hammer sear 4175 is pulled off engagement with the hammer disconnector sear 4117. This release allows the hammer 411 to rotate slightly forward.

14. Forward rotation of the trigger 415 also moves the trigger hammer sear 4155 back and into potential engagement with the hammer trigger sear 4115.

15. After the disconnector hammer sear 4175 releases the hammer disconnector sear 4117 to rotate the hammer 411 forward the trigger hammer sear 4155 stops further forward rotation by the hammer 411.

16. The trigger 415 is once again pulled to start the firing cycle over. To shoot the automatic gun 900 the trigger 415 must be pulled and then released and then pulled again for each shot.

Safe Mode

FIG. 25A and FIG. 25B show the relative position of the fire control components when the automatic gun 900 is put into the Safe mode. To position the automatic gun 900 for the safe mode the following procedure is used starting with the bolt 200 in either closed-bolt or open-bolt position.

1. The fire control selector arm 4165 is rotated aft.

2. As shown in shown in FIG. 25A and FIG. 39 when the fire control selector 416 is in the safe mode the trigger tang 4151 is stopped from any upward movement.

3. As shown in shown in FIG. 25B when the fire control selector 416 is in the safe position it also rotates the bolt hold-open fire selector slot 4133 down and blocks further movement of the bolt hold-open 413.

4. As shown in shown in FIG. 25A the trigger 415 cannot move so the hammer 411 cannot be released.

5. When the automatic gun 900 is in the safe mode the fire control selector 416 can be rotated to either the semiautomatic or automatic mode of firing.

Unique to this embodiment are the simple design of the fire control components and the high use of polymers to mold most of the components. Also unique is the housing within the removable pistol grip 400 all of the fire control components and the ability to change from left-hand or right-hand operation by changing only one component.

Operation: Section D: Gun Special Features

Within this Section the following special features are discussed:

1. Folding shoulder stock 700.

2. Flechette 980 loading into the 3½-inch shotshell 950-1.

Gun Special Feature Section D—Folding Shoulder Stock 700

FIG. 26 and FIG. 26A show the automatic gun 900 with the folding shoulder stock 700 being installed and in the extended position. FIG. 27 and FIG. 27A show the folding shoulder stock 700 being put into stow and the final stow position.

Deployment of the Folding Shoulder Stock 700:

As shown in FIG. 27 folding shoulder stock stow ball detent 613 located in the butt of the folding shoulder stock 700 is pulled off the folding shoulder stock stow stud 114 located on the right side of the automatic gun 900. The folding shoulder stock 700 is then rotated on the folding shoulder stock pivot studs 7003 in the pistol grip folding shoulder stock hinges 4003 shown in FIG. 26 out to the extended position as shown in FIG. 26A. As shown in FIG. 26 the rotation of the folding shoulder stock body 701 moves the folding shoulder stock locking key grove 7001 molded into the front face of the folding shoulder stock body 701 over the pistol grip folding shoulder stock locking key 4001 molded into the aft face of the pistol grip body 401. Once extended as shown in FIG. 26A the folding shoulder stock will snap the folding shoulder stock latch 703 into engagement under the folding shoulder stock latch plate 427 under the push from the folding shoulder stock latch spring 703A. The folding shoulder stock 700 is now locked into the extended position.

The folding shoulder stock latch 703 and the folding shoulder stock latch spring 703A are shown in FIG. 41A while the folding shoulder stock latch plate 427 is shown in FIG. 39C. Also identified in FIG. 39C are the pistol grip folding shoulder stock locking key 4001 and the pistol grip folding shoulder stock hinge 4003, both molded into the aft face of the pistol grip body 401.

As shown in FIG. 26 the function of the pistol grip folding shoulder stock locking key 4001 and the folding shoulder stock locking key grove 7001 is to prevent the folding shoulder stock pivot studs 7003 from moving up and out of engagement with the pistol grip folding shoulder stock hinge 4003 when the folding shoulder stock body 701 is put into the extended position.

Stowing the Folding Shoulder Stock 700

Shown in FIG. 26A depress the folding shoulder stock latch 703 and rotate to the right the folding shoulder stock 700 on the folding shoulder stock pivot studs 7003 rotating in the pistol grip folding shoulder stock hinges 4003. Shown in FIG. 27 the folding shoulder stock 700 is snapped onto the folding shoulder stock stow stud 114. FIG. 27A where it is held by the folding shoulder stock stow ball detent 613.

Removal or Installation of the Folding Shoulder Stock 700

FIG. 26A shows the removal and installation of the folding shoulder stock 700. To remove depress the folding shoulder stock latch 703 and rotate the folding shoulder stock 700 as shown in FIG. 26A. Then pull the folding shoulder stock pivot studs 7003 up and out of the pistol grip folding shoulder stock hinges 4003. The folding shoulder stock 700 has been removed from the gun. The folding shoulder stock 700 is installed onto the gun using the same procedure but in reverse.

Gun Special Feature Section D—Flechette 980 Loaded 3½ Inch Shotshell 950-1

The flechette 980 is used in the 3½-inch shotshell 950-1 of this embodiment and shown in FIG. 28 and FIG. 28A. Shown in FIG. 28A the flechette 980 comprises a unique design to improve both the terminal effect and the flight characteristics of the flechette 980.

Flechette Chisel Point Nose 9805:

The flechette chisel point nose 9805 on the flechette 980 is shown in FIG. 28A. The flechette chisel point nose 9805 of this embodiment does not have a point in the classic meaning—that being a symmetrical point about the centerline of the flechette body 9801. The front of the flechette body 9801 in this embodiment is a chamfer cut across the flechette body 9801 that is called in this embodiment the flechette chisel point nose 9805.

The flechette chisel point nose 9805 induces a pitching moment into the flechette 980 when there is a medium change in flight medium. When the flechette chisel point nose 9805 enters the target while the flechette tail fins 9803 are still outside that medium there is pitching moment put on the flechette body 9801 that force the flechette to divert from the original flight axis. The result is simple, the flechette chisel point nose 9805 makes the flechette 980 turn and tumble in the target and not just pass straight through—as common to the flechettes in use today. The amount of angle on the flechette chisel point nose 9805 is not critical and can vary greatly.

Flechette Tail Fin 9803 has a Helix

FIG. 28A shows a slight helix on the flechette tail fins 9803. The flechette tail fin 9803 twist angle shown in this embodiment is approximately 7 degrees to the centerline axis of the flechette body 9801. However this angle is not critical to the basic design concept and sprit and can be changed. If only one or more of the flechette tail fins 9803 have a helix it will be enough to cause the flechette 980 to roll about its flight axis. It is not the intent of this embodiment to have a large enough helical angle to spin the flechette 980 at a high rate. The flechette tail fin 9803 helical angle need only be enough to produce a slow roll about the flight axis.

The reason for wanting the flechette to only roll about the flight axis is because no flechette can be made perfectly symmetric. Some feature on the flechette 980 will be out of symmetry. ANY feature out of symmetry will induce a divergence from the flight axis to cause the flechette to either hook or slice—to use golf terms—as the flechette travels down range.

Usually this divergence is because no set of flechette tail fins can be made perfectly symmetric—and a non-symmetric fin or fins will cause the flechette to diverge from the flight axis in free flight. This means that the flechette cluster 952 when launched will diverge in an ever-increasing cone—like the mouth of a trumpet—as they travel down range. This translates into a impact pattern diameter greater than it should be.

To reduce this ever increasing divergence the helix on the flechette tail fins 9803 causes the flechette 980 roll about its flight axis. Thus the divergence induced by the flechette non-symmetric feature(s) will be contained within the roll of the flechette 980 as a spiraling helical flight path—a corkscrew style flight path. Even a slow roll of the flechette 980 will keep the flechette cluster 952 in a tighter group—thus a smaller pattern diameter.

Flechette Sabot 951

Shown in FIG. 28 is the simple sabot 951 comprising the sabot clam shell sides 953 and the sabot base 955 that contain the flechette cluster 952. The front nose of the sabot clamshells side 953 are dished to permit ram air to split the sabot clam shell sides 953 apart after the sabot 951 has cleared the muzzle of the barrel body 505. By retaining the base skirt of the sabot clamshell sides 953 inside the sabot base 955 the sides of the sabot clamshell sides 953 are made to peel back—like a banana—to depart the flechette cluster 952 with as little disturbance as possible. The sabot 951 in this embodiment is shown with the two sabot clamshells sides 953—but that quantity can be increased to 3 or more without changing the basic concept or the spirit shown in this embodiment.

Grenade Launcher Operation, FIG. 42 Through FIG. 53A

Section 1. Grenade launcher basic operation. To understand how the grenade launcher assembly 8000 is made and operates.

Section 2. Grenade launcher double-action lock, a detail discussion. To understand how the launcher double-action lock works and is made a special series of nine sectionalized views FIG. 50 through FIG. 53A are provided.

Section 3. Mounting grenade launcher. To understand how the grenade launcher 8000 attaches to the bottom accessory rail 184 of the automatic gun 900, four sectionalized views FIG. 42 through FIG. 43A are provided:

Section 4. Grenade launcher loading and unloading ammunition. To understand how the grenade launcher is loaded-unloaded three sectionalized views FIG. 44 through FIG. 44B are provided.

Section 5. Grenade launcher special features. Two unique special features are discussed:

1. The grenade launcher cannot fire unless the cylinder 8380 is in correct alignment with the launcher barrel 8450.

2. The cylinder 8380 can be hand rotated either clockwise or counter clockwise.

Common to ALL Sectionalized Views are the Following Special Viewing Conditions.

- The breech body 8210 and the breech nut 8214 has had their right side partially sectionalized. These components are shown non sectionalized in the breech 8200 expanded view FIG. 48.
- The launcher top strap 8415 and the launcher barrel 8450 have their right side partially sectionalized. These components are shown non sectionalized in the frame 8400 expanded view FIG. 47.
- The launcher hammer 8323, the launcher trigger 8233, and the launcher firing pin 8231 have been partially sectionalized. These components are shown non-sectionalized in the breech 8200 expanded view FIG. 48.
- The cylinder body 8387, the front pivot bushing 8385, the aft pivot bushing 8384 and the cylinder chamber 83871 have had a 120-degree segment sectionalized. These components are shown non sectionalized in the cylinder 8380 expanded view FIG. 49.

Section 1. Grenade Launcher Basic Operation

After loading, which is covered in Section 4 and shown in FIG. 44A, the cylinder 8380 with the three 40 mm NATO grenade cartridges 8950 is rotated to align the cylinder chamber 83871 with the launcher barrel 8450, correct alignment is shown in FIG. 42. As shown in FIG. 44A when the cylinder 8380 is in correct alignment the set of two strong launcher ball detents 8637 located in the breech nut 8214 of the breech 8200 engage the two launcher detent recess 83841 located on the aft face of the aft pivot bushing 8384.

The launcher trigger 8233 is pulled aft. As shown in FIG. 51A the aft movement of the launcher trigger 8233 pushes the cylinder lock 8235 down into engagement with the cylinder lock notch 83872 located on the cylinder body 8387. Pulling the launcher trigger 8233 aft also retract the launcher hammer 8232 to compress the launcher hammer spring 8232A.

Then as shown in FIG. 52A after the launcher hammer 8232 has been pulled all the way back the launcher sear 8234 that engaged the launcher hammer 8233 to ride over the body of the lock plate screw 8228. The launcher sear 8234 movement over the lock plate screw 8228 pushes the launcher sear

8234 out of engagement with the launcher hammer 8232. As shown in FIG. 23A the launcher hammer 8232 now falls to strike the launcher firing pin 8231 to fire the 40 mm NATO grenade cartridge 8950.

After firing the launcher trigger 8233 is released. As shown in FIG. 50A and FIG. 50B this allows the launcher double-action lock to reset. The cylinder 8380 is then rotated by hand clockwise or counter-clockwise one position to align the fresh 40 mm NATO grenade cartridge 8950 with the launcher barrel 8450. Once again the launcher trigger 8233 is pulled aft to work the lock to fire the grenade cartridge 9850. This Firing cycle is repeated until all of the grenade cartridges 8950 in the cylinder 8380 have been fired.

Section 2. Grenade Launcher Double-Action Lock, a Detail Discussion

Launcher Double-Action Lock FIG. 50, Grenade Launcher Ready to Fire.

FIG. 50 shows the grenade launcher 8000 ready to fire and the areas of coverage for FIG. 50A and FIG. 50B. Overall FIG. 50 shows that the cylinder 8380 is securely held in the frame 8400 by the cylinder pivot screw 8455. The cylinder 8380 is loaded with the three 40 mm NATO grenade cartridges 8950—two of which are seen in FIG. 50. The cylinder 8380 is in alignment with the launcher barrel 8450.

The close-up view FIG. 50A shows the breech assembly 8200 and frame assembly 8400 components at the start of the launcher hammer 8232 movement. Also shown is area of coverage for FIG. 50B that shows a close-up view the launcher sear 8234 region at the start of the launcher hammer 8232 movement.

In FIG. 50A the cylinder lock 8235 is up and out of engagement with the cylinder lock notch 83872. The lock trigger tang 82351 is on the launcher trigger lock cam 82331. The launcher latch 8236 and the launcher latch release lever 8212 are up under the strong spring load from the latch springs 8236A. Within the breech body 8210 the launcher firing pin 8231 is held aft by the weak launcher firing pin return spring 8231A, and the launcher hammer 8232 is pushed forward by the strong launcher hammer spring 8232A. The launcher trigger 8233 is held forward by the weak launcher trigger return spring 8233A and the launcher sear 8234 is held down by the strong launcher sear spring 8234A.

The close-up view in FIG. 50B shows the launcher sear 8234 region at the start of the launcher hammer 8232 movement. The launcher trigger 8233 is ready to be pulled. The launcher hammer 8232 is held forward by the strong launcher hammer spring 8232A. The launcher sear 8234 is held down by the strong launcher sear spring 8234A. The launcher sear hammer face 82341 is in engagement on the launcher hammer sear 82321. The launcher sear cam face 82342 is forward of the screw sear cam face 82281 located on the lock plate screw 8228.

Grenade Launcher Double-Action Lock FIG. 51, Launcher Trigger Half-Way Back.

Overall view FIG. 51 shows the grenade launcher 8000 with the launcher trigger 8233 pulled halfway back and area of coverage for close-up view FIG. 51A that shows the launcher trigger 8233 and the launcher sear 8234 regions.

Close-up view FIG. 51A shows the cylinder lock 8235 depressed and the lock cylinder tang 82352 now engaged in the cylinder lock notch 83872. The launcher trigger lock support 82332 is now under the lock trigger tang 82351.

FIG. 51A also shows the launcher trigger 8233 pulled aft halfway back. The launcher firing pin 8231 has been reset aft by the launcher firing pin spring launcher 231A and is now resting aft against the breech body 8210 while protruding into the launcher hammer 8232 operating cavity. The sear hammer face 2341 has pulled the launcher hammer sear 82321 aft compressing the launcher hammer spring 8232A. Note that the launcher sear 8234 has not yet come in contact with the lock plate screw 8228.

Grenade Launcher Double-Action Lock FIG. 52, Launcher Trigger all the Way Back.

The overall view FIG. 52 shows the grenade launcher 8000 with the launcher trigger 8233 pulled all the way back and area of coverage for close-up view FIG. 52A that shows the launcher trigger 8233 and the launcher sear 8234 regions. FIG. 52 shows that the launcher trigger lock support 82332 has moved further under the lock trigger tang 82351.

The close-up view FIG. 94A shows the movement of the launcher trigger 8233 aft has pushed the launcher sear cam face 82342 up and over the screw sear cam face 82281. Upward movement of the launcher sear 8234 has pulled the launcher sear hammer face 82341 out of engagement with the launcher hammer sear 82321, releasing the launcher hammer 8232 which can now move forward under the force of the launcher hammer spring 82332A.

Grenade Launcher Double-Action Lock FIG. 53, Launcher Fired.

The overall view FIG. 53 shows the grenade launcher 8000 after the launcher hammer 8232 has fallen and struck the launcher firing pin hammer face 82311 and area of coverage for close-up view FIG. 96A showing that the launcher sear 8234 has been pushed up by the lock plate screw 8228.

The overall view FIG. 53 shows that the launcher trigger 8233 is fully aft. The cylinder lock tang 82352 is down and fully engaged in the cylinder lock notch 83872. The lock trigger tang 82351 is still over the launcher trigger lock support 82332. The launcher hammer 8232 has been pushed forward by the launcher hammer spring 8232A and has struck the launcher firing pin hammer face 82311—forcing the launcher firing pin 8231 forward to fire the 40 mm NATO grenade cartridge 8950.

The close-up view FIG. 53A shows that the launcher sear 8234 has been pushed up by the lock plate screw 8228. The launcher hammer 8232 has moved forward by force of the launcher hammer spring 8232A. The forward movement of the launcher hammer 8232 has moved the launcher hammer sear 82321 forward and under the launcher sear 8234. The lock plate screw 8228 is holding the launcher sear 8234 up.

The following forward movement of the launcher trigger 8233 will permit the launcher sear hammer face 82341 to reset in front of the launcher hammer sear 82321, making the grenade launcher 8000 ready for the next firing.

Section 3. Grenade Launcher Mounting

The overall view FIG. 42 shows the mounting of the sectionalized grenade launcher 8000 onto the bottom accessory rail 184 of the automatic gun 900 and area of coverage for FIG. 43A.

As shown in the close-up view FIG. 43A depressing the launcher latch release lever 8212 pulls the launcher latches 8236 down, which will permit the accessory rail grove 84151 to slid back and over the bottom accessory rail 184 until stopped by the launcher buffer 8416 that is shown in FIG. 43.

The launcher latches 8236 stop the grenade launcher from moving forward off the bottom accessory rail 184. The launcher buffer 8416 stops the grenade launcher 8000 from further aft movement and buffers the grenade launcher 8000 firing recoil loads.

To remove the grenade launcher 8000 from the bottom accessory rail 184 the launcher latch release lever 8212 is depressed to release the launcher latches 8236 from engagement with the bottom accessory rail latch notch 1841 and then slide the grenade launcher 8400 forward off the bottom accessory rail 184.

Section 4. Grenade Launcher Loading and Unloading

The overall right side view FIG. 44 shows the loading and ejection operation for the grenade launcher 8000 and area of coverage for FIG. 44A. FIG. 44B shows the loading and ejection operation from the left aft side.

The loading and ejection sequence follows:

1. As shown in FIG. 44A and FIG. 44B swing open the loading gate 8215.

2. Again as shown in FIG. 44A and FIG. 44B rotate the cylinder 8380 approximately 60 degrees in either direction until the cylinder chamber 83871 is in alignment with the bottom opening in the frame 8400.

3. As shown in FIG. 44A and FIG. 44B to eject the fired case grasp the launcher ejector screw knob 8614 and pull aft to remove the fired 40 mm NATO grenade cartridge case 89501 from the cylinder chamber 83871.

4. After ejection of the 40 mm NATO grenade cartridge case 89501 release the launcher ejector screw knob 8614 and the launcher ejector return spring 8386A that is shown in FIG. 49 will return the launcher ejector 8386 to the stow position within the cylinder body 8387.

5. As shown in FIG. 44A and FIG. 44B to load a fresh 40 mm NATO grenade cartridge 8950 simply insert it into the cylinder chamber 83871.

6. Swing the loading gate 8215 closed as shown in FIG. 51. The launcher ball detent 8637 shown in FIG. 44B will hold the loading gate 8215 closed.

Section 5. Grenade Launcher Special Features

The cylinder 8380 can be rotated by hand in either the counter-clockwise or clockwise direction. Rotation of the cylinder 8380 is only prohibited when the launcher trigger 8233 is pulled. Pulling the launcher trigger 8233 engages the cylinder lock 8235 in the cylinder lock notch 83872 stopping any rotation of the cylinder 8380.

The grenade launcher cannot be fired unless one of the three cylinder chambers 83871 are in correct alignment with the launcher barrel 8450.

CONCLUSIONS, RAMIFICATIONS, AND SCOPE

As can be seen from the foregoing, the present embodiment provides a automatic gun, a grenade launcher, and a improved flechette shotshell integrated into a improved weapon system called the Urban Combat System that is optimized for urban combat use that, compared to its conventional counterparts, provides less complex construction, reduced component fabrication cost, substantially improved field service ability for both the automatic gun and the grenade launcher, and markedly reduces the automatic gun's firing recoil loads to thereby correspondingly improve the automatic gun's controllability in automatic fire.

While the automatic gun of the present embodiment has been representatively illustrated and described as being a weapon fired and supported by a person, it will be readily appreciated by those of skill in this particular art that it also can be operatively fired and supported on a variety of aircraft and ground support structures if desired.

While the grenade launcher of the present embodiment has been representatively illustrated and described as being the grenade launcher that can be fired while mounted on a host weapon, it will be readily appreciated by those of skill in this particular art that the grenade launcher can also be fired from and supported on a variety of mounts including but not limited to operatively fired independent of any host weapon if desired.

Additionally, while the principles of the present embodiment have been illustratively incorporated in the automatic gun that fires shotshell cartridges, it will be appreciated that such principles could also be incorporated in a variety of other types and sizes of automatic guns if desired.

Additionally, while the principles of the present embodiment have been illustratively incorporated in the multiple shot grenade launcher firing grenade cartridges, it will be appreciated that such principles could also be incorporated in a variety of other types and sizes of weapons firing various types and sizes of cartridges if desired.

The foregoing detail description is to be clearly understood as being given by way of illustration and example only, the sprit and scope of the present embodiment being limited solely by the appended claims.

I claim:

1. A weapon for firing live ammunition comprising:

a. a receiver assembly;

b. a barrel assembly including a chamber slidably mounted in said receiver assembly to move fore and aft within the receiver assembly;

c. a bolt assembly adapted to advance a feed system while ejecting fired cartridge cases during its aft movement and to chamber live cartridges and reset said feed system during its fore movement;

d. a pistol grip assembly;

wherein said feed system further comprises;

e. a feed ratchet mounted in said pistol grip assembly or said receiver assembly that rotates a feed drive shaft in one direction through a planetary ring gear that amplifies the rotational movement; and f. an index plunger to engage a corresponding pocket in said receiver assembly when said feed drive shaft has engaged a feed sprocket.

2. The weapon of claim 1 wherein said feed sprocket comprises;

a. a plurality of sprocket pockets into which said cartridge, a cartridge link or a cartridge carrier are adapted to lie; and b. a plurality of ribs or grooves in said sprocket pockets to restrain fore and aft movement of said cartridge link or said cartridge carrier.

3. The weapon of claim 1 wherein said feed system includes a feed assembly comprising;

a. a feed cover assembly made predominately from polymer materials and slidably removable from said weapon for loading and unloading of said ammunition; and b. a magazine assembly made predominately from polymer materials and slidably removable from said weapon for loading and unloading of said ammunition.

4. The weapon of claim 3 wherein said feed cover assembly comprises;

a. a linked-belt that is pulled into said feed cover assembly by the rotation of a driven secondary feed sprocket and positioned within said feed cover at near to the same plane of the driven said feed sprocket for a minimum of one belt pitch; and b. a cartridge link with three retention clamps arranged in a Y configuration wherein said single retention clamp of one said cartridge link can be placed between two retention clamps from another said cartridge link wherein said two cartridge links can clamp over a cartridge to compose a linked-belt of cartridges.

5. The weapon of claim 4 wherein said cartridge link has;

a. a single or plurality of said retention clamps to hold said cartridge;

b. a rim feed ramp located on the aft face of the aft retention clamp to cam a cartridge rim upward as said cartridge is pushed forward within said cartridge link;

c. a groove to restrain the fore and aft movement of said cartridge rim within said cartridge link;

d. a single or plurality of thrust grooves or thrust ribs to engage a corresponding thrust rib or thrust groove in said feed sprocket;

e. means for guiding the cartridge link while in the feed cover on the front and aft body of the cartridge link; and f. a groove to allow a single or plurality of metal-stiffening spring clips to be added to said retention clamps.

6. The weapon of claim 4 wherein said feed cover assembly contains latches that can latch into corresponding receptacles in an ammo box comprising an opening in the top for allowing the feed of said linked-belt to said weapon.

7. The weapon of claim 4 wherein said cartridges are shot-shells.

8. The weapon of claim 3 wherein said magazine assembly comprises;

a. one or more feed sprockets within said magazine assembly wherein they are driven in rotation by said feed drive shaft;

b. a plurality of cartridge carriers wherein the cartridge carriers are connected to each other to form a continuous chain to be driven within said magazine by said feed sprockets, or;

c. a single feed sprocket wheel containing a plurality of cartridge pockets.

9. The weapon of claim 8 wherein said cartridge carriers comprise;

a. retention clamps to hold a cartridge;

b. a rim feed ramp located on the aft face of the said retention clamp to cam said cartridge rim upward as said cartridge is pushed forward within said cartridge carrier;

c. a groove to restrain said fore and aft movement of said cartridge rim;

d. a single or plurality of thrust grooves or thrust ribs to engage corresponding thrust ribs or thrust groove in said feed sprocket; and e. a groove to allow a single or plurality of metal-stiffening spring clips to be added to said retention clamps.

10. The weapon of claim 8, wherein said cartridge pockets located in said feed sprocket wheel comprise;

a. retention clamps to hold a cartridge;

b. a rim feed ramp located on the aft face of said retention clamp to cam said cartridge rim upward as said cartridge is pushed forward within said cartridge pocket of said feed sprocket wheel; and c. a groove to restrain said fore and aft movement of said cartridge rim.

11. The weapon of claim 1 that is adapted to mount and demount a foldable shoulder stock having one or more pivot studs or hinges for mounting onto corresponding hinges or pivot studs located on said weapon.

* * * * *